US008827843B2

(12) United States Patent
Priester et al.

(10) Patent No.: US 8,827,843 B2
(45) Date of Patent: Sep. 9, 2014

(54) MUSCLE TRAINING APPARATUS AND METHOD

(76) Inventors: William B. Priester, Jackson, TN (US); Richard E. May, Birmingham, AL (US); C. Bryan Dawson, Jackson, TN (US); David A. Ward, Jackson, TN (US)

( * ) Notice: Subject to any disclaimer, the term of this patent is extended or adjusted under 35 U.S.C. 154(b) by 0 days.

(21) Appl. No.: 13/478,890

(22) Filed: May 23, 2012

(65) Prior Publication Data

US 2013/0150174 A1 Jun. 13, 2013

Related U.S. Application Data

(60) Division of application No. 12/237,502, filed on Sep. 25, 2008, now Pat. No. 8,398,501, which is a continuation-in-part of application No. 11/376,974, filed on Mar. 16, 2006, now Pat. No. 8,597,133, and a continuation-in-part of application No. 11/857,049, filed on Sep. 18, 2007, now Pat. No. 7,766,760, which is a continuation-in-part of application No. 10/681,971, filed on Oct. 9, 2003, now Pat. No. 7,351,157.

(51) Int. Cl.

| | |
|---|---|
| ***A63B 69/36*** | (2006.01) |
| ***A63B 24/00*** | (2006.01) |
| ***A63B 21/06*** | (2006.01) |

(52) U.S. Cl.

CPC ..... *A63B 21/0608* (2013.01); *A63B 69/3623* (2013.01); *A63B 69/3614* (2013.01); *A63B 24/00* (2013.01); *A63B 69/36* (2013.01); *A63B 2220/806* (2013.01); *A63B 2207/02* (2013.01); *A63B 69/3632* (2013.01); *A63B 2220/40* (2013.01); *A63B 24/0003* (2013.01)

USPC ..... 473/409; 473/219; 473/228

(58) Field of Classification Search

USPC ..... 473/223, 226, 228, 437, 457, 451, 409

See application file for complete search history.

(56) References Cited

U.S. PATENT DOCUMENTS

| | | | | |
|---|---|---|---|---|
| 1,712,537 | A | 5/1929 | White | |
| 2,482,015 | A | 9/1949 | McConnell | |
| 2,804,306 | A | 8/1957 | Chedister et al. | |
| 2,910,297 | A | 10/1959 | Bonetate | |
| 3,565,444 | A | 2/1971 | LaRocca | |
| 3,758,117 | A | 9/1973 | Harrison | |
| 3,809,397 | A * | 5/1974 | Gruenewald | 473/457 |
| 3,829,102 | A | 8/1974 | Harrison | |
| 3,997,115 | A | 12/1976 | Licudine | |
| 4,017,083 | A | 4/1977 | Johnson | |

(Continued)

*Primary Examiner* — Nini Legesse

(74) *Attorney, Agent, or Firm* — Ludeka Neely Group, P.C.

(57) ABSTRACT

The invention is directed to a muscle trainer and methods for exercising opposing muscles of a person moving an implement. If the opposing muscles were of appropriate strength, the opposing muscles would apply forces in opposite directions to the implement to assist in maintaining an ideal movement of the implement. The methods train the opposing muscles to consistently move the implement in an ideal way to accomplish the function. The methods include: (a) moving the muscle trainer through an actual motion; (b) determining a difference between the actual motion and an ideal motion, the difference indicating a dominating force direction in which the dominating muscles urge the muscle trainer; (c) applying an external force to the muscle trainer to urge the muscle trainer in the dominating force direction; and (d) using the non-dominating muscles to urge the muscle trainer against the external force to thereby exercise the non-dominating muscles.

35 Claims, 32 Drawing Sheets

(56) References Cited

U.S. PATENT DOCUMENTS

| | | | | | |
|---|---|---|---|---|---|
| 4,379,552 | A | | 4/1983 | Webb et al. | |
| 4,576,378 | A | | 3/1986 | Backus | |
| 4,907,800 | A | | 3/1990 | Paddamaneck | |
| 5,002,275 | A | * | 3/1991 | Beutler et al. | 473/228 |
| 5,096,199 | A | | 3/1992 | Wyatt, Jr. et al. | |
| 5,100,148 | A | | 3/1992 | Smith | |
| 5,143,376 | A | | 9/1992 | Johnson | |
| 5,165,683 | A | * | 11/1992 | Beutler et al. | 473/228 |
| 5,184,825 | A | * | 2/1993 | Ruth | 473/228 |
| 5,207,625 | A | * | 5/1993 | White | 482/111 |
| 5,209,482 | A | | 5/1993 | Hopfer | |
| 5,230,512 | A | | 7/1993 | Tattershall | |
| 5,236,192 | A | | 8/1993 | Pitzel | |
| 5,310,188 | A | * | 5/1994 | Hernberg | 473/206 |
| 5,338,035 | A | | 8/1994 | Lyford | |
| 5,362,059 | A | * | 11/1994 | Grossman | 473/228 |
| 5,374,063 | A | | 12/1994 | Ogden | |
| 5,435,696 | A | | 7/1995 | Cunning | |
| 5,441,269 | A | | 8/1995 | Henwood | |
| 5,456,650 | A | | 10/1995 | Williams, Jr. et al. | |
| 5,467,538 | A | | 11/1995 | Chou et al. | |
| 5,571,048 | A | | 11/1996 | Kenney | |
| 5,613,915 | A | | 3/1997 | Van Allen, Jr. | |
| 5,634,857 | A | | 6/1997 | Bradshaw et al. | |
| 5,688,183 | A | | 11/1997 | Sabatino et al. | |
| 5,694,340 | A | | 12/1997 | Kim | |
| 5,772,522 | A | | 6/1998 | Nesbit et al. | |
| 5,845,885 | A | | 12/1998 | Carnevali | |
| 5,971,828 | A | | 10/1999 | Lin | |
| 5,971,864 | A | | 10/1999 | Joshi et al. | |
| D416,081 | S | | 11/1999 | Lee | |
| 6,079,949 | A | | 6/2000 | Litvin | |
| 6,224,493 | B1 | | 5/2001 | Lee et al. | |
| 6,238,299 | B1 | | 5/2001 | Barnette | |
| 6,441,745 | B1 | | 8/2002 | Gates | |
| 6,533,551 | B2 | | 3/2003 | Escobar | |
| 6,739,981 | B1 | | 5/2004 | Lin | |
| 6,843,731 | B1 | * | 1/2005 | Oprandi | 473/238 |
| 6,851,933 | B2 | | 2/2005 | Cortez | |
| 7,713,061 | B1 | | 5/2010 | Albertini | |
| 7,736,242 | B2 | | 6/2010 | Stites et al. | |
| 2001/0031666 | A1 | | 10/2001 | Knecht | |
| 2002/0016213 | A1 | | 2/2002 | Templeton | |
| 2002/0077189 | A1 | | 6/2002 | Tuer et al. | |
| 2003/0207719 | A1 | * | 11/2003 | Hughes | 473/228 |
| 2004/0097297 | A1 | | 5/2004 | Strite | |
| 2004/0259651 | A1 | | 12/2004 | Storek | |
| 2005/0215336 | A1 | * | 9/2005 | Ueda et al. | 473/131 |
| 2006/0025229 | A1 | * | 2/2006 | Mahajan et al. | 473/131 |

* cited by examiner

| | Over-rotation (O) | Merged (M) | Under-rotation (U) |
|---|---|---|---|
| Behind-the-ideal-shaft-plane (B) | B/O | B/M | B/U |
| In-the-ideal-shaft-plane (I) | I/O | I/M | I/U |
| Front-of--the-ideal-shaft-plane (F) | F/O | F/M | F/U |

*FIG. 25A*

| | Hook (H) | Square (+) | Slice (S) |
|---|---|---|---|
| Error Inside Out (EIO) | EIO/H | EIO/+ | EIO/S |
| Ideal Inside Out (IIO) | IIO/H | IIO/+ | IIO/S |
| Error Outside In (EOI) | EOI/H | EOI/+ | EOI/S |

*FIG. 25B*

MUSCLE TRAINING APPARATUS AND METHOD

This application claims priority as a divisional of co-pending U.S. patent application Ser. No. 12/237,502 filed Sep. 25, 2008, titled "Muscle Training Apparatus and Method," which is a continuation-in-part of co-pending U.S. patent application Ser. No. 11/376,974 filed Mar. 16, 2006, titled "Motion Training Apparatus and Method," and which is a continuation-in-part of U.S. patent application Ser. No. 11/857,049 filed Sep. 18, 2007, titled "Muscle Training Apparatus and Method," which issued as U.S. Pat. No. 7,766,760, which is a continuation-in-part of U.S. patent application Ser. No. 10/681,971 filed Oct. 9, 2003 titled "Muscle Training Apparatus and Method" which issued as U.S. Pat. No. 7,351,157 on Apr. 1, 2008. The entire contents of these prior applications are incorporated herein by reference.

FIELD

This invention relates to a muscle trainer and to methods of exercising a muscle. This invention particularly relates to a muscle trainer for use by an individual when exercising one or more muscles used to swing an implement, and/or when exercising one or more muscles used to rotate the implement, and to methods of exercising such muscles.

BACKGROUND OF THE INVENTION

Many types of activities require an individual to swing an implement in an attempt to successfully accomplish the end goal of participation in such activity. For example, when participating in any of several sporting games, an individual may be required to swing any of several different implements, each of which is unique to a particular one of the games. Examples of such implements include a bat in the games of baseball and softball, a racket used in the games of tennis and racket ball, and a club used in the game of golf. The swinging of an implement is also required in certain non-sports or work environments such as, for example, the swinging of a maul, a hammer or an axe.

In any of the above-noted activities, an efficient and desired end result may be achieved from the swinging of the implement when the implement is swung in an ideal path. The ideal path will vary depending on the individual's height, build and flexibility. When an individual swings the implement in that individual's ideal path, various muscle groups must function together in a precise way. The need for muscular precision is particularly apparent in the game of golf, where the implement is a golf club and the individual is a golfer. If the individual is aligned properly and is swinging the implement at the proper speed along the ideal path, the end result will also be ideal.

In the game of golf, the golf club includes a metal or non-metal-composite shaft having a club head attached to one end of the shaft and a gripping material, referred to as "the grip," attached to the other end of the shaft. Another component of the game of golf is a golf ball. The general object of the game is for the golfer, by use of the club, to cause the ball to be moved typically from an earthen mound, referred to as "the tee," toward and into a small container, referred to as "the cup", which is located in a carpet of short grass, referred to as "the green," typically several hundred yards from the tee.

The golfer causes the ball to be moved generally by (1) grasping the grip of the club with both hands, (2) "addressing" the ball with the club head which includes aligning "a sweet spot" of a front, or ball-impact, face of the club head with the ball, (3) raising the club, desirably through the ideal path, in a motion referred to as "the backswing," (4) locating the shaft of the club, upon completion of the backswing, in a transitional position behind the head of the golfer, (5) swinging the club forward from the transitional position, desirably returning through the ideal path, in a momentum-gathering motion referred to as "the downswing" and, desirably, (6) directing the sweet spot of the front face of the club head into impact-engagement with the ball to drive the ball along a desired trajectory and direction, leading to eventual placement of the ball in the cup.

The combined motions of the backswing and the downswing are referred to as "a stroke." Typically, several strokes by the golfer are required to advance the ball along a path, commonly referred to as "the fairway," between the tee and the green, and to its ultimate destination in the cup.

When the golfer addresses the ball with the ball-impacting front face of the club head (hereinafter referred to as the club face), the sweet spot of the club face is adjacent and aligned with the ball as noted above. As the golfer begins the backswing, the club head is moved through an arc away from the ball, but desirably maintains an initial arcing alignment between the club face and the ball. At some point during the initial segment of the backswing, there is anatomical/mechanical necessity for some degree of rotation of the club shaft such that the club face loses its arcing alignment with the ball. As the golfer swings the club through the downswing of the stroke, the golfer must effectively rotate the club in the reverse direction, preferably just before impact with the ball, to return the club face to arcing alignment with the ball.

Desirably, following movement of the club through the full stroke, the golfer should have returned the club face through the ideal path to the addressed position with the momentum necessary to effectively strike and carry the ball in a desired trajectory and direction.

While it is a practical impossibility to accomplish a "perfect" golf swing each and every time a golfer swings the club to impact the ball, several professional golfers seem to accomplish a near "perfect" swing on a reasonably consistent basis. In attempts to bring some semblance of a near "perfect" swing to at least non-professional golfers, techniques have been developed to train the swinging muscles of a golfer with a goal of developing muscle memory to provide a more consistent and efficient golf swing. Even so, there remains a need for a device and methods which will better enable the golfer, or any one swinging an implement, to swing the club or other implement along an ideal path.

SUMMARY OF THE INVENTION

The above and other needs are met by a muscle trainer and methods which contemplate that when an individual swings an implement along a path, a first muscle or set of muscles exerts a pulling force on the swinging implement in a first direction generally laterally of the ideal path. At the same time, a second muscle or set of muscles exerts a pulling force on the swinging implement in a second direction generally laterally of the ideal path and generally in a direction which is opposite to the first direction. If the first and second muscles or sets of muscles are of equal strength, the opposing pulling forces exerted upon the implement tend to maintain the implement in an ideal path to achieve the ideal end result in an efficient and desirable manner.

As used hereinafter, the word "muscle" can mean a single muscle, a set of muscles, or both.

When swinging the implement, if the first muscle is stronger than the second muscle, the first muscle will dominate the weaker second muscle to the extent that the implement is pulled laterally away from the ideal path in the first direction, whereby the individual is not swinging the implement in the most efficient manner to accomplish the task at hand. This undesirable dominant-muscle condition and its attendant disadvantages are particularly apparent in sporting games such as, for example, the game of golf, where the implement is a golf club and the individual is a golfer.

One of the primary goals in golf involves achieving an ideal plane of the swing of the golf club. The ideal backswing plane has been described as being like a sheet of glass resting on the golfer's shoulders and extending to the golf ball. Producing the ideal downswing plane requires that the sheet of glass is shifted to a flatter angle and is skewed for a more inside to outside club shaft path. To achieve these ideal planes, the path that the club shaft must follow during the swing must be an ideal one. However, the ideal club shaft path does not typically coincide with a true plane like a sheet of glass. The non-planar nature of the ideal club shaft path is more apparent in the backswing, in which the ideal club shaft path has been described as having a significant upward curvature.

In an attempt to marry these conflicting visual images of curves and planes, the term "club shaft plane" will hereinafter be used in preference to the terms club shaft path and swing plane. As mentioned above, it would be very difficult, if not impossible, for a human being to swing a golf club through a complete stroke while keeping the club shaft in one club shaft plane which is a true plane. Hence, it is correct to state that the path in which the club shaft travels is not typically a true plane. In fact, there are an infinite number of singular positions of the club shaft along the golf club's path of travel throughout the entire swing. At each of these positions, there is a singular club shaft plane which rests in the spatial field representing the direction of travel of the club shaft for that position only. In other words, at each position of the club in a swing, there is a single plane that coincides with the club shaft's instantaneous direction vector. For simplicity, the composite of these infinite number of singular club shaft planes is referred to herein as the club shaft plane. It may also be referred to as the composite club shaft plane. For each golfer, there are ideal club shaft planes for the backswing, downswing, and follow-through which may vary slightly depending on the type of shot being played. These ideal club shaft planes will be different for each golfer depending on the golfer's height, build, and flexibility.

To best visualize the club shaft plane, observation of the golfer's swing should take place from a position looking down the target line on the takeaway side of the golfer's swing. From this perspective, a common error is for the golfer to allow the club shaft to deviate behind or in front of their ideal club shaft plane. To achieve the result of keeping the club shaft within the ideal club shaft plane, a group of opposing muscles in the golfer's torso, shoulders, arms, and hands must function in a proper manner. This muscle group is referred to as the "club shaft plane opposing muscle group." The two sets of opposing muscles within the club shaft plane opposing group are the "behind-the-plane muscles" and the "front-of-the-plane muscles." One could consider these two sets of opposing muscles as being in a tug-of-war, pulling against each other to determine the actual club shaft plane. Ideally then, these two sets of muscles should be of appropriate strength, such that neither set dominates the other set, and the shaft of the club is maintained within, and is not moved laterally from, the ideal club shaft plane.

To better represent the movement of the entire golf club in space, the position of the club face will hereinafter be referred to as the club face plane. Regardless of the loft of the club face, the club face plane represents the position of the club face as if the club face had zero degrees of loft. Unlike the club shaft plane which typically has some degree of curvature, the club face plane is a true plane since it is an extension of the zero degree club face. The concepts of the club face plane and the club shaft plane help one to visualize the relationship between the movement of the club face and the club shaft during the golf swing. The proper relationship between these two planes is captured in a "two-plane-merger" golf swing theory.

The tug-of-war between the behind-the-plane muscles and the front-of-the-plane muscles is accompanied by the anatomical/mechanical need for rotation of the shaft and club face plane during the swing. The two-plane-merger theory can be explained by the following discussion of swing positions.

At the address, or six o'clock, position, the club face plane is ideally a vertical plane which is essentially perpendicular to the club shaft plane. In a face-to-face perspective while observing the swing of a right handed golfer, the club face plane is rotated in a counter-clockwise direction about the axis of the club shaft to achieve a mechanically efficient movement in which the club face plane "slices" through the air in an aerodynamic fashion. Ideally, somewhere between the eight o'clock and ten o'clock backswing positions, the club face plane has been rotated ninety degrees in a counter-clockwise direction so that the club face plane "merges," and is substantially "co-planar," with the club shaft plane. This ideal ninety degree rotation creates what is referred to as the "merged position." At the backswing completion position and during the downswing, the club face plane should remain merged with the club shaft plane until just before impact when the club face plane is rotated ninety degrees in a clockwise direction to achieve a "square" impact position which is perpendicular to the club shaft plane. The relationship of the club face plane and the club shaft plane during the follow-through should approximate the mirror image of the relationship of the two planes during the backswing with a remerger of the two planes occurring between the four o'clock and six o'clock positions. This action defines proper execution of the two-plane-merger golf swing theory.

It follows that the two-plane-merger zone of the golf swing exists above the substantially horizontal line connecting the nine o'clock backswing position and the three o'clock follow-through position. The zone of the golf swing below this horizontal line is referred to as the two plane perpendicular zone or impact zone.

The rotation of the club shaft and the club face plane to bring about two-plane-merger utilizes a group of opposing muscles in the arms and hands referred to as the "rotational opposing muscle group." With an observer in a face-to-face perspective with a right handed or left handed golfer, the two sets of opposing muscles in the rotational opposing muscle group are referred to as the "counter-clockwise rotational muscles" and the "clockwise rotational muscles." The counter-clockwise rotational muscles move the club face plane in counter-clockwise direction, such that if the face-to-face observer were looking at the clubface plane as the hand on a clock, it would be moving from 12:00 towards 9:00. It follows that, in the same perspective, the clockwise muscles move the club face plane from 12:00 towards 3:00.

In the two-plane-merger theory, over action of either set of opposing rotational muscles will result in "demerged errors." These demerged errors occur when the rotation of club face plane is either greater or less than ninety degrees.

During the backswing of a right handed golfer, over action of the counter-clockwise rotational muscles will result in an angle of rotation of the club face plane of greater than ninety degrees and an "open" club face position. Over action of the clockwise rotational muscles will result in an angle of rotation of the club face plane of less than ninety degrees and a "shut" or "closed" club face position.

During the backswing of a left handed golfer, over action of the clockwise rotational muscles will result in an angle of rotation of the club face plane of greater than ninety degrees and an open club face position. Over action of the counter clockwise rotational muscles will result in an angle of rotation of the club face plane of less than ninety degrees and a shut or closed club face position.

A third group of opposing muscles in the arms and hands controls the hinging movement of the club during the swing. This group of opposing muscles is referred to as the "hinge opposing muscle group" and is composed of two sets of opposing muscles, the "hinge loading muscles" and the "hinge releasing muscles."

In a face-to-face perspective with a right handed or left handed golfer, the hinge opposing muscle group can be isolated by elevating and lowering the head of the club within the vertical club face plane at the six o'clock address position. While keeping the arms and the rest of the body in relatively fixed position, maximal elevation of the club head without rotation of the club face plane demonstrates maximum and isolated function of the hinge loading muscles. Returning the maximally elevated club head to the six o'clock address position without rotation of the club face plane similarly demonstrates maximum and isolated function of the hinge releasing muscles.

For a right handed golfer, the hinge angle $\phi$ is the angle between the club shaft and the left forearm. For a left handed golfer, the hinge angle $\phi$ is the angle between the club shaft and the right forearm. Professional golfers will intentionally vary the change in their hinge angle depending on the type of shot they are playing. Given that professional golfers will frequently flatten their downswing club shaft plane in relation to their backswing club shaft plane, it is incorrect to assume that the address hinge angle will be identical to the impact hinge angle.

To illustrate hinge errors, the intentional change in the hinge angle during the backswing will be arbitrarily set at ninety degrees. An under loaded hinge error occurs during the backswing when the change in the hinge angle is less than ninety degrees. An over loaded hinge error occurs during the backswing when the change in the hinge angle is greater than ninety degrees.

An early release of the hinge angle error during the downswing occurs when the golfer allows the hinge angle to begin increasing before the club shaft approaches a horizontal position relative to the ground. This is one of the most common errors in golf and is referred to as "casting." This power wasting error is called casting because the motion resembles what a fisherman intentionally does with his wrists when casting the end of his fishing line towards a landing spot target. Casting is definitely the most common and swing-disrupting hinging error. A late release of the hinge angle error during the downswing occurs when the golfer does not allow the hinge angle to begin increasing at the appropriate hinge release point. This is a very uncommon error.

An under released hinge angle error occurs during the downswing when the golfer does not allow the hinge angle to increase to the ideal impact hinge angle. This error plays a role in hitting "thin" shots and "topped" shots. A thin shot occurs when ball is struck at a place below the "sweet spot." The sweet spot is the ideal point of impact on the club face. A topped shot occurs when the lower edge of the club face strikes the ball above its equator, resulting in a downward trajectory of the ball into the ground. An over released hinge angle error occurs during the downswing when the golfer allows the hinge angle to increase beyond the ideal impact hinge angle. This error plays a role in hitting "fat" shots. A fat shot occurs when the lower edge of the club face strikes the ground before the club face contacts the ball.

Another crucial variable associated with the swing is arc. The arc of the swing refers to the path of the club head and is determined by the amount of extension of the hands away from the golfer's body, the timing of the golfer's wrist hinge, the amount of flexion of the left elbow of a right-handed golfer, the amount of flexion of the right elbow of a left-handed golfer, the amount of shoulder turn, and the amount of hip turn by the golfer. It should be appreciated that a fourth group of opposing muscles could be delineated and trained for swing arc and the two sets of opposing muscles in this "arc opposing muscle group" could be called the "arc enhancing muscles" and the "arc contracting muscles." It should also be appreciated that in a complex motion like the golf swing there are other opposing muscle groups, in addition to the four opposing muscle groups mentioned above, which can also be delineated and trained.

Speed is a swing variable which is influenced by the combined actions of all the opposing muscle groups in the swing. The speed of the backswing is typically slower than the speed of the downswing. Variation in the speed of the swing and the timing of the transition between the backswing and downswing create the tempo of the swing. Speed and tempo are much easier to manipulate and manage once the golfer has acquired the proper muscle memory for their ideal club shaft plane, ideal two-plane merger, ideal hinging, and ideal performance of other opposing muscle group actions such as that needed for ideal arc.

The exercising and improvement of memory patterns of opposing muscle groups, such as, for example, the three opposing muscle groups described above, can be accomplished by working the various sets of opposing muscles through motions which are akin to the motions typically utilized when swinging a golf club in the normal fashion. If the dominant, or stronger, set of opposing muscles is exercised to the same extent as the dominated, or weaker, set of opposing muscles, any strength imbalance between the two sets of opposing muscles will be undesirably maintained. If the dominated set of opposing muscles is exercised solely in an effort to bring the strength level thereof in line with the dominating set of opposing muscles, then the dominating muscles would tend to lose muscle tone, and the desired memory patterns of the two sets of opposing muscles would be difficult, if not impossible, to attain.

Thus, there is a need for a muscle trainer, and methods of exercising, which will provide simultaneous sustained exercising of sets of opposing muscles leading to the development of desired memory patterns, while, at the same time, processing the dominated set of opposing muscles through a more strenuous exercise program, to eventually provide balanced muscle strength of the sets of opposing muscles.

These and other needs are met by various embodiments of an invention that provides methods of exercising muscles used in swinging an implement. In one embodiment, the invention provides a method for training opposing implement shaft plane muscles to consistently maintain the implement in an ideal implement shaft plane during the swing. The method comprises: (a) swinging a muscle trainer in an actual implement shaft plane; (b) determining a difference between the actual implement shaft plane and the ideal implement shaft plane, where the difference indicates a dominating implement shaft plane force direction; (c) applying an external force to the muscle trainer to urge the muscle trainer in the dominating implement shaft plane force direction; and (d) using a non-dominating implement shaft plane muscle to urge the muscle trainer against the external force to thereby exercise the non-dominating implement shaft plane muscle.

In another embodiment, the invention provides a method for training opposing rotational muscles to consistently execute ideal rotation of an implement during a swing. This method comprises: (a) swinging a muscle trainer while rotating the muscle trainer through an actual rotation angle by application of rotational forces exerted by the two opposing rotational muscles; (b) determining a difference between the actual rotation angle and an ideal rotation angle, where the difference indicates a dominating rotational force direction; (c) applying an external force to the muscle trainer to further urge the muscle trainer in the dominating rotational force direction; and (d) using a non-dominating rotational muscle to urge the muscle trainer against the external force to thereby exercise the non-dominating rotational muscle.

In yet another embodiment, the invention provides a method for training opposing hinge muscles to consistently execute an ideal hinging movement of an implement during a swing. The method comprises: (a) swinging a muscle trainer while performing a hinging movement of the muscle trainer through an actual hinge angle in a hinge plane by application of hinge forces exerted by the two opposing hinge muscles; (b) determining a difference between the actual hinge angle and an ideal hinge angle, the difference indicating a dominating hinge force direction; (c) applying an external force to the muscle trainer to urge the muscle trainer in the dominating hinge force direction; and (d) using a non-dominating hinge muscle to urge the muscle trainer against the external force to thereby exercise the non-dominating hinge muscle.

In each of these methods, step (b) may include determining positions of the muscle trainer at multiple points during the swing of the muscle trainer. In the determination of the hinge angle, step (b) may also include determining positions of the left forearm for a right-handed golfer and the right forearm for a left-handed golfer. These positions may be determined based on signals generated by one or more sensors mounted on the muscle trainer and/or the golfer's forearm.

In each method, the external force applied in step (c) may be generated by one or more force generators that are attached to the muscle trainer. In some embodiments, the force generators provide thrust that urges the muscle trainer in the desired direction to exercise the non-dominating muscle.

In various embodiments, the muscle trainer has a shape and a weight distribution configured to simulate the shape and weight distribution of various implements that are swung when in use, such as a golf club, a baseball bat, a softball bat, a tennis racket, a racket ball racket, a maul, an axe and a hammer.

BRIEF DESCRIPTION OF THE DRAWINGS

Further advantages of the invention are apparent by reference to the detailed description considered in conjunction with the figures, which are not to scale so as to more clearly show the details, wherein like reference numbers indicate like elements throughout the several views, and wherein:

FIG. 2 is a perspective view showing a golfer with the club having nearly reached the backswing completion position, and being located undesirably behind the ideal club shaft plane of FIG. 1;

FIG. 3 is a perspective view showing a golfer with the club having nearly reached the backswing completion position and being located undesirably in front of the ideal club shaft plane of FIG. 1;

FIG. 25A depicts a probability square representing nine states of motion in the two-plane-merger zone of the golf swing;

FIG. 25B depicts a probability square representing nine states of motion in the impact zone of the golf swing;

DETAILED DESCRIPTION OF PREFERRED EMBODIMENTS OF THE INVENTION

Figure 1:
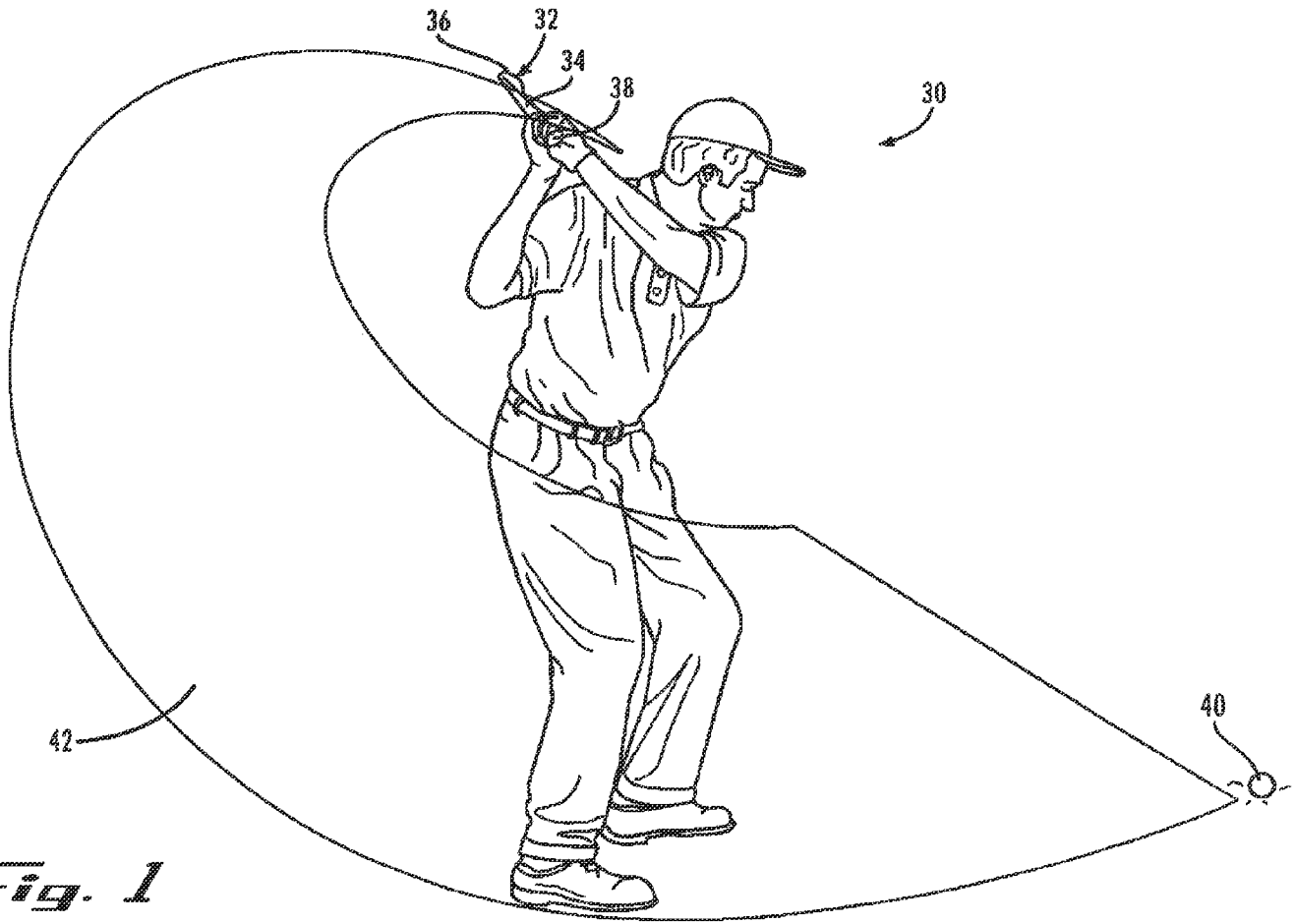
FIG. 1 is a perspective view showing a golfer having moved a golf club fully through a backswing to a backswing-completion position (hereinafter referred to as the three o'clock "toe down" position by viewing the club as being the hand of a clock) and through a generally "C" shaped path, the plane of which is referred to as a club shaft plane, representing the ideal plane of travel of a shaft of the golf club during the backswing thereof.

Referring to FIG. 1, a golfer 30 has completed a backswing of a golf club 32, with the club being at the peak of the backswing, or backswing-completion position, and poised for the beginning of a downswing of the club, in anticipation of the completion of a full stroke. The club 32 includes a club shaft 34 extending between a distal end and a proximal end thereof. A club head 36 is mounted on the distal end of the shaft 34, and a grip 38 is formed about a portion of the shaft at or near the proximal end of the shaft.

The grip 38 typically extends from its outboard end disposed at the proximal end of the shaft 34 towards the distal end of the shaft, and terminates at an inboard end of the grip along an intermediate portion of the shaft. In preparation for swinging the club 32, the golfer 30 positions the golfer's hands on the grip 38 in a conventional club-gripping manner, whereby the thumb of one hand, for example, the right hand, is closer to the inboard end of the grip 38 than the thumb of the other hand. For description purposes, the thumb which is closer to the inboard end of the grip 38 is referred to herein as the inboard thumb.

Prior to initiating the backswing, the golfer 30 has placed the golfer's hands around the grip 38 in the conventional golf-gripping manner, and has addressed a golf ball 40, which is located in front of the golfer at an address, or six o'clock, position (FIG. 6), ideally to align the sweet spot of the club head 36 with the ball.

During the backswing movement of the club 32 from the six o'clock position to the backswing-completion position illustrated in FIG. 1, the golfer 30 moves the club shaft 34 through a generally "C" shaped path 42, referred to hereinafter as the club shaft plane. The ideal club shaft plane flattens and skews slightly during the downswing to create a separate and distinct ideal downswing club shaft plane. The golfer's ability to generate an ideal downswing club shaft plane is dependent on the golfer's ability to maintain an ideal backswing club shaft plane. By maintaining the club within these ideal club shaft planes, the golfer is more likely to strike the golf ball 40 with the sweet spot of the club face 52 to attain the desired trajectory and direction of the ball.

While professional golfers occasionally make errant shots, such shots are infrequent. With their inherent ability, training regimen, muscle balance and muscle memory patterns, the professionals consistently make shots which attain the desired trajectory and direction of travel of the ball 40. However, most other golfers continuously wrestle with the nagging problem of being unable to swing the golf club 32 in such a manner to bring about the lofty goal of consistent and desired ball trajectory and direction. While it is unlikely that most non-professional golfers will ever attain the inherent ability demonstrated by professional golfers, the non-professional golfers can improve their playability of the game of golf through the training of selected muscles used in the swinging of a golf club.

As a starting point, in order to attain the desired result, the golfer 30 must possess the ability to properly grip the club 32, and to maintain an appropriate stance and posture when swinging the club. Then, the golfer 30 must commit to exercising certain muscle groups, which are located in their hands, wrists, shoulders and other parts of the body, necessary to provide the consistent ability to produce good golf shots under any kind of pressure.

Various embodiments of muscle trainers described herein are designed to facilitate methods of exercising and training the appropriate muscles typically utilized by the golfer 30 in the swinging of the club 32. Such exercises are designed to enhance the strength and balance of these muscles, and to fine tune the muscle memory patterns necessary for consistent production of good golf shots. The methods of exercising accomplished by the use of the muscle trainers described herein can be appreciated by an understanding of the below-described principles of the relationships between the swinging of the golf club 32 and the muscles and muscle groups involved in such swinging action.

In the two-plane-merger golf swing theory, the two planes are referred to as the club shaft plane 42 and the club face plane. With regard to the club shaft plane, it would be very difficult, if not impossible, for a human being to swing the golf club 32 through a complete stroke while keeping the club shaft 34 in one club shaft plane which is a true plane. Hence, it is correct to state that the path in which the club shaft travels is not typically a true plane. As discussed above, there are an infinite number of singular positions of the club shaft 34 along the golf club's path of travel throughout an entire swing. At each of these positions, there is a single plane that coincides with the club shaft's instantaneous direction vector. The composite of these infinite number of singular club shaft planes has been referred to herein as the club shaft plane.

The club face plane represents the position of the club face 52, in space, during the swing. Regardless of the loft of the club face, the club face plane represents the position of the club face as if the club face had zero degrees of loft, and is more appropriately defined as a true plane since it is an extension of the surface of the zero degree club face. The concept of the club face plane helps one to visualize the relationship between the movement of the club face 52 and the club shaft 34 during the swinging motion of the club.

At the address, or six o'clock, position (FIG. 6), the club face plane is ideally a vertical plane which is essentially perpendicular to the club shaft plane. During the backswing (FIG. 1), the club face 52 and the club face plane are rotated, by the golfer, about the axis of the club shaft 34 to allow for a mechanically efficient movement in which the club face plane slices through the air in an aerodynamic fashion. Ideally, for a right handed golfer in the first half of his backswing, the club face plane is rotated approximately ninety degrees in a counter-clockwise direction such that, somewhere between the 8 o'clock and 10 o'clock positions, the club face plane merges, and is co-planar, with the club shaft plane 42. This ideal ninety degree rotation creates what is referred to as the merged position. At the backswing completion position and during the downswing, the club face plane should remain merged with the club shaft plane until just before impact when the club face plane is rotated approximately ninety degrees into an impact position, which is once again perpendicular to the club shaft plane. The relationship of the club face plane and the club shaft plane during the follow-through should approximate the mirror image of the relationship of the two planes during the backswing with a remerger of the two planes occurring between the four o'clock and six o'clock positions. This action defines the two-plane-merger golf swing theory. Such two-plane-merger is essential in developing a repeatable swing pattern which is effective under pressure.

It follows that the two-plane-merger zone of the golf swing exists above the substantially horizontal line connecting the nine o'clock backswing position and the three o'clock follow-through position. The zone of the golf swing below this horizontal line is referred to as the two plane perpendicular zone or impact zone.

With respect to the club shaft plane 42 shown in FIG. 1, it is not uncommon for the non-professional golfer 30 to position the club shaft 32 outside of the ideal club shaft plane. Such deviation from the ideal club shaft plane is referred to herein as positioning the club shaft in front of or behind (i.e., above or below, respectively, as viewed in FIG. 1) the ideal club shaft plane. Referring to FIG. 2, the illustrated location of the club 32 indicates that the club shaft 34 is in a position which is behind the ideal club shaft plane 42 illustrated in FIG. 1. Referring to FIG. 3, the illustrated location of the club 32 indicates that the club shaft 34 is in a position which is in front of the ideal club shaft plane 42 illustrated in FIG. 1.

It is important for the golfer to minimize, and hopefully eliminate, the amount of club shaft deviation, which is behind, or in front of, the ideal club shaft plane. This requires a proper and balanced functioning of a group of opposing muscles in the golfer's hands and forearms. This muscle group is referred to as the club shaft plane opposing muscle group. The two sets of opposing muscles within the club shaft plane group are the behind-the-plane muscles and the front-of-the-plane muscles. The behind-the-plane muscles are responsible for positioning the club shaft 34 behind the ideal club shaft plane 42 and the front-of-the-plane muscles are responsible for positioning the club shaft 34 in front of the ideal club shaft plane 42. When these two sets of opposing muscles are acting in concert, where the sets are of equal strength and balance, the golfer 30 is able to swing the golf club 32 with the club shaft 34 in the ideal club shaft plane 42.

The direction of any deviation of the club shaft 34 during the swing, whether such direction is behind or in front of the ideal club shaft plane 42, can be determined by an observer of the golfer during the swing and presented to the golfer for use in taking corrective action such as that described herein. Also, a video camera can be used to record the golfer's direction of deviation, and thereafter observed by the golfer 30 in a video playback for use in taking corrective action.

Figure 6:
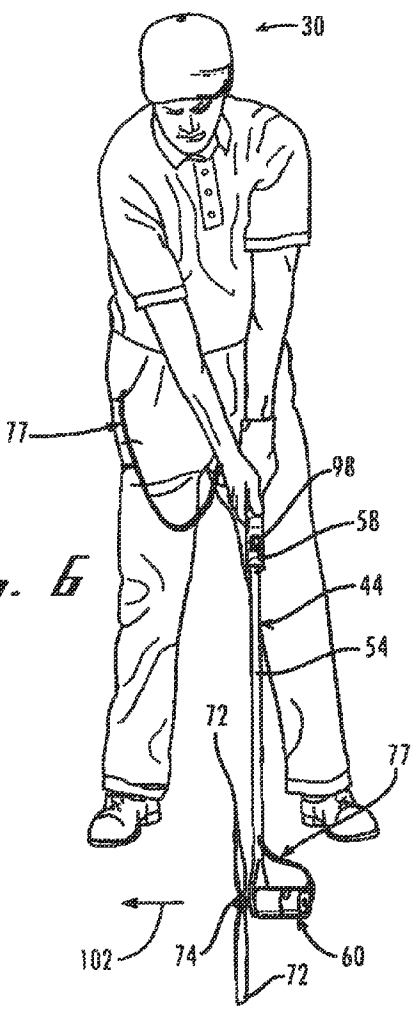
FIG. 6 is a front perspective view showing a golfer gripping the muscle trainer of FIG. 4, with the muscle trainer in a six o'clock position in preparation for a muscle training exercise, in accordance with a preferred embodiment of the invention.

When the golfer 30 is standing in the address position, as illustrated in FIG. 6, the hands, wrists, arms and shoulders of the golfer form a triangle. For a right-handed golfer, the front-of-the-plane muscles are located on the back of the left hand, the outside of the left forearm, the palm of the right hand and the inside of the right forearm. The behind-the-plane muscles are the mirror image of the front-of-the-plane muscles. For a left-handed golfer, these relationships are exactly opposite.

During the swing, the front-of-the-plane muscles and the behind-the-plane muscles are, in essence, in a tug-of-war, with the two sets of muscles being at opposite ends of an imaginary rope. If the behind-the-plane muscles are overacting, or dominating, the pulling force of these muscles moves the club shaft 34 behind the ideal club shaft plane 42. The opposite effect occurs if the front-of-the-plane muscles are overacting, or dominating. In such situations, a strengthening of the dominated muscle set is required in order to preclude either set from dominating the other set, thereby bringing balance to the tug-of-war and maintaining the club shaft 34 in the ideal club shaft plane 42.

The tug-of-war between these two sets of opposing club shaft plane muscles is further complicated by the need for an approximately ninety degree rotation of the club shaft 34 and club face 52 to merge the club face plane with the club shaft plane 42 as described above in the two-plane-merger golf swing theory. Errors within this two-plane-merger theory are referred to as demerged situations. These demerger errors occur when the amount of club face plane rotation is either greater or less than ninety degrees. When the angle of club face plane rotation is less than ninety degrees, the club face 52 is said to be in a closed or shut position. When the angle of club face plane rotation is greater than ninety degrees, the club face 52 is said to be in an open position.

Figure 7:
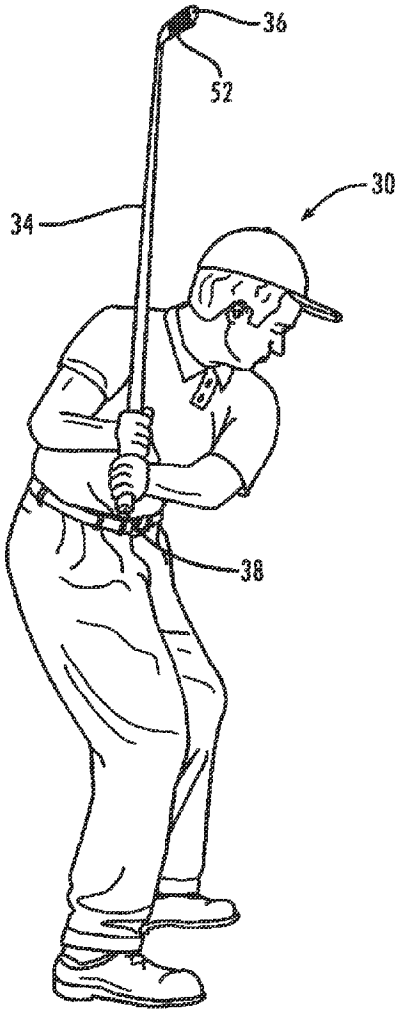
FIG. 7 is a front perspective view showing a golfer in a nine o'clock "toe up" position, relative to the six o'clock position of FIG. 6, while gripping the muscle trainer of FIG. 4 in the process of a muscle training exercise, in accordance with a preferred embodiment of the invention.
Figure 7:
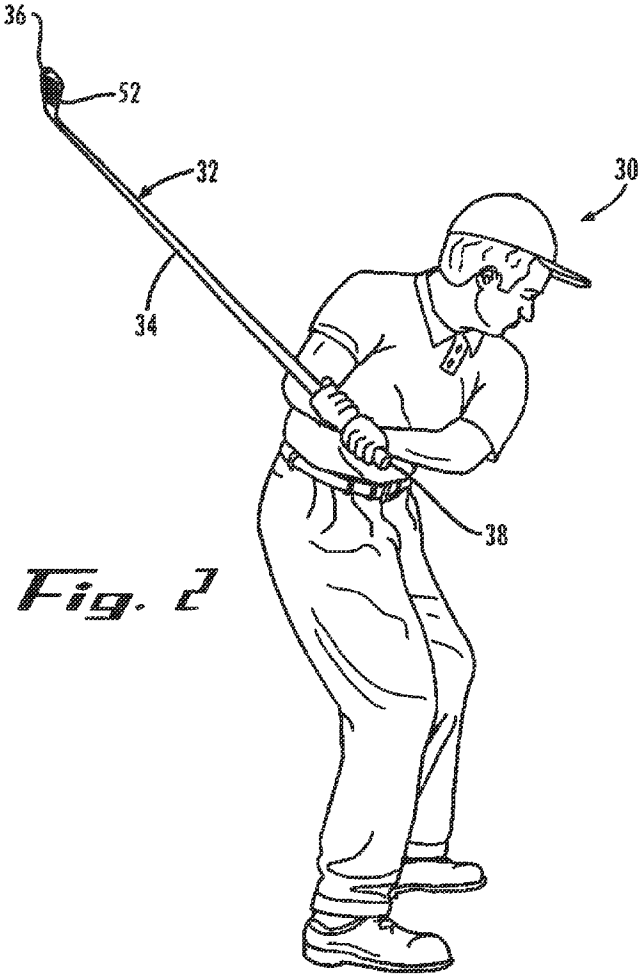

The rotation of the club shaft 34 and the club face 52 to bring about two-plane-merger utilizes a group of opposing muscles known as the rotational opposing muscle group. When viewing a golfer's swing while standing in front of the golfer (FIGS. 6 and 7), the rotational muscle group can be divided into two sets of opposing muscles: the counter-clockwise rotational muscles and the clockwise rotational muscles.

In the two-plane-merger theory, over action of either set of opposing rotational muscles will result in the demerger errors described above. For example, during the backswing of a right-handed golfer, over action of the clockwise rotational muscles will result in closed club face position. Over action of the counter-clockwise rotational muscles will result in an open club face position.

A third group of opposing muscles in the arms and hands controls the hinging movement of the club 32 during the swing. This group of opposing muscles is referred to as the hinge opposing muscle group and is composed of two sets of opposing muscles, the hinge loading muscles and the hinge releasing muscles.

In a face-to-face perspective with a right handed or left handed golfer (FIG. 22A), the hinge opposing muscle group can be isolated by elevating and lowering the distal end of the muscle trainer within the vertical club face plane at the six o'clock address position. While keeping the arms and the rest of the body in a relatively fixed position, maximal elevation of the distal end of the muscle trainer without rotation of the club face plane demonstrates maximum and isolated function of the hinge loading muscles. Returning the maximally elevated distal end of the muscle trainer to the six o'clock address position without rotation of the club face plane, similarly demonstrates maximum and isolated function of the hinge releasing muscles.

Figure 22A:
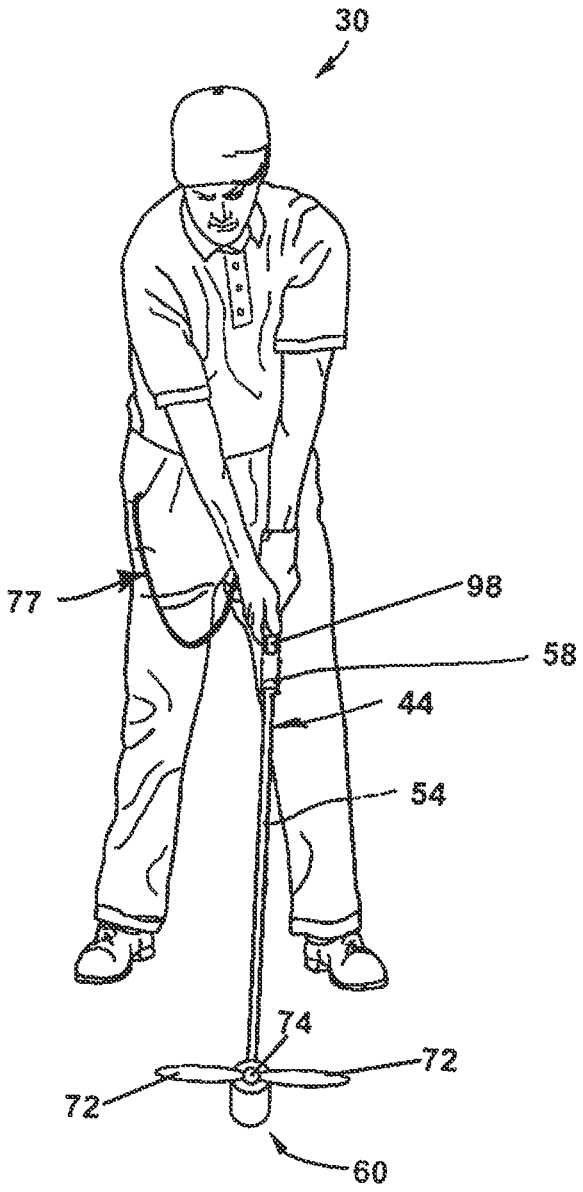
FIG. 22A is a front perspective view showing a golfer gripping the muscle trainer of FIG. 4, with the muscle trainer in a six o'clock position and oriented to exercise hinge muscles in accordance with a preferred embodiment of the invention.
Figure 22B:
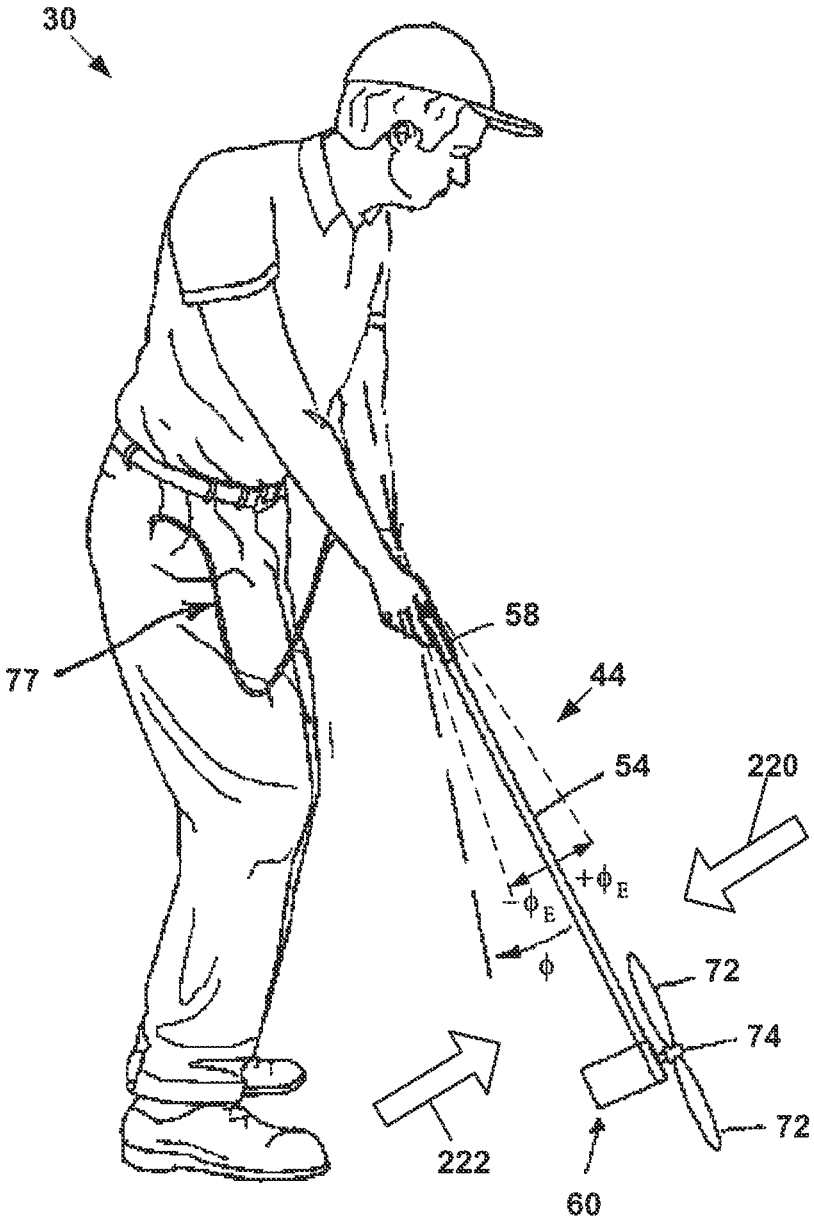
FIG. 22B is a side perspective view showing the right side of a golfer gripping the muscle trainer of FIG. 4, with the muscle trainer in a six o'clock position and oriented to exercise hinge muscles in accordance with a preferred embodiment of the invention.

As shown in FIG. 22B, for a right handed golfer, the hinge angle is the angle $\phi$ between the shaft 54 and the hatched line extending in a substantially coaxial fashion from the distal aspect of the left forearm. For a left handed golfer, the hinge angle is the angle $\phi$ between the shaft 54 and a similar imaginary line which is coaxial with the long axis of the right forearm and which extends from the distal aspect of the right forearm. Professional golfers will intentionally vary their hinge angle depending on the type of shot they are playing. Given that professional golfers will frequently flatten their downswing club shaft plane in relation to their backswing club shaft plane, it is incorrect to assume that the address hinge angle will be identical to the impact hinge angle.

To illustrate hinge errors, the intentional change in the hinge angle $\phi$ during the backswing will be set at ninety degrees. An under loaded hinge error occurs during the backswing when the change in the hinge angle $\gamma$ is less than ninety degrees. An over loaded hinge error occurs during the backswing when the change in hinge angle $\phi$ is greater than ninety degrees.

An early release of the hinge angle error during the downswing occurs when the golfer allows the hinge angle $\phi$ to begin decreasing before the club shaft 34 approaches a horizontal position relative to the ground. This is one of the most common errors in golf and is referred to as casting. A late release of the hinge angle error during the downswing occurs when the golfer does not allow the hinge angle $\phi$ to begin decreasing at the appropriate hinge release point. This is a very uncommon error.

An under released hinge angle error ($+\phi_E$ in FIG. 22B) occurs during the downswing when the golfer does not allow the hinge angle $\phi$ to decrease to the ideal impact hinge angle. This error plays a role in hitting thin shots and topped shots. A thin shot occurs when ball 40 is struck at a place below the sweet spot. The sweet spot is the ideal point of impact on the club face 52. A topped shot occurs when the lower edge of the club face strikes the ball above its equator, resulting in a downward trajectory of the ball into the ground. An over released hinge angle error ($-\phi_E$ in FIG. 22B) occurs during the downswing when the golfer allows the hinge angle q to decrease beyond the ideal impact hinge angle. This error plays a role in hitting fat shots. A fat shot occurs when the lower edge of the club face strikes the ground before the club face contacts the ball.

Another crucial variables associated with the swing is arc. The arc of the swing refers to the path of the club head 36 and is determined by the amount of extension of the hands away from the golfer's body, the timing of the golfer's wrist hinge, the amount of flexion of the left elbow of a right-handed golfer, the amount of flexion of the right elbow of a left-handed golfer the amount of shoulder turn, and the amount of hip turn by the golfer. It should be appreciated that a fourth group of opposing muscles could be delineated and trained for swing arc and the two sets of opposing muscles in this "arc opposing muscle group" could be called the "arc enhancing muscles" and the "arc contracting muscles." It should also be appreciated that in a complex motion like the golf swing there are other opposing muscle groups, in addition to the four opposing muscle groups mentioned above, which can also be delineated and trained.

Speed is a swing variable which is influenced by the combined actions of all the opposing muscle groups in the swing. The speed of the backswing is typically slower than the speed of the downswing. Variation in the speed of the swing and the timing of the transition between the backswing and downswing create the tempo of the swing. Speed and tempo are much easier to manipulate and manage once the golfer has acquired the proper muscle memory for their ideal club shaft plane, ideal two-plane merger, ideal hinging, and ideal performance of other opposing muscle group actions such as that needed for ideal arc.

While practicing, a golfer may frequently use positioning drills to improve the positioning of the club during his swinging motion. These positioning drills are usually performed at a swing speed which is much slower than the swing speed the golfer uses in actual competition. Even with imbalanced muscle groups, reasonable attempts can be made to keep the club shaft within the ideal club shaft plane and to accomplish two-plane merger during periods when the club is being swung slowly. However, it becomes increasingly difficult to accomplish these goals when the speed of the swing is increased while striking the ball during a competitive round of golf. To maintain the ideal club shaft plane, two-plane-merger, and proper hinging when swinging at a speed the golfer uses during actual competition, there must be an exquisite balance between the opposing sets of muscles in the club shaft plane muscle group, rotational muscle group, and the hinge muscle group.

Thus, in order for any golfer suffering from the muscle domination deficiencies described above to improve their ability to play the game of golf, an exercise program to balance the three opposing muscle groups is an absolute necessity. Given that a golfer wishes to embark on such an exercise program, the key is to be able to address the specific needs of the muscles of the three groups in such a way that the ideal swing movements and the resultant ideal ball flight patterns are attainable.

The various muscle trainers described herein are designed to exercise the muscles of the three muscle groups, while placing a greater effort in strengthening the dominated, or weaker, sets of opposing muscles. In this manner, the dominating sets of muscles are exercised to retain the muscle tone thereof, while at the same time the dominated sets of muscles are worked and exercised more vigorously to improve the muscle tone thereof, and to bring the three muscle groups into a balanced condition. Further, by working and exercising the three muscle groups together, enhanced muscle memory patterns are developed there between.

Once the three muscle groups have attained parity in strength, balance, and memory patterns, the golfer 30 can maintain the club shaft 34 more consistently within the ideal club shaft plane 42, more effectively practice the principle of the two-plane-merger theory, and perform proper hinging action to attain desired trajectory, direction, and distance of travel of the ball 40.

Figure 4:
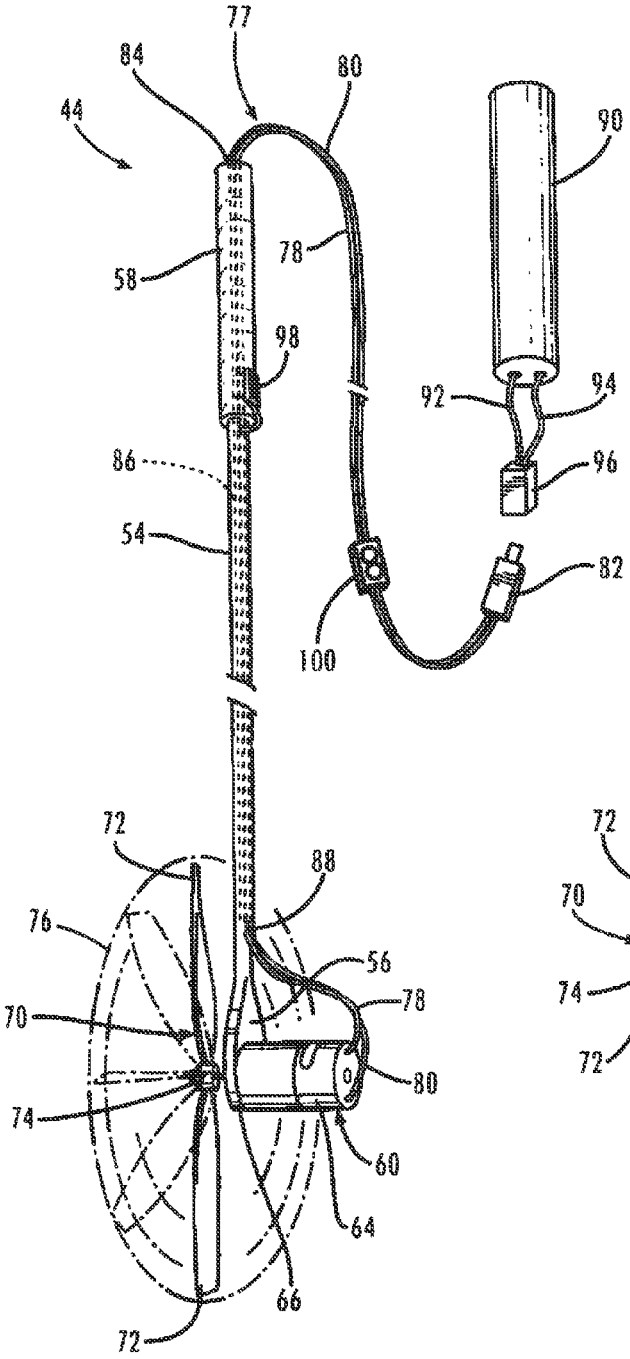
FIG. 4 is a perspective view of a muscle trainer in accordance with a first embodiment of the invention.
Figure 5:
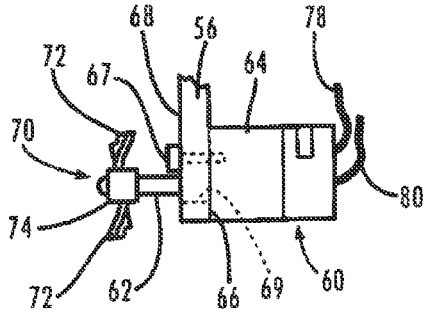
FIG. 5 is a partial side view showing a motor and fan blade assembly of the muscle trainer of FIG. 4 in accordance with a preferred embodiment of the invention.
Figure 7:
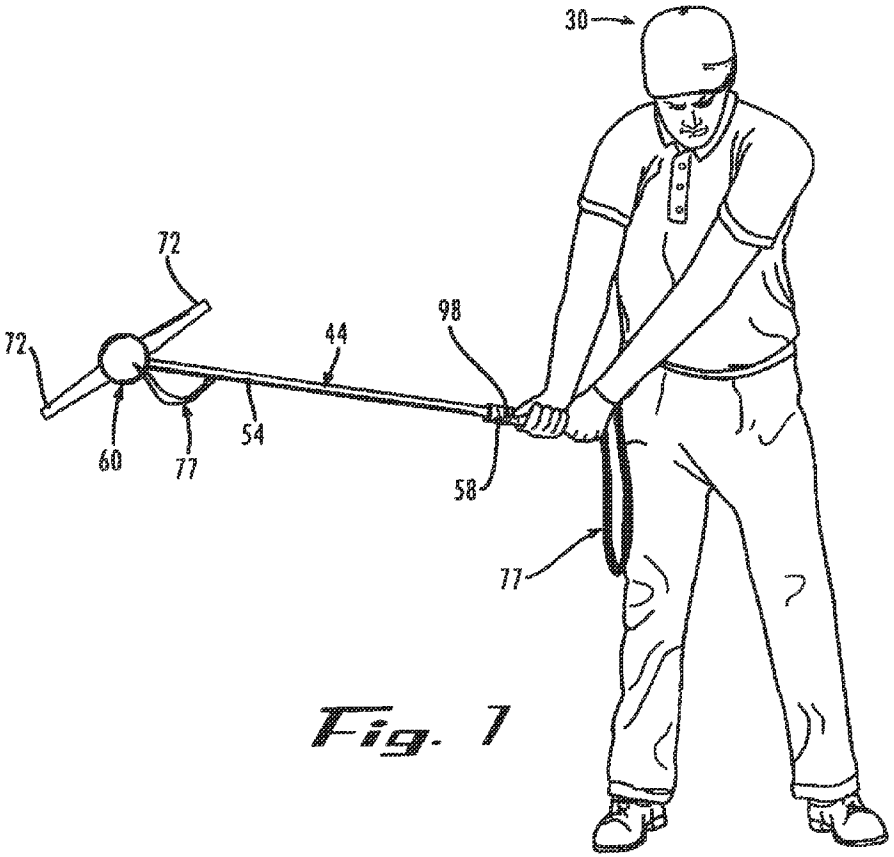

As shown in FIGS. 4 and 5, the muscle trainer 44 of a first embodiment of the invention includes a hollow shaft 54 having a flat motor-mount pad 56 formed at a distal end of the shaft, and a grip 58 attached to an outer side of the shaft adjacent a proximal end thereof. The grip 58 is formed from a soft non-metallic material, such as, for example, leather, of the type typically used to form the grip of a conventional golf club, such as, for example, the club 32 (FIG. 1).

Referring to FIGS. 4 and 5, the muscle trainer 44 further includes an electric motor 60 having a rotatable drive shaft 62 extending from one end of a motor housing 64. One end of the motor housing 64 is placed against a first side 66 of the pad 56, and is attached to the pad, such as by screws 67. The drive shaft 62 extends through an opening 69 formed through the pad 56 to a second side 68 of the pad.

The motor 60 could be of the type typically used to power radio-controlled miniature models such as, for example, model airplanes. The motor 60 could be of the type referred to as universal motors, which can operate either from a DC power source or an AC power source, and which are commonly used to operate small household appliances and light-duty power tools. The speed of operation of the motor 60 can be controlled and varied, for example, by use of a rheostat, a variable transformer with rectification, or electronically by use of a silicon controlled rectifier. Further, a reversing switch can be used with the motor 60 to facilitate selective operation of the motor in either rotational direction. Suitable examples of speed controls and a reversing switch are described in Chapter 3, and illustrated at FIGS. 3.1.1, 3.1.2, 3.1.3 and 3.3.10, of a handbook titled "DC MOTORS SPEED CONTROLS SERVO SYSTEMS," Fifth Edition, August, 1980, obtained from Electro-Craft Corporation of Hopkins, Minn., and locatable by Library of Congress Catalog Card Number 78-61244.

Referring to FIGS. 4 and 5, a fan blade assembly 70 includes a pair of blades 72, which are fixedly attached to a hub 74. The hub 74 is mounted to the distal end of the rotatable drive shaft 62 of the motor 60, and is attached to the drive shaft 62 for rotation therewith. A protective cage 76 is preferably fixedly attached to the pad 56 to preclude the blades 72 from coming into injurious or damaging contact with anyone, or any object, external to the cage. It is noted that each of the embodiments of the muscle trainer described herein preferably include a protective cage, such as the cage 76, which is not illustrated in all of the drawings thereof for the purpose of providing a clear illustration of the environment of a fan blade assembly of each respective embodiment.

In the motor-mounted arrangement illustrated in FIGS. 4 and 5, a common axis of the motor 60 and the blades 72 preferably extends at an angle of about ninety degrees from the shaft 54. The combination of motor 60 and the fan blade assembly 70 are one embodiment of a force generator.

Referring to FIG. 4, a wiring assembly 77 includes a pair of electrically conductive wires 78 and 80, which are connected at one end thereof to a plug 82, and at an opposite end thereof to the motor 60. The wires 78 and 80 extend from the plug 82, through an axial opening 84 formed in the proximal end of the hollow shaft 54, through an axial passage 86 within the hollow shaft, through an opening 88 formed through a side portion of the shaft near the pad 56, and to the connection with the motor 60.

A power source 90, such as an interchangeable and rechargeable electrical battery pack, is preferably connected through a pair of electrical wires 92 and 94 to a receptacle 96, which mates with and is connectable to the plug 82, to facilitate the application of electrical operating power from the battery pack to the motor 60. An ample length of the wiring assembly 77 preferably extends between the plug 82 and the shaft opening 84 to provide for selective placement of the battery pack 90 by the golfer 30 during use of the muscle trainer 44. As indicated above, the motor 60 could be operated by use of an AC power source, such as a single-phase 60-hertz source typically available through a conventional household power outlet or the like. Alternatively, power cells, such as batteries, can be disposed in the handle or shaft of the club.

A spring-biased push-button switch 98 is mounted on the grip 58, at any location which provides convenient access to the thumbs, fingers or hands of the golfer 30 to facilitate selective operational control of the muscle trainer 44 by the golfer during an exercise session. Preferably, the push-button switch 98 is located on the grip 58 so that the inboard thumb of the golfer 30 overlays the switch 98 when the golfer places the golfer's hands around the grip 58 in the conventional club-gripping manner. While the golfer's hands are in this position, the golfer can selectively operate the motor 60 by depressing the push-button switch 98 when the golfer is in an exercise mode without disturbing the position of either hand around the grip 58.

During the period when the golfer 30 is processing through an exercise cycle, the golfer maintains the push-button switch 98 in the closed state by continuing to depress the switch 98, so that the motor 60 remains operational during the exercise cycle. Upon release of the push-button switch 98, the spring-biased switch is opened to remove operating power from the motor 60. If desired, the push-button switch 98 could be mounted at different locations on the grip 58 to accommodate different gripping positions of respective users of the muscle trainer 44.

Referring to FIG. 4, a control module 100 is connected to the wiring assembly 77 and contains a speed controller and a reversing switch, for example, such as that described above, to allow the user of the muscle trainer 44 to pre-select the speed and direction of rotation of the motor 60 prior to using the muscle trainer during an exercise mode. The speed controller is a first enhancement of the basic invention embodied in the muscle trainer 44, the reversing switch is a second enhancement of the basic invention embodied in the muscle trainer 44, and the combination of the speed controller and the reversing switch is a third enhancement of the basic invention embodied in the muscle trainer 44. In alternative embodiments of the invention, the control module 100 is located in the handle or elsewhere in the shaft.

Figure 23:
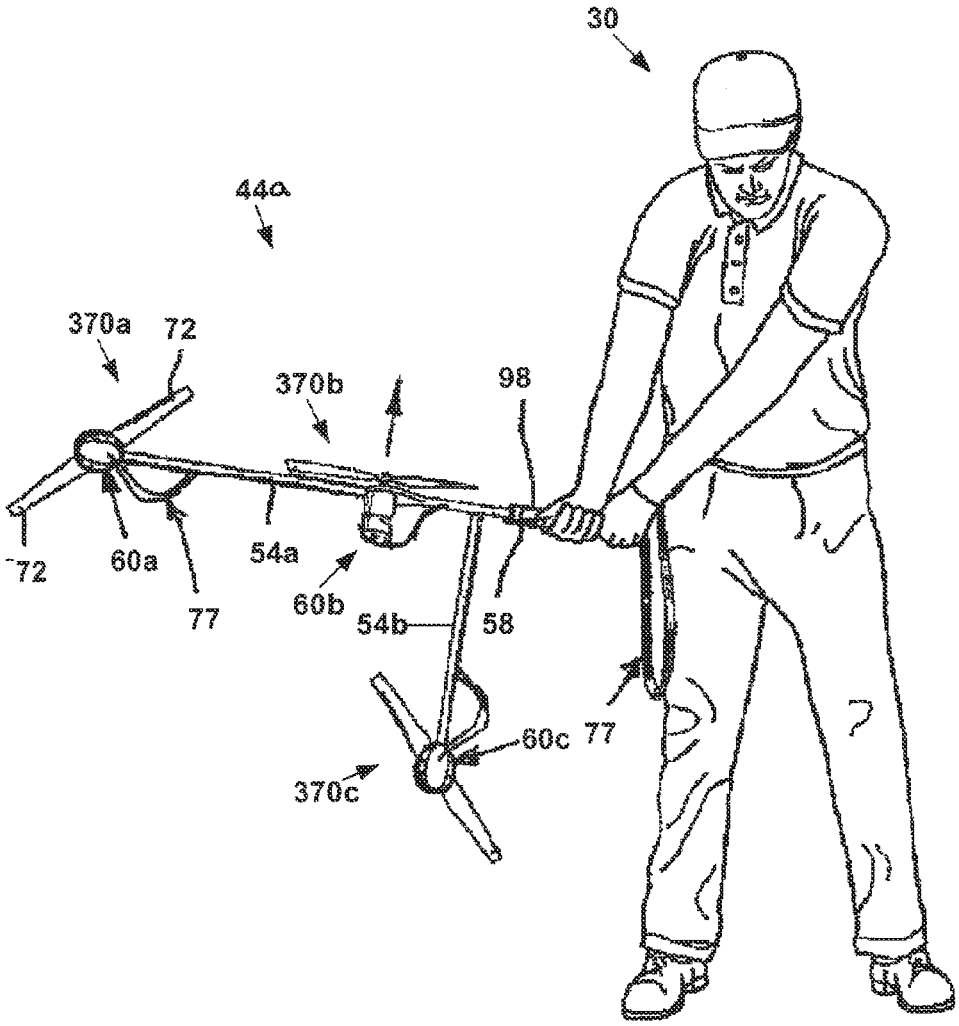
FIG. 23 depicts a front perspective view of a golfer gripping an embodiment of the muscle trainer having multiple force generators for generating forces in multiple directions.
Figure 24:
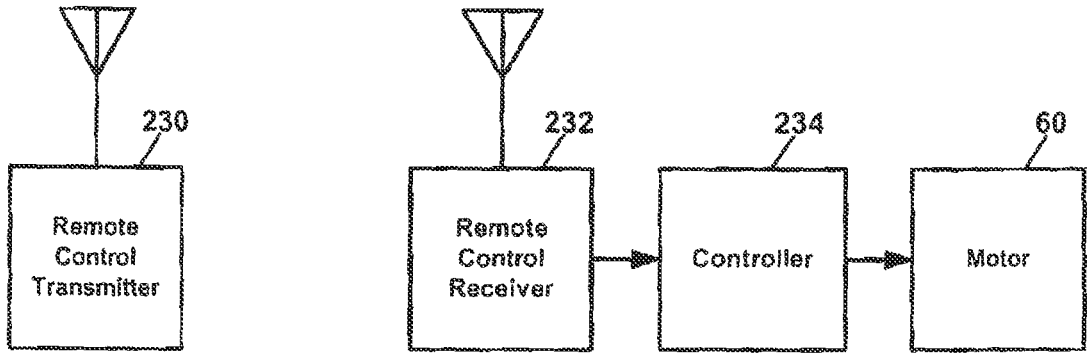
FIG. 24 depicts a remote control device for remotely controlling the activation, direction and speed of a force generator of a muscle trainer.

As shown in FIG. 24, an alternative embodiment of the invention includes a remote wireless control transmitter 230 which allows an observer, such as a teaching professional to facilitate selective operational control of the muscle trainer 44 while the golfer is swinging the muscle trainer 44. This embodiment includes a remote control receiver 232 for receiving wireless control signals transmitted from the transmitter 230. The receiver 232 is operatively connected to a controller circuit 234. The controller 234 controls the on/off state, speed and direction of the motor 60 based on the wireless control signals received by the receiver 232. The receiver 232 and the controller 234 may be disposed within the grip 58 or the shaft 54 of the muscle trainer 44. Alternatively, the receiver 232 and the controller 234 may be disposed within a separate housing connected to the muscle trainer via the wiring assembly 77. As one skilled in the art will appreciate, the remote control transmitter 230 and receiver 232 may operate according to digital or analog communication protocols using radio frequency (RF), infrared (IR) or other wireless communication means. It will be appreciated that the transmitter 230, receiver 232 and controller circuit 234 may be used to control one motor or multiple motors. A multiple-motor embodiment is depicted in FIG. 23 and is described in more detail hereinafter.

In the following example of use of the muscle trainer 44, and the practice of a method of exercising the club shaft plane opposing muscle group, the golfer 30 is a right-handed golfer, and the front-of-the-plane muscles are the set of dominated muscles.

When the golfer 30 anticipates using the muscle trainer 44 during an exercise session, the golfer will preferably use the conventional golf club 32 and process through several practice strokes in the presence of a personal observer, or in front of a video camera, in order to determine, as described above, whether the club shaft 34 is in front of the ideal club shaft plane 42 or behind the ideal club shaft plane. Assuming that information relayed by the observer, or through use of the video camera, indicates that the golfer's front-of-the-plane muscles are the dominated set of muscles, the golfer 30 will make the desired speed and direction-of-rotation adjustments, through the control module 100.

The speed of the motor 60 and the blades 72 will establish the magnitude of a pulling force at which the distal end of the muscle trainer 44 is urged in the manner described below. The golfer 30 can adjust the speed controller of the control module 100 to selectively establish the linear pulling force level at which the golfer wishes to conduct the exercise cycle. Then, as described below, the adjustment of the reversing switch of the control module 100 will establish the direction in which the linear pulling force is to be applied.

After making the speed and direction-of-rotation adjustments at the control module 100, the golfer 30 then places the battery pack 90 of the muscle trainer 44 in a convenient location such as, for example, the right front pocket of the golfer's pants as illustrated in FIG. 6. It is noted that, instead of placement in the pants pocket, the battery pack 90 could be clipped to the golfer's belt or placed at other locations which will accommodate a comfortable and unimpeded swinging of the muscle trainer 44.

The golfer 30 grasps the grip 58 of the muscle trainer 44 in the conventional club-gripping manner, with the blades 72 extending to the right of the golfer, again as indicated in FIG. 6. The golfer 30 assumes a position and stance as if the golfer is addressing a ball at the six o'clock position as illustrated in FIG. 6. It is noted that the combined axial length of the grip 58, the shaft 54, the pad 56 and the blades 72 is slightly less than the length of a typical golf club, such that the blades are above a surface on which the golfer is standing during the exercise session.

The golfer 30 depresses the spring-biased push-button switch 98, such as by use of the golfer's inboard thumb, to operate the motor 60. With the appropriate direction of rotation of the motor 60 having been selected by prior adjustment of the reversing switch, the linear pulling force generated by the rotary movement of the blades 72 will urge the distal end of the muscle trainer 44 to the golfer's right, as indicated by an arrow 102 in FIGS. 6, 8 and 9. To initiate an exercise phase of the exercise cycle, the golfer 30 swings the muscle trainer 44 from the address position (FIG. 6) through a conventional non-stop backswing while processing through the positions shown in FIGS. 7, 8 and 9.

In the alternative, the golfer 30 could process the muscle trainer 44 through several step-and-stall motions, as described below, until reaching the fully completed backswing position illustrated in FIG. 9. During the step-and-stall motions, the golfer steps the trainer from the address position at six o'clock to a next position, such as, for example, the seven o'clock position, and stalls the motion of the trainer before advancing, for example, to the eight o'clock position. This pattern is continued through each clock position, for example, and so on to the fully completed backswing position illustrated in FIG. 9, while retaining the muscle trainer at each stepped position for a prescribed time before moving the trainer to the next stepped position.

During the non-stop backswing or the step-and-stall motions by the golfer 30, the dominating set of behind-the-plane muscles and the dominated set of in-front-of-the-plane muscles, work together in the tug-of-war context in an attempt to maintain the shaft 54 of the muscle trainer 44 within the club shaft plane through the swinging stroke in the same manner that such sets of muscles would move the golf club 32 when the golfer is swinging the club. In this manner, the dominating set of muscles and the dominated set of muscles are being worked together to the extent that both sets are being exercised and the muscle memory patterns of the two sets are being enhanced.

Figure 9:
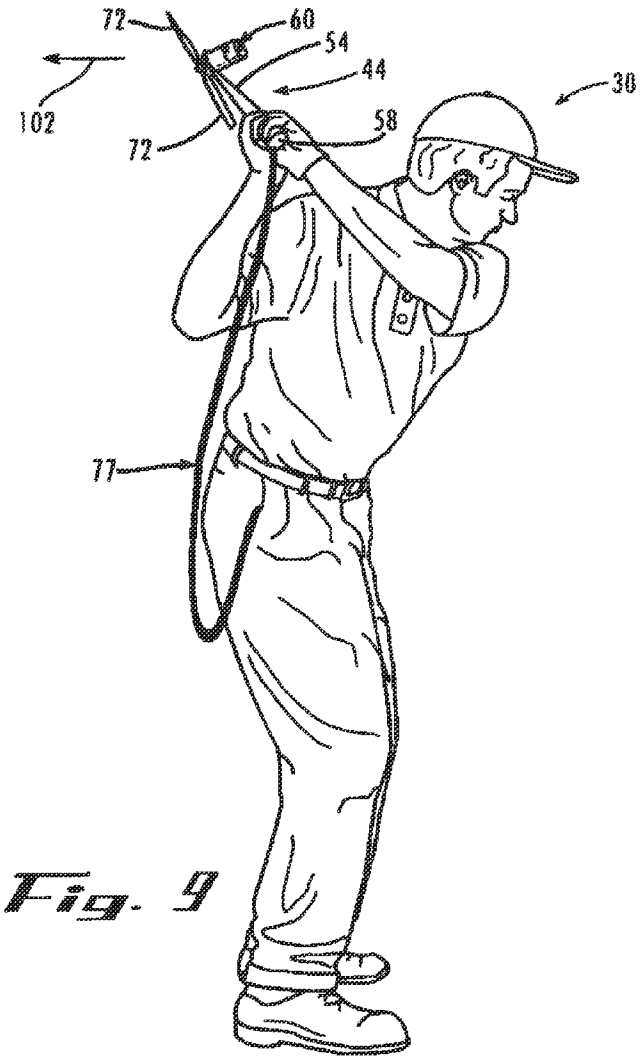
FIG. 9 is a side perspective view showing the right side of a golfer in the backswing-completion position while gripping the muscle trainer of FIG. 4 in the process of a muscle training exercise, in accordance with a preferred embodiment of the invention.
Figure 8:
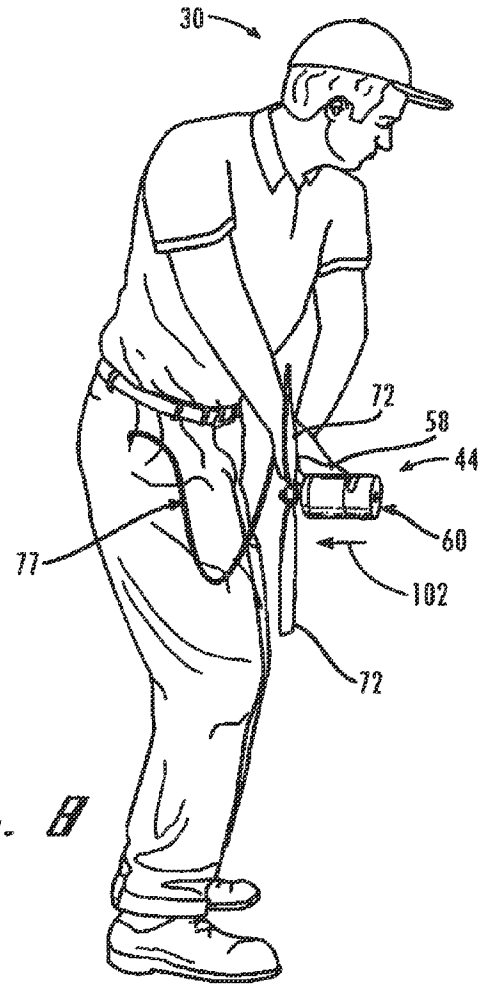
FIG. 8 is a side perspective view showing the right side of a golfer in the nine o'clock "toe up" position of FIG. 7 while gripping the muscle trainer of FIG. 4 in the process of a muscle training exercise, in accordance with a preferred embodiment of the invention.

Additionally, as indicated by the arrow 102 in FIGS. 8 and 9, the motor 60 is rotating the blades 72 in such a direction that the linear pulling force generated by the rotating blades is urging, or attempting to pull, the muscle trainer 44 in the illustrated direction. This direction is opposite the direction that the dominated set of in-front-of-the-plane muscles would normally be directing the trainer 44. Consequently, the dominated set of muscles, which in this instance is the front-of-the-plane muscles, is working more strenuously than the dominating set of muscles, i.e., the behind-the-plane muscles, not only to attempt to locate the shaft 54 in the club shaft plane, but to also overcome the linear pulling force of the rotating blades 72. In this manner, the front-of-the-plane muscles, which comprise the dominated set of muscles, are being stressed more than the behind-the-plane muscles, in an exercise context.

Upon reaching the full backswing position (FIG. 9), the golfer 30 releases the spring-biased push-button switch 98, and the motor 60 ceases to operate, thereby completing one cycle of the exercise motion, with the resulting effect of overtraining the front-of-the-plane muscles to thereby bring the tug-of-war between the two sets of opposing muscles into a balanced perspective leading to the sculpting of an ideal club shaft plane.

If the front-of-the-plane muscles of a right handed golfer are the dominating muscles, the muscle trainer 44 may be revolved through one hundred and eighty degrees so that the linear pulling force of the rotating blades 72 is in a direction which is opposite the direction of the arrows 102, shown in FIGS. 6, 8, and 9. The muscle trainer 44 would then be processed through the same exercising steps described above, except that the behind-the-plane muscles, which in this instance are the dominated muscles, would be more strenuously exercised for the reasons expressed above.

In the alternative, the reversing switch of the control module 100 could be reversed from the state described above, where the front-of-the-plane muscles were the dominated muscles, so that the rotation of the motor 60, and the blades 72, would be reversed to provide a linear pulling force in a direction opposite the direction of the arrows 102 shown in FIGS. 6, 8 and 9.

If the golfer 30 is left handed, the orientations of the linear pulling forces for the left handed golfer are mirror images of the above described pulling forces for the right handed golfer. Therefore, the reversing switch of the muscle trainer 44 would be switched accordingly to provide the mirror image pulling forces to accommodate the left handed golfer 30. Otherwise, the muscle trainer 44 would be used in the same manner as described above with respect to the right handed golfer.

In a similar manner, the muscle trainer 44 can also be used to selectively train the hinge opposing muscle group. As shown in FIGS. 22A and 22B, to place the linear pulling force in the hinge plane, the golfer 30 grasps the grip 58 of muscle trainer 44 with the shaft 54 having been rotated ninety degrees in either a clockwise or a counter-clockwise direction from the shaft's orientation shown in FIGS. 6, 7, 8 and 9. As above, the golfer can proceed with a non-stop swing and depress the push-button switch in the section of the swing in which hinge training is needed, or use step-and-stall motions to accomplish the needed hinge training.

As stated above, the most common hinging error is known as casting. For a right-handed or left-handed golfer with over action of the hinge releasing muscles at the beginning of the downswing, the hinge angle $\phi$ would be inappropriately decreasing during this section of the swing. To achieve proper hinging in this situation, the dominated hinge loading muscles must be exercised in a more strenuous fashion than the dominating hinge releasing muscles. This would require that the propeller generate a linear pulling force on the implement which will urge the distal end of the muscle trainer 44 in the hinge release direction as indicated by the arrow 220 in FIG. 22B. Likewise, if there is over action of the hinge loading muscles at any point during the swing, the propeller would need to generate a linear pulling force on the implement which will urge the distal end of muscle trainer 44 in the hinge loading direction as indicated by the arrow 222 in FIG. 22B.

Figure 10:
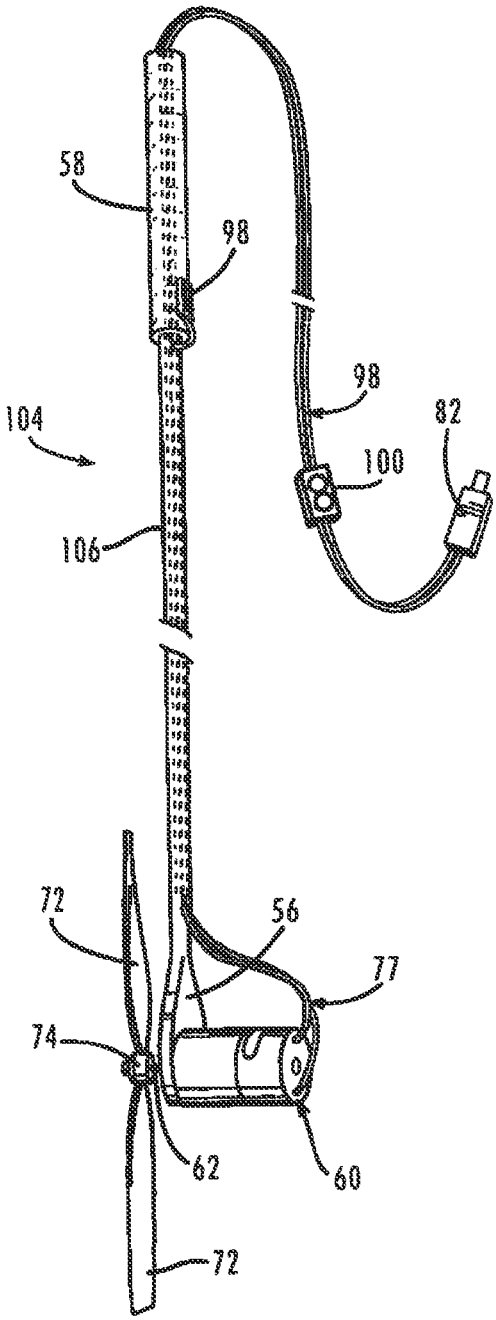
FIG. 10 is a perspective view showing a muscle trainer in accordance with a second embodiment of the invention.

As shown in FIG. 10, the muscle trainer 104, which is a second embodiment of the invention, includes a hollow shaft 106. The muscle trainer 104 differs from the muscle trainer 44 (FIG. 4) in that the length of the shaft 106 is shorter than the length of the shaft 54. Otherwise the muscle trainers 44 and 104 are substantially identical. Except for the shaft 106, the elements of the muscle trainer 104 are identified in FIG. 10 by the same numbers as the corresponding elements of the muscle trainer 44 shown in FIG. 4.

In the motor-mounted arrangement of the muscle trainer 104 illustrated in FIG. 10, a common axis of the motor 60 and the blades 72 extends at an angle of ninety degrees from the shaft 54 in the same manner as in the motor-mounted arrangement of the muscle trainer 44.

The muscle trainer 104 is preferably used in the same manner as the muscle trainer 44, as described above. The shorter shaft 106 allows the muscle trainer 104 to be used in a closer-quarters environment, such as, for example, a room within a house. Otherwise, the advantages attainable by use of the muscle trainer 44, as described above, are also attainable by use of the muscle trainer 104.

As noted above, the rotation of the club shaft and the club face to effect the two-plane merger utilizes a rotational opposing muscle group, which includes the counter-clockwise rotational muscles and the clockwise rotational muscles. These rotational muscles should also be exercised and sculpted to provide total enhancement of the golfer's swing.

Figure 13:
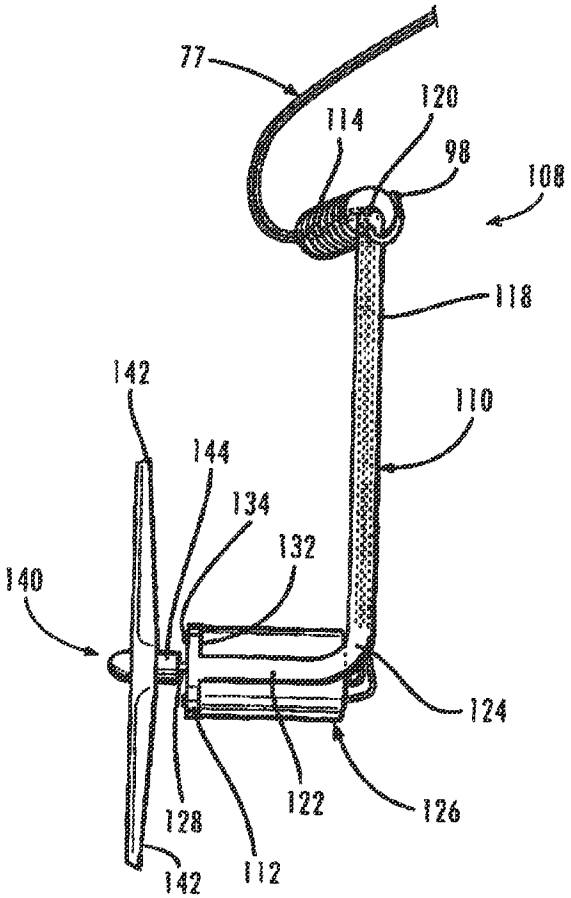
FIG. 13 is a bottom perspective view showing the muscle trainer of FIG. 12.
Figure 12:
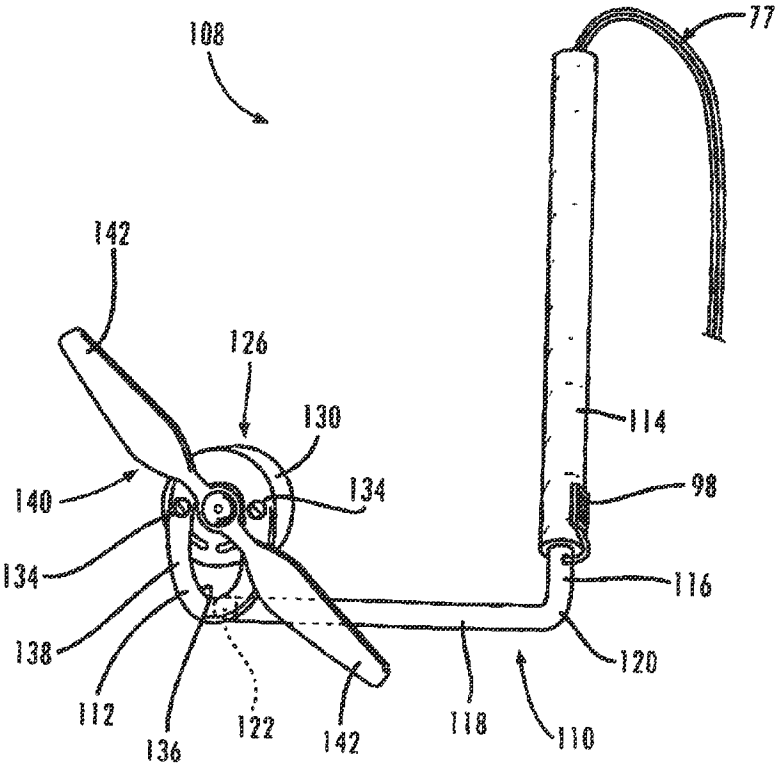
FIG. 12 is a front perspective view showing a muscle trainer in accordance with a third embodiment of the invention.

With that in mind, as shown in FIGS. 12 and 13, the muscle trainer 108 is a third embodiment of the invention. The muscle trainer 108 includes a hollow shaft 110 having a flat motor-mount pad 112 formed at a distal end of the shaft, and a grip 114 attached to an outer side of the shaft adjacent a proximal end thereof. The grip 114 is formed from a soft non-metallic material, such as, for example, leather, of the type typically used to form the grip of a conventional golf club, such as, for example, the club 32.

The shaft 110 is formed with a first straight section 116 which includes the grip 114, and a second straight section 118 which extends at an angle of substantially ninety degrees from the section 116 at a juncture 120 of the first and second straight sections. The shaft 110 is further formed with a third straight section 122, which extends at an angle of substantially ninety degrees from the second straight section 118 at a juncture 124 of the second and third straight sections. The first straight section 116 is also referred to herein as a grip section, the second straight section 118 is also referred to herein as an intermediate section, and the third straight section 122 is also referred to herein as a motor-mount section.

As shown in FIGS. 12 and 13, the first and second straight sections 116 and 118, respectively, of the shaft 110 are located in a plane, hereinafter referred to as "the common plane," while the third straight section 122 extends perpendicularly from the common plane.

Referring to FIGS. 12 and 13, the muscle trainer 108 further includes an electric motor 126 having a rotatable drive shaft 128 extending from one end of a motor housing 130. The one end of the motor housing 130 is placed against a first side 132 of the pad 112, and is attached to the pad by screws 134. The drive shaft 128 extends through an opening 136 formed through the pad 112, and from a second side 138 of the pad.

A fan blade assembly 140 includes a pair of blades 142, which are fixedly attached to a hub 144. The hub 144 is mounted on the free end of the rotatable drive shaft 128 of the motor 126, and is attached to the drive shaft for rotation therewith. In this arrangement, the combination of the motor 126 and the fan blade assembly 140 form a force generator.

A protective cage of the type shown in FIG. 4 may be fixedly attached to the pad 112 to preclude the blades 142 from coming into injurious or damaging contact with anyone or any object external to the cage. The muscle trainer 108 also preferably includes the wiring assembly 77, the battery pack 90, the push-button switch 98, and the control module 100 with the speed controller and the reversing switch in the same fashion as the muscle trainer 44.

In the motor-mounted arrangement of the muscle trainer 108, as illustrated in FIGS. 12 and 13, a common axis of the motor 126 and the blades 142 extends at an angle of ninety degrees from the common plane in which the first and second sections 116 and 118, respectively, are located. This is preferably the same angular relation in which the common axis of the motor 60 and the blades 72 of the muscle trainer 44 is mounted with respect to the shaft 54 thereof. With this angular relationship, the muscle trainer 108 will provide a linear pulling force in the direction of the arrow 102 (FIGS. 6 and 14), which is comparable to the linear pulling force provided by the muscle trainers 44 and 104. Therefore, this linear-pulling-force feature of the muscle trainer 108 provides the opportunity for the golfer 30 to use the muscle trainer 108 to exercise the front-of-the-plane muscles and the behind-the-plane muscles in the same manner described above with respect to the muscle trainers 44 and 104.

In addition, with the second straight section 118 of the shaft 110 of the muscle trainer 108 being offset by ninety degrees from the first straight section 116 (grip section), significant rotational forces are generated as the blades 142 are rotated by the motor 126. The rotational forces generated by the rotating blades 142 are represented in FIG. 14 by a rotating-arrows symbol 146.

Figure 16:
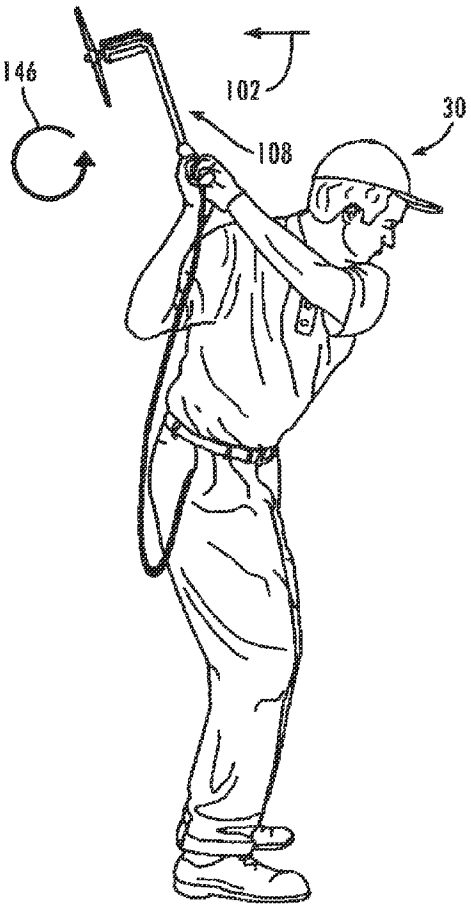
FIG. 16 is a side perspective view showing the right side of a golfer in the backswing-completion position while gripping the muscle trainer of FIG. 12 in the process of a muscle training exercise.
Figure 15:
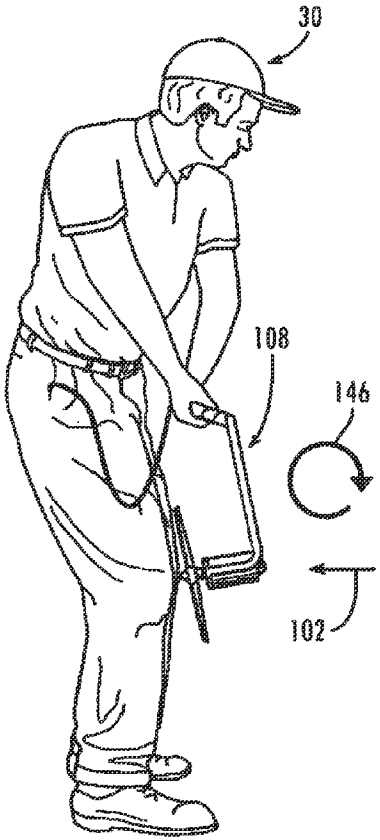
FIG. 15 is a side perspective view showing golfer in a nine o'clock "toe up" position, relative to the six o'clock position of FIG. 14, while gripping the muscle trainer of FIG. 12 in the process of a muscle training exercise.
Figure 14:
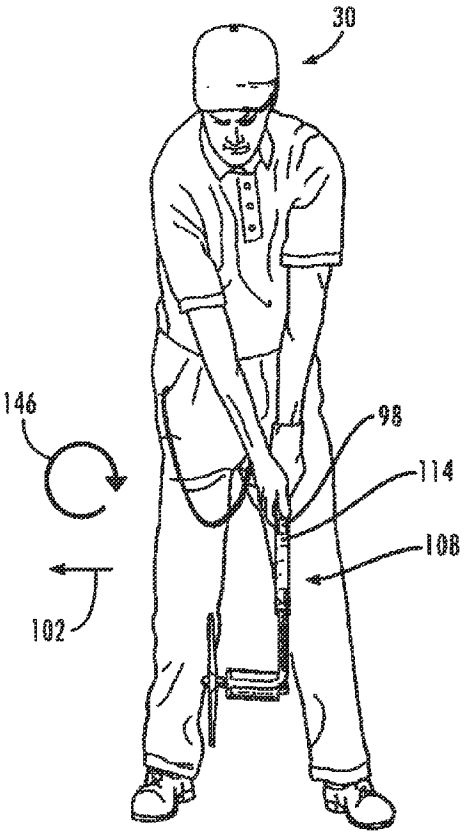
FIG. 14 is a front perspective view showing a golfer gripping the embodiment of the muscle trainer of FIG. 12, with the muscle trainer in a six o'clock position in preparation for a muscle training exercise.

Referring to FIGS. 14, 15 and 16, when using the muscle trainer 108, the golfer 30 grasps the grip 114 in the conventional golf-gripping manner, depresses the push-button switch 98 and proceeds with a non-stop backswing, or the step-and-stall motions, to process through an exercise cycle in the same manner as described above with respect to the use of the muscle trainer 44. During the exercise cycle, the front-of-the-plane muscles and the behind-the-plane muscles are exercised in the manner described above. Also, the rotational opposing muscle group is stressed by the rotational forces generated by the effect of the rotating blades 142 being offset from the axis of the first straight section 116. Thus, the rotational opposing muscle group is exercised by the golfer's reactionary efforts in response to the rotational forces.

For a right-handed golfer with over action of clockwise rotational muscles during the backswing, the club face would be in a closed position at the backswing completion position. To achieve two-plane-merger in this situation, the dominated counter-clockwise rotational muscles must be exercised in a more strenuous fashion than the dominating clockwise rotational muscles. This would require that the propeller generate a clockwise rotational force on the implement. Likewise, if there is over action of the counter-clockwise rotational muscles, the propeller would be set to generate a counter-clockwise rotational force on the implement.

With dedicated exercising use of the muscle trainers 44 and 108 over a period of time, the golfer 30 will obtain a proper club shaft plane, proper hinging, and proper rotational muscle memory to the extent that the action of the hands, wrists and arms can be thought of as being on automatic pilot. This allows the golfer 30 to easily concentrate on other essentials such as swing speed, swing arc, keeping the golfer's weight from shifting to the outside of the golfer's right foot (if the golfer is right handed) or outside the golfer's left foot (if the golfer is left handed), and driving the downswing with the larger muscles of the torso.

As shown in FIGS. 12 and 13, the motor 126 and the blade assembly 140 are located to one side of an imaginary common plane which passes through the first straight section 116 and the second straight section 118. With this arrangement, the axis of the motor 126 and the blade assembly 140 extends perpendicularly from the common plane.

Other arrangements could be employed where the motor and the blades do not extend fully to one side of the common plane, but the axis of the motor and the blades continues to be perpendicular to the common plane. For example, with reference to FIG. 13, the pad 112 could be formed at a distal end of the straight section 118, in place of the illustrated junction 124, to form a distal end of the shaft 110. In this arrangement, the pad 112 would be in the common plane. The motor 126 would be mounted on one side of the pad 112, and thereby on one side of the common plane, and the blades 142 would be located on the other side of the pad, and thereby on the other side of the common plane, with the axis of the motor and the blades being perpendicular to the common plane. This assembly of the pad 112, the motor 126 and the blades 142 would then resemble the assembly of the pad 56, the motor 60 and the blades 72, respectively, at the distal end of shaft 54, as shown in FIG. 4.

Figure 11:
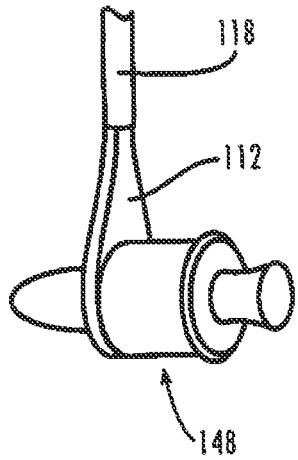
FIG. 11 is a partial perspective view showing a motor which can be used in place of the motor of FIG. 5, in accordance with an alternative embodiment of the invention.
Figure 19:
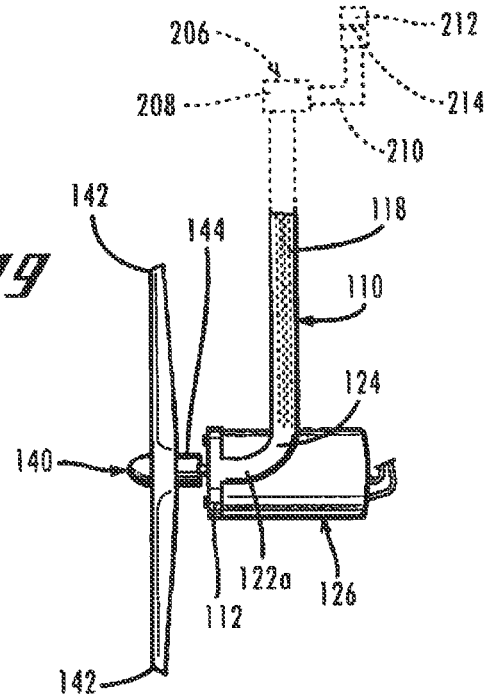
FIG. 19 is a partial side view showing a first modified version of the muscle trainer of FIG. 13 in accordance with an alternative embodiment of the invention.
Figure 20:
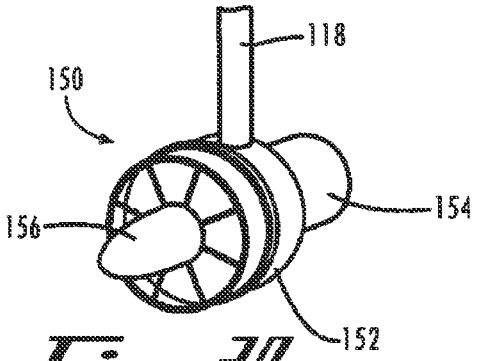
FIG. 20 is a partial side view showing a second modified version of the muscle trainer of FIG. 13 in accordance with an alternative embodiment of the invention.

Other arrangements, in which the force generator is perpendicular to the common plane, are illustrated in FIGS. 11, 19 and 20. As shown in FIG. 11, a jet engine 148, of the type typically used with model airplanes, is mounted on the pad 112, where the pad is located at the distal end of the straight section 118 of the muscle trainer 108 as modified in the manner described above. In this arrangement, the jet engine 148 forms a force generator.

As shown in solid view in FIG. 19, the muscle trainer 108 has been modified to replace the straight section 122 (FIG. 13) with a shorter straight section **122*a* of the shaft 110, which is also located in the common plane, whereby the motor 126 straddles the common plane and the common axis of the motor and the blades 142** are perpendicular to the common plane.

Referring to FIG. 20, the muscle trainer 108 has been modified to replace the motor 126 and the fan blade assembly 140 with an integral assembly 150. The integral assembly 150 includes a shroud 152 having an enclosed side wall with axial openings at opposite ends thereof. A motor 154 is mounted partially within the shroud 152 and extends from a first of the axial openings thereof. A fan blade assembly 156 is mounted on a shaft of the motor 154 and is contained within the shroud 152 adjacent a second of the axial openings thereof. The combination of the motor 154 and the fan blade assembly 156 form a force generator.

In preparation for assembly with the integral assembly 150, the muscle trainer 108 is modified to the extent that the distal end of the straight section 118 is the distal end of the now padless shaft 110. As shown in FIG. 20, the distal end of the modified straight shaft 118 is connected directly to an outer surface of the shroud 152. Since the straight section 118 is in the common plane, the integral assembly 150 straddles the common plane and the common axis of the motor 154 and the fan blade assembly 156 is perpendicular to the common plane.

Figure 17:
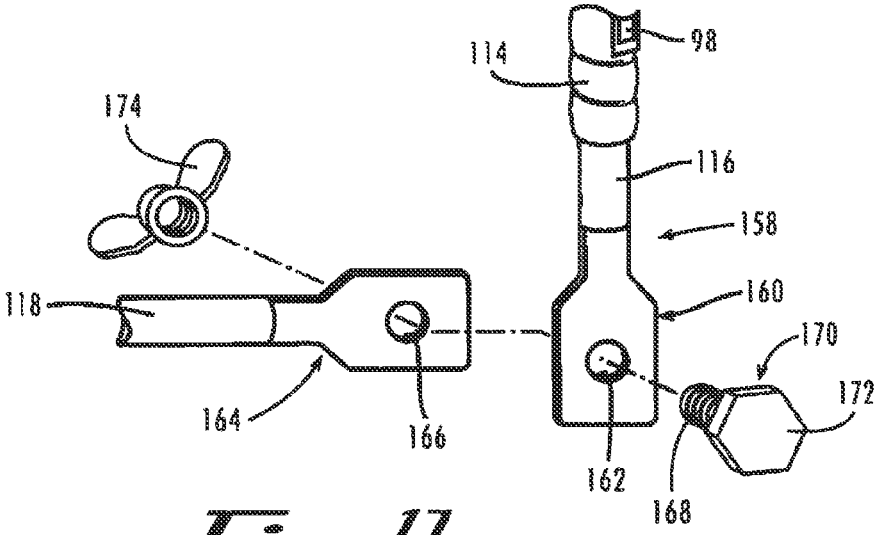
FIG. 17 is a partial exploded view showing a first apparatus for adjusting the relative position of a pulling force means with respect to the shaft of a preferred embodiment of the invention.

While the muscle trainer 108 provides for the mounting of the straight section 116 of the shaft 110 at an angle of ninety degrees with respect to the straight section 118, the golfer 30 may find more comfort and greater ease of exercising with an angle greater or less than ninety degrees between the sections 116 and 118. With that in mind, the muscle trainer 108 shown in FIG. 13 is modified by placing a first adjustment mechanism 158, as shown in FIG. 17, at the juncture 120 of the shaft 110.

In particular, the straight section 116 is separated from the straight section 118 at the juncture thereof to form adjacent free ends of the straight sections. The adjustment mechanism 158 includes a first connection member 160 which is attached to the free end of the straight section 116 and is formed with a flat portion having a hole 162 formed there through. The adjustment mechanism 158 further includes a second connection member 164 which is attached to the free end of the straight section 118 and is formed with a flat portion having a hole 166 formed there through. The flat portions are arranged into an overlapping assembly with the holes 162 and 166 in alignment. A threaded portion 168 of a bolt 170 is located through the aligned holes 162 and 166, while a head 172 prevents the bolt from being moved through the holes. A threaded fastener 174 is placed on the threaded portion 168 of the bolt 170 and tightened to retain the connection members 160 and 164 in assembly, and to connect and retain together the straight sections 116 and 118 of the shaft 110.

The fastener 174 can be loosened and the straight sections 116 and 118 manipulated to a perpendicular position or a non-perpendicular position selected by the golfer 30 and then retightened to secure the straight sections in the selected angular relationship. Since the straight sections 116 and 118 are located in the common plane, by using the muscle trainer 108 modified by the adjusting mechanism 158, the golfer 30 has the opportunity of selectively and adjustably locating the motor 126 and the fan blade assembly 140 in many different angular positions, including perpendicular and non-perpendicular, with respect to the distal end of the straight section 116, while maintaining the common axis of the motor 126 and the fan blade assembly 140 perpendicular to the common plane.

Figure 18:
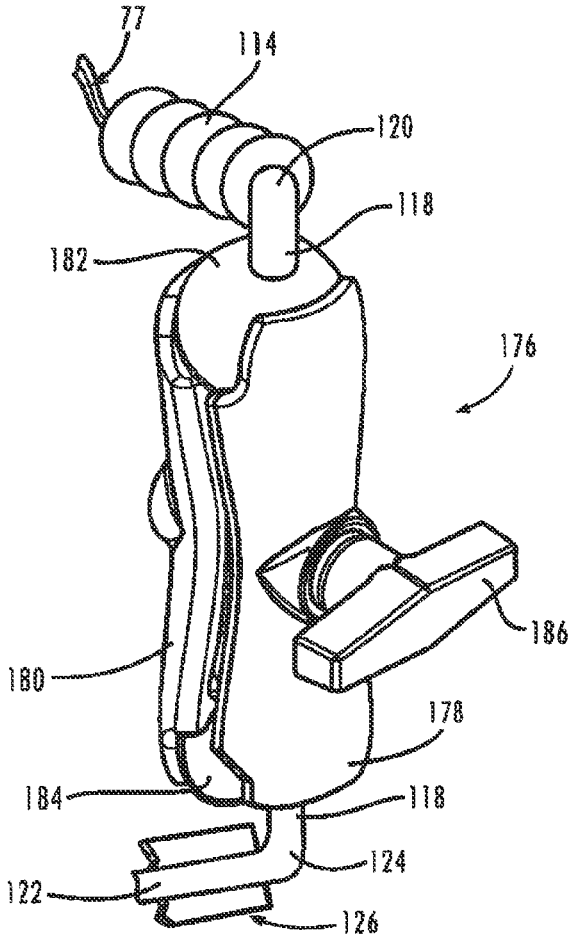
FIG. 18 is a partial perspective view showing a second apparatus for adjusting the relative position of the pulling force means with respect to the shaft of a preferred embodiment of the invention.

The muscle trainer 108 shown in FIGS. 12 and 13 can also be modified to accomplish the above-noted adjustability by replacing an intermediate portion of the straight section 118 of the shaft 110 with a second adjusting mechanism 176 as shown in FIG. 18. With this arrangement, a proximal portion of the straight section 118 remains adjacent the junction 120, and a distal portion of the straight section 118 remains adjacent the junction 124.

The adjusting mechanism 176 includes two half shells 178 and 180, which, when assembled together, generally assume a "peanut" shape with opposite open ends. Each of the half shells 178 and 180 is formed with a concave interior, which interfaces with the concave interior of the other shell when the shells are assembled together. Two spherical elements 182 and 184 are spatially located within, and at opposite ends of, the interior of the assembled half shells 178 and 180, and extend partially from a respective one of the open ends.

An adjusting knob 186 is located along an outer side of the half shell 178 and cooperates with a threaded member extending from the half shell 180 and through the assembled half shells. Selective manipulation of the knob 186 allows a slight separation, without disassembly, of the half shells 178 and 180 so that the spherical elements 182 and 184 can be adjustably manipulated while being retained within the assembled half shells. The knob 186 can then be adjusted to move the half shells 178 and 180 to a tightened position, whereby the spherical elements 182 and 184 are clamped between the half shells in their manipulated positions.

The second adjusting mechanism 176 is illustrated, described and referred to as "a split arm assembly" in U.S. Pat. No. 5,845,885, which issued on Dec. 8, 1998, to Jeffrey D. Carnevali. A split arm assembly, of the type described herein as the second adjusting mechanism 176, is available commercially from National Products Inc. of Seattle, Wash.

Referring again to FIG. 18, the remaining proximal portion of the straight section 118, which is joined with the juncture 120, is attached to the spherical element 182. Also, the remaining distal portion of the straight section 118, which is joined with the juncture 124, is attached to the spherical element 184.

If the golfer 30 wishes to adjust the angular relationship between the straight section 116 of the shaft 110 and the straight section 118 thereof, the knob 186 is manipulated to relax the retention of the two half shells 178 and 180. Thereafter, the spherical element 182 is manipulated to make the desired angular adjustment, and the knob 186 is again manipulated to draw the half shells 178 and 180 tightly together to retain the selected angular adjustment.

During the adjustment process, the spherical element 184 is not manipulated, whereby the common axis of the motor 126 and the fan blade assembly 140 is retained in the perpendicular relation with the common plane. This perpendicular relationship can be permanently maintained by securing the distal portion of the straight section 118 within the space occupied by the spherical element 184 between the half shells 178 and 180.

It is noted that the distal portion of the straight section 118 of the shaft 110 can be adjusted if desired. Such adjustment would shift the common axis of the motor 126 and the fan blade assembly 140 into a non-perpendicular alignment with the common plane. Also, an adjustment mechanism, such as the adjustment mechanism 158 of FIG. 17, could be located in place of the juncture 124 of the shaft 110 to provide adjustment of the common axis of the motor 126 and the fan blade assembly 140 into a non-perpendicular alignment with the common plane.

When the common axis of the motor 126 and the fan blade assembly 140 is located at a non-perpendicular angle with respect to the common plane, a vector component of the non-perpendicular angle will be perpendicular to the common plane. This vector component is referred to hereinafter as "the perpendicular vector component." The perpendicular vector component will result in a force generation component directed in the manner comparable to direction of the force generation described above with respect to the non-adjustable muscle trainer 108 as shown in FIGS. 12 and 13. Thus, the golfer 30 will be able to maintain an exercise regimen comparable to that described above with respect to the non-adjustable muscle trainer 108.

In addition, other vector components of force generation are present when the common axis of the motor 126 and the fan blade assembly 140 are non-perpendicular with respect to the common plane. These vector components are referred to hereinafter as "the non-perpendicular vector components." The non-perpendicular vector components will result in force generation components which allow the golfer 30 to laterally extend the benefits of exercising of the club shaft plane muscle group, the rotational muscle group, and the hinge muscle group thereby further enhancing the sculpting of these muscles.

Figure 21:
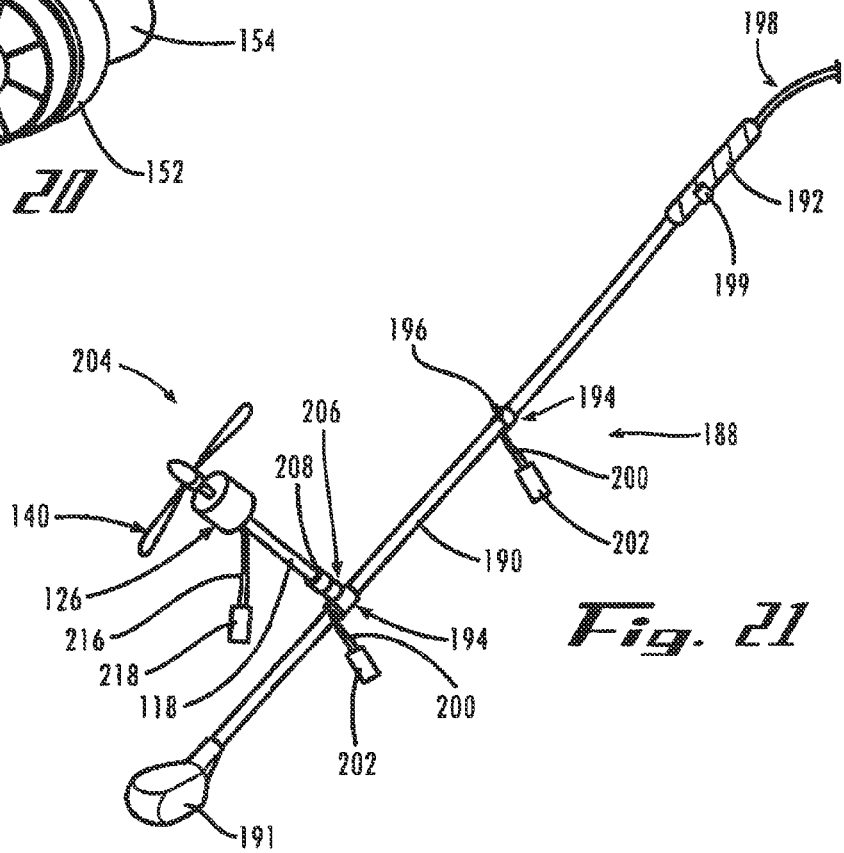
FIG. 21 is a side view of a conventional golf club, referred to as a driver, which has been modified to be used as a muscle trainer, in accordance with an alternative embodiment of the invention.

As depicted in FIG. 21, an alternative embodiment of the invention includes a conventional golf club, such as a driver 188, that has been modified to provide facility for muscle training in a manner similar to the muscle trainers 44, 104 and 108, and the various above-described modified versions thereof. In particular, the modified driver 188 includes a hollow shaft 190, a club head 191 at a distal end thereof, and a grip 192 at a proximal end thereof, all in a conventional manner. The length of hollow shaft 190 could be varied and club head 191 could be changed to produce a replica of any type of golf club. At least one support ring 194 is secured to a selected portion of the shaft 190, with each ring including a threaded stud 196 extending away from the shaft. Although two support rings 194 are illustrated in FIG. 21, the number and orientation of the support rings can be varied to produce any desired force vector or combination of force vectors on modified driver 188.

The proximal end of the shaft 190 is formed with an opening (not shown) to facilitate insertion of a distal portion of a main wiring assembly 198 into an axial opening of the hollow shaft, with the main wiring assembly being connectable to a power source, such as the battery pack 90 described above. A push-button switch 199 is attached to the grip 192 and is connected to the main wiring assembly 198 in the manner described above with respect to the push-button switch 98.

Preferably, at least one small opening is formed through intermediate portions of the shaft 190, with each opening being located adjacent to the at least one respective support ring 194. At least one short wiring assembly 200 is connected at an internal end thereof, internally of the shaft, to the main wiring assembly 198, and extends outward through the at least one small opening. An external end of the at least one short wiring assembly 200 is connected to at least one connector 202.

As shown in FIG. 21, at least one motor and fan blade assembly 204 is attached to the modified driver 188. Although only one motor and fan assembly is shown, it is possible to attach more than one such assembly to produce an infinite number of combined force vectors on modified driver 188. For example, FIG. 23 depicts an embodiment having three motors and fan blade assemblies. With reference to FIG. 21, the motor and fan blade assembly 204, which is essentially the same as the assembly of the motor 126 and the fan blade assembly 140 as shown in solid in FIG. 19, includes the shaft section 118, a distal portion of which is shown in FIG. 19 in solid and a proximal portion of which is shown in dashed line.

As further shown in dashed line in FIG. 19, the motor and fan blade assembly 204 includes a connection member 206 formed with a band 208, which is attached to a proximal end of the shaft section 118. An arm 210 extends integrally from the band 208, and a coupling pad 212 is formed integrally with the arm. The coupling pad 212 is formed with a hole 214 there through which is positionable selectively over the at least one threaded stud 196, as shown in FIG. 21, which extends from the at least one support ring 194 mounted spatially on the shaft 190 of the driver 188. As shown in FIG. 21, a short wiring assembly 216 is connected at one end thereof to the motor 126, and at an opposite end thereof to a connector 218, which is designed to be connectable to the at least one connector 202.

When the golfer 30 desires to use the modified driver 188 in a muscle training mode, the golfer places the hole 214 of the coupling pad 212 over the threaded stud 196 of the at least one support ring 194, which is attached to the shaft 190 of the driver. A threaded fastener is then placed on the stud 196 and tightened against the coupling pad 212 to secure the motor and fan blade assembly 204 to the modified driver 188. The main wiring assembly 198 is connected to the battery pack.

The golfer 30 then uses the modified driver 188 in the manner described above with respect to the use of muscle trainers 44, 104, or 108 to exercise the club shaft plane muscle group, the rotational muscle group, and the hinge muscle group in accordance with the principles of the invention described herein.

While various force generators (i.e., the motors 60, 126 and 154, and their respective blade assemblies, and the jet engine 148) have been described above for use with respective ones of the various muscle trainers 44, 44*a*, 104, 108, and 188, it is to be understood that any of the above-described force generators could be used with any of the various muscle trainers without departing from the spirit and scope of the invention.

FIG. 23 depicts an embodiment of the muscle trainer 44*a* which includes multiple force generators for generating forces in multiple directions relative to the shaft 54*a* of the muscle trainer. This embodiment includes a first motor 60*a* and blade assembly 70*a* for generating force in a first direction, a second motor 60*b* and blade assembly 70*b* for generating force in a second direction, and a third motor 60*c* and blade assembly 70*c* for generating force in a third direction. In the embodiment shown in FIG. 23, the orientations of the first and second directions relative to the club shaft plane depend on swing position. The first direction is substantially parallel with the club shaft plane when the muscle trainer 44*a* is in the impact zone, and is substantially perpendicular to the club shaft plane when the muscle trainer 44*a* is in the two-plane merger zone. The second direction is substantially perpendicular to the club shaft plane when the muscle trainer 44*a* is in the impact zone, and is substantially parallel to the club shaft plane when the muscle trainer 44*a* is in the two-plane merger zone. At all swing positions, the first and second directions are substantially perpendicular to the shaft 54*a*. The force in the third direction is a rotational force about the shaft 54*a*. The first motor 60*a* is preferably disposed at the end of the shaft 54*a*. The second motor 60*b* is preferably disposed in a central portion of the shaft 54*a*. The third motor 60*c* is preferably disposed on a shaft 54*b* which is connected to and extends outward from the shaft 54*a*. It should be appreciated that there could be more than three force generators positioned on muscle trainer 44*a*, and that one such additional force generator could be positioned to generate a force in either of two directions which coincide with the axis of shaft 54*a*.

In summary, with dedicated exercising use by a golfer of any of the above-described muscle trainers 44, 44*a*, 104, 108, or 188 over a period of time, the golfer will attain balanced muscle tone and enhanced memory of the club shaft plane muscle group leading to a proper club shaft plane. With dedicated exercising use of the muscle trainers 44, 44*a*, 104, or 188 over a period of time, the golfer will attain balanced muscle tone and enhanced memory of the hinge muscle group leading to proper hinging. Further, with dedicated exercising use of the muscle trainers 108 or 188 over a period of time, the golfer will also attain enhanced rotational muscle memory leading to proper rotation of the club face plane throughout the swing. It should be appreciated that there are additional opposing muscle groups, such as the arc muscle group, which could be enhanced and brought into balance using modifications of the above described muscle trainers. With the attainment of these attributes, the action of the hands, wrists and arms in subsequent golf swings by the golfer, during the playing of the game of golf, can be thought of as being on automatic pilot. This allows the golfer to easily concentrate on other essentials such as swing speed, keeping the golfer's weight from shifting to the outside of the right foot, if the golfer is right handed, or outside the left foot, if the golfer is left handed, and driving the downswing with the larger muscles of the torso and legs.

The game of golf, and particularly the swinging of a golf club in playing the game of golf, has been used above as a centerpiece to describe the principles of the invention covered herein, as practiced by the use of the various embodiments and versions of the above-described muscle trainers, and the methods of exercising. However, the muscle trainers, and the methods of exercising, described above can also be used to enhance the muscle memory associated with other sports games and activities. For example, games such as baseball, softball, tennis, racket ball, weight lifting and weight throwing involve action between competing muscles to obtain balance and direction in the particular sports endeavor. Indeed, the muscle trainers, and the methods of exercising, described above can be used in many walks of life unrelated to sports games. For example, the swinging and directing of a maul, a hammer or an axe into engagement with a target object requires separate muscle groups. In this regard, the word "implement" as used herein may refer to sports-related implements, such as golf clubs, baseball and softball bats, tennis and racket ball rackets, weight lifting and weight throwing devices, and labor-related implements, such as mauls, hammers or axes. Also, the word "shaft" as used herein may refer to any elongate portion of a sports-related or labor-related implement, including but not limited to any of the implements listed above.

States of Motion in Two-Plane-Merger Zone and Impact Zone of Golf Swing

FIG. 25A represents nine potential states of motion in the two-plane-merger zone of the golf swing. For the backswing, the nine squares refer only to the portion of the backswing which extends from the point at which club face plane rotation has ended (eight o'clock to ten o'clock) to the point of completion of the backswing (three o'clock toe down). The central probability square (UM) represents a state of ideal motion for this segment of the backswing in which the golf club is located in an ideal club shaft plane and ideal two-plane-merger is being maintained. The other eight probability squares represent states of improper motion.

For the downswing, the nine squares of FIG. 25A refer only to the portion of the downswing which extends from the backswing completion position (three o'clock toe down) to the point at which club face plane rotation begins its rapid acceleration phase in the impact zone. The impact zone extends from around the nine o'clock downswing club shaft position through the three o'clock follow-through club shaft position. In the downswing segment between three o'clock toe down and nine o'clock, most professional golfers tend to maintain the state of motion they were in during the same segment of their backswing (nine o'clock to three o'clock toe down).

As rapid club face plane rotation begins in the impact zone, a second probability diagram, shown in FIG. 25B, represents the position of the club face plane (x axis) and club shaft plane (y axis) at impact. Ideally, the club face plane should return to a position ninety degrees away from the club shaft plane at impact. This position is referred to as the squared position or being square at impact (+). The other two impact positions are the slice position (S) and the hook position (H). The slice position refers to the state of motion in which club face plane rotation has fallen short of the square position. This position is also referred to as the open club face position at impact. The hook position refers to the state of motion in which club face plane rotation has progressed past the square position. This position is also referred to as the closed club face position at impact.

For a stroke in which the club is swung into the impact zone behind the ideal club shaft plane, the club face will approach the ball on a path which is too inside to outside the target line. This non-ideal inside to outside the target line approach can also be called non-ideal inside out and in this instance means the clubface approaches the ball from too far inside the target line, crosses the target line at impact, then moves too far outside the target line after impact. Since this is an error state of motion, it can also be called error inside out (EIO).

For a stroke in which the club is swung into the impact zone in the ideal club shaft plane, the club face will approach the ball on a path which is just slightly inside out. This state of motion is called ideal inside out (IIO).

For a stroke in which the club is swung into the impact zone in front of the ideal club shaft plane, the club face will approach the ball on a path which is outside in. This means the club face approaches the ball from outside the target, crosses the target line at impact, then moves inside the target line after impact. This state of motion is called error outside in (EOI). EOI includes the potential path in which the club face approaches the ball on a path down the target line.

The nine states of motion represented in the nine probability squares of FIG. 25B produce shots referred to as follows: EIO/S→"push slice"; EIO/+→"push"; EIO/H→"push hook"; IIO/S→"fade"; IIO/+→"draw"; IIO/H→"hook"; EOI/S→"pull slice"; EOI/+→"pull"; and EOI/H→"pull hook". Obviously, a straight shot has been left out and for good reason. A perfectly straight shot means a square club face has approached the ball on the target line and stayed on the target line through impact. For a full stroke, this straight trajectory is very hard to reproduce and is not usually a goal for the professional golfer. Professional golfers like to see shape in their shots and usually prefer either a fade or a draw as their standard trajectory. They make adjustments in their swings to produce different and more dramatic shape as the specific shot warrants.

The probability grids of FIGS. 25A and 25B can be superimposed on one another as the state of motion located in a certain square in FIG. 25A will usually produce the state of motion located in the same square in FIG. 25B.

Figure 25C:
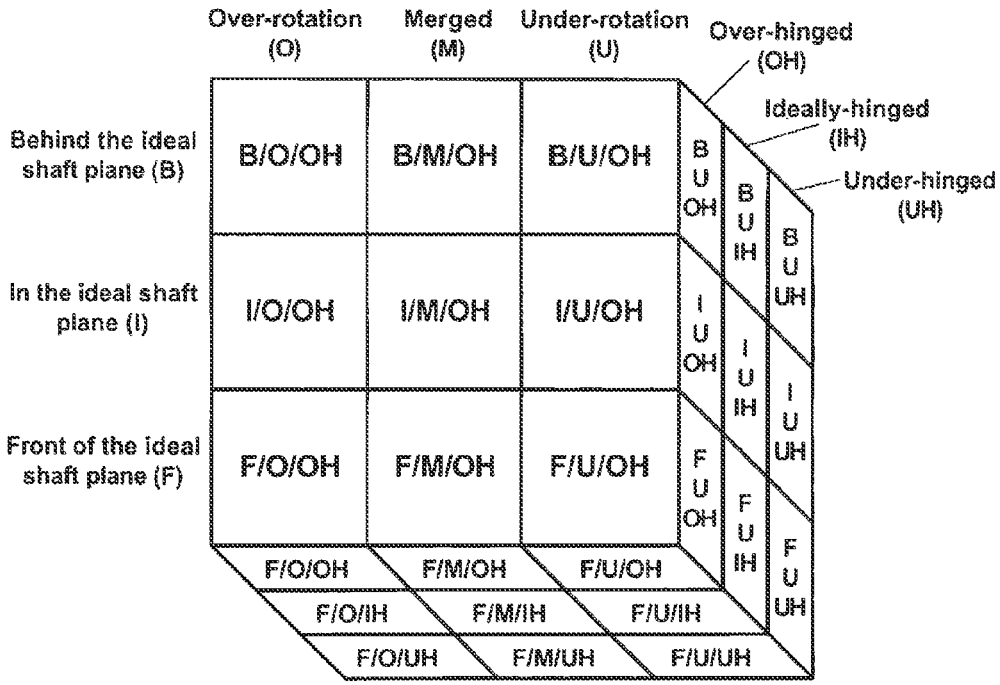
FIG. 25C depicts a probability cube representing twenty-seven states of motion in the two-plane-merger zone of the golf swing.
Figure 25D:
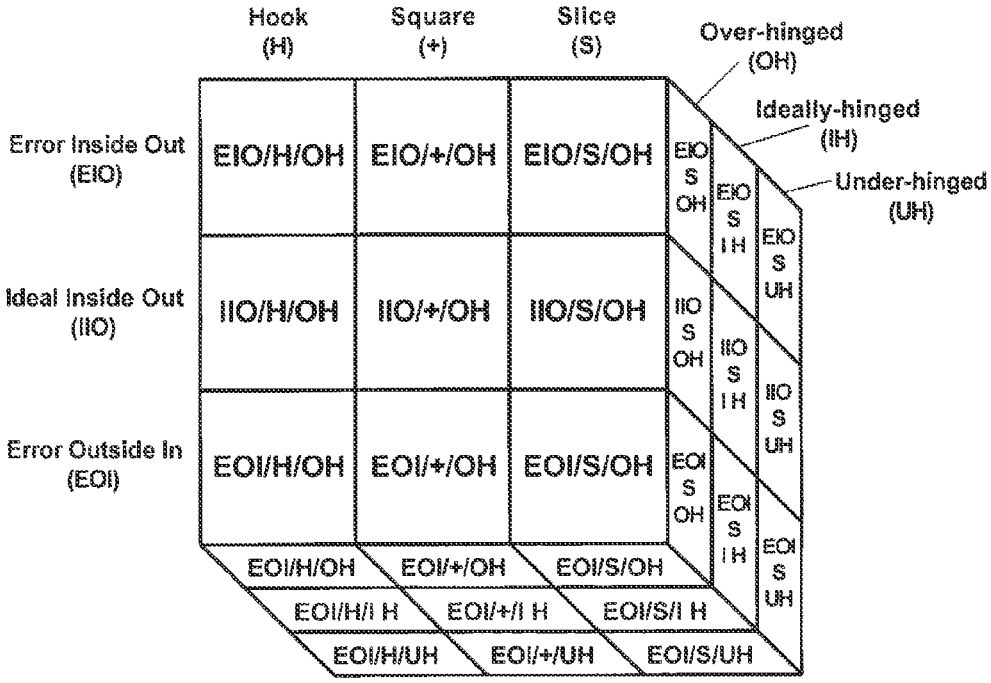
FIG. 25D depicts a probability cube representing twenty-seven states of motion in the impact zone of the golf swing.

Furthermore, as shown in FIGS. 25C and 25D, the probability grids of FIGS. 25A and 25B can be converted into probability cubes by adding a z-axis representing the three states of hinging at any point in the swing. Under-hinged (UH) signifies that the hinge angle $\phi$ is less than ideal at a given point in the swing ($-\phi_E$ in FIG. 22B beyond negative hinge tolerance). Ideally-hinged (IH) signifies that the hinge angle $\phi$ is ideal at a given point, or is at least within the $-/+\phi_E$ tolerance. Over-hinged (OH) signifies that the hinge angle $\phi$ is greater than ideal at a given point ($+\phi_E$ in FIG. 22B beyond positive hinge tolerance). Ordering these three states of hinge motion along the z-axis in the same way (UH, IH, OH) provides twenty-seven states of potential motion at any point in the two-plane-merger zone and in the impact zone. The ideal state of motion is in the center of each probability cube: I/M/IH for the two-plane-merger zone and IIO/+/IH for the impact zone.

Other error states of motion which are not represented in FIGS. 25A and 25B include but are not limited to those related to arc of the swing, speed of the swing, and positioning of the actual impact site on the clubface relative to the desired impact site. More complex probability matrices can be developed from these additional states of motion. If any single error state of motion or any combination of error states of motion exists at any point in time in a golfer's swing, the implement and its various biofeedback options can be used to correct the errors. Of course, an ideal golf swing begins with instruction and attainment of an ideal grip, alignment, stance and posture. Grip, alignment, stance and posture errors will negatively impact the attempt to attain the ideal states of motion described above.

Theories representing different concepts of what an "ideal golf swing" should look like can be represented by their own unique probability diagrams. Regardless of the nature of the "ideal golf swing" sought after by the golfer and/or their teaching professional, the present invention can be used to attain it.

Sensing Swing Errors

Figure 26:
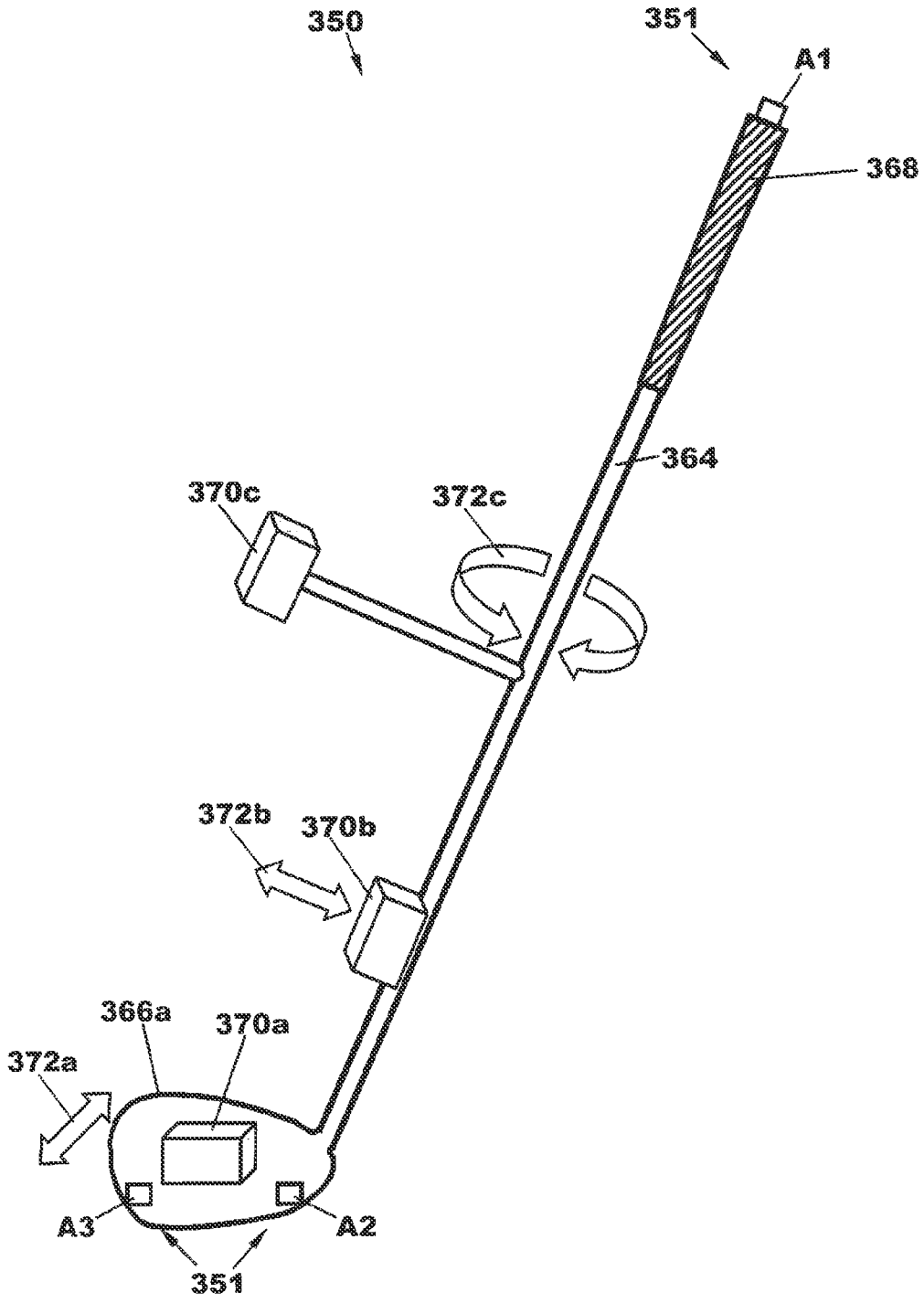
FIG. 26 depicts a swinging implement of a swing trainer according to a preferred embodiment of the invention.

With reference to FIG. 26, a preferred embodiment of a muscle trainer 350 includes one or more swing characteristic sensors 351 attached to the shaft 364 for sensing direction and velocity characteristics of a swing. In one preferred embodiment of the invention, the swing characteristic sensors 351 comprise accelerometers that sense acceleration of the shaft 364 and club head 366*a* in three orthogonal axes. As shown in FIG. 26, the accelerometers are preferably packaged in accelerometer assemblies A1, A2 and A3 positioned near the outboard end of the grip 368, the rear edge or heel of the club head 366*a* and the forward edge or toe of the club head 366*a*, respectively. In this manner, three-dimensional acceleration vectors may be measured with respect to at least three points on the muscle trainer.

Figure 33:
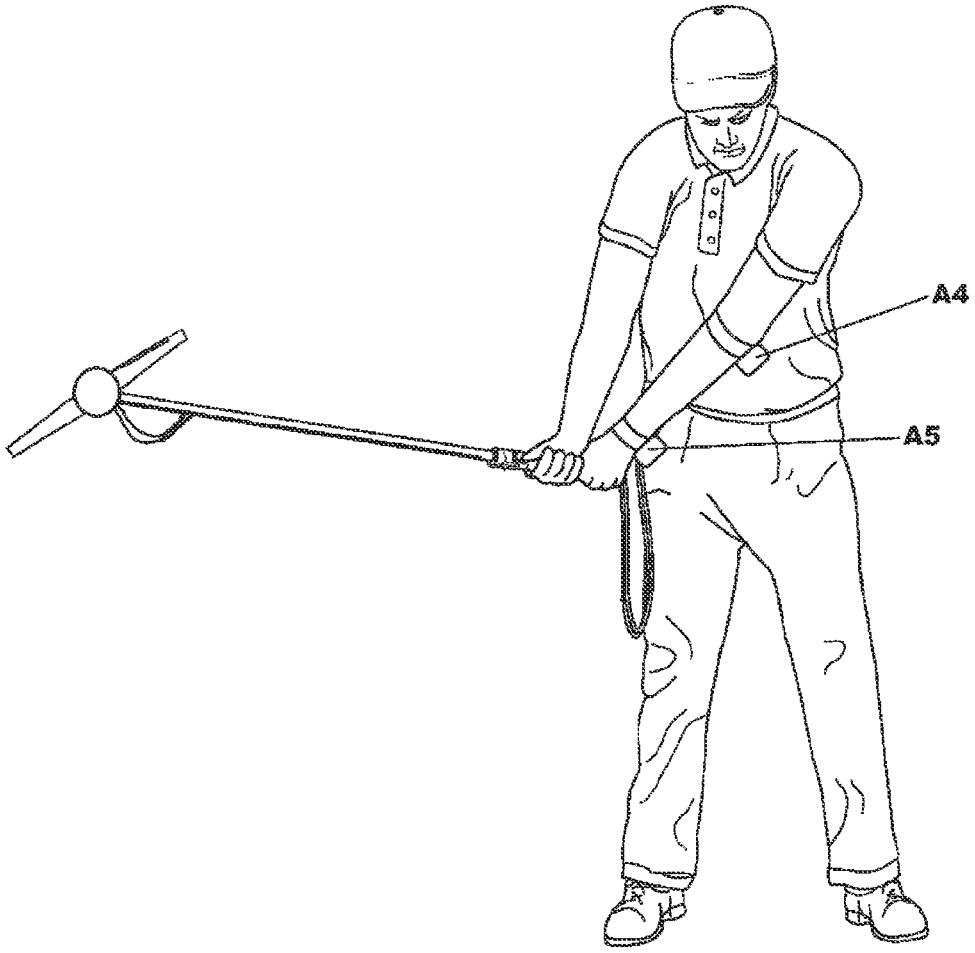
FIG. 33 depicts forearm position sensors according to a preferred embodiment of the invention.

Hinge angle errors may be determined using swing characteristic sensors 351 that sense the angular relationship between the club shaft and the golfer's left forearm (for a right-handed golfer). As shown in FIG. 33, a pair of sensors A4 and A5 are used to determine a vector generally coinciding with the ulna bone of the golfer's forearm. The sensor A4 is positioned adjacent the golfer's elbow and the sensor A5 is positioned adjacent the fifth metacarpal (pinky) side of the golfer's wrist. The sensors A4 and A5 may be accelerometers or other position sensors similar to sensors A1, A2 and A3 described above. The sensors A4 and A5 may be attached to the golfer's forearm using elastic bands or Velcro straps.

Figure 27:
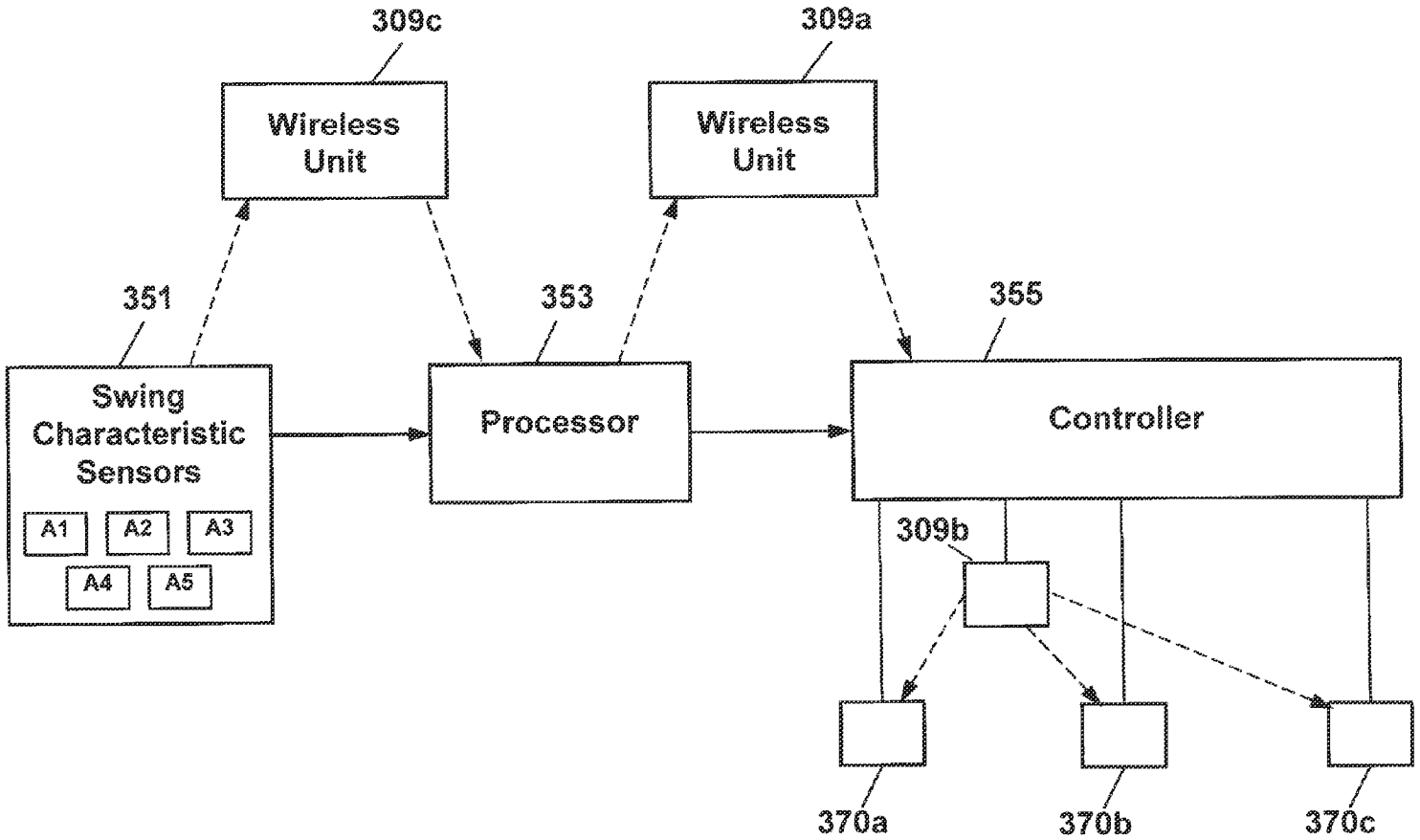
FIG. 27 depicts a functional block diagram of a swing trainer system according to a preferred embodiment of the invention.

As depicted in FIG. 27, the swing characteristic data as sensed by the sensors 351 is transferred to a processor 353. Signals from the sensors A1, A2, A3, A4 and A5 may be transmitted via one or more wireless transmitters 309*c*, such as Bluetooth transmitters, or via a wiring harness connected to the computer processor 353. Alternatively, the processor 353 may be located within the club shaft 364 or other portion of the muscle trainer 350.

Based on the measured acceleration data from sensors A1, A2 and A3, the processor 353 preferably calculates the orientation and direction of travel of the club shaft 364 and the club head 366*a* in three dimensions. Based on the measured acceleration data from sensors A4 and A5, the processor 353 calculates the orientation and direction of travel of the golfer's forearm in three dimensions. Calculation of the three-dimensional direction and velocity vectors based on the measured acceleration is accomplished using integration routines in software running on the processor 353. One example of a preferred analysis routine is described hereinafter. It should be appreciated that there could be more than three accelerometer assemblies positioned on the muscle trainer, and that the accelerometer assemblies A1, A2 and A3 and any additional accelerometer assemblies can be positioned in various different locations on or within the shaft 364 and club head 366*a*. The depiction of the locations of these assemblies in FIG. 26 is one example of three possible locations.

It should also be appreciated that there could be more than two accelerometer assemblies positioned on the golfer's body, and that the accelerometer assemblies A4 and A5 can be positioned in various different locations on the golfer's forearm. The depiction of the locations of these assemblies in FIG. 33 is one example of two possible locations.

Figure 28:
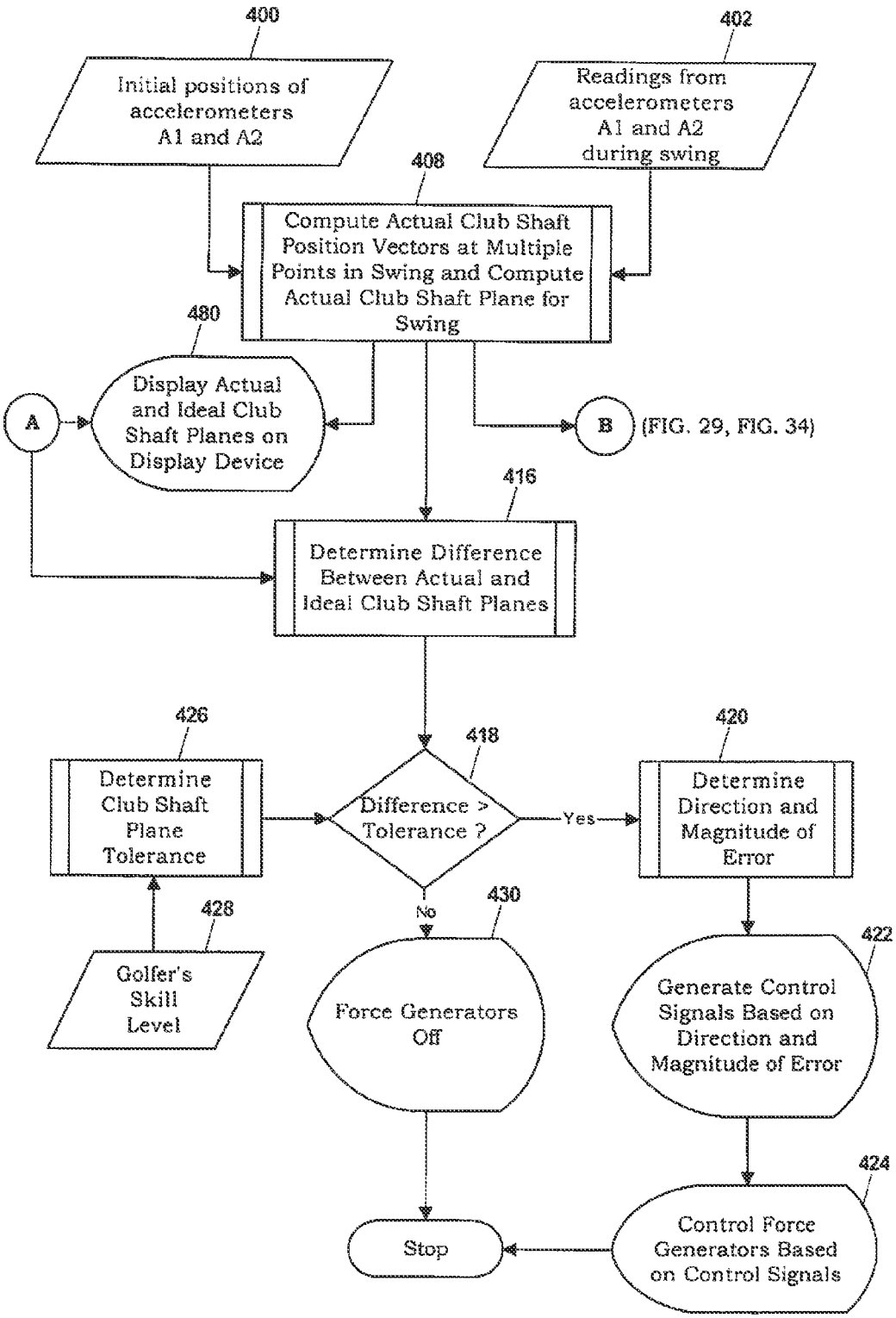
FIG. 28 depicts a flowchart of a method for comparing an actual club shaft plane to an ideal club shaft plane according to a preferred embodiment of the invention.

As set forth previously, the swing characteristic sensors 351 may comprise accelerometer units A1, A2 and A3 attached to the shaft 364 and head 366*a* of the muscle trainer 350 and accelerometer units A4 and A5 attached to the golfer's forearm. In a preferred embodiment of the invention, acceleration signals from the units A1, A2, A3, A4 and A5 are provided to a data acquisition board connected to the processor 353 where the acceleration signals are conditioned and digitized. As shown in FIG. 28, the initial positions of accelerometers are determined at the beginning of a swing (step 400), such as by precise placement of the club head and shaft at predetermined reference positions. The muscle trainer 350 is then swung while sampling the accelerometer signals at about one millisecond (or smaller) intervals (step 402). The sampled acceleration data is provided to a numerical ordinary differential equation (ODE) solver running on the processor 353. The ODE solver may be implemented as a commercially available software routine designed for acceleration-to-position conversions or as a more generally applicable Computer Algebraic System (CAS), such as Mathematica™. Preferably, the solver routine applies a Runge-Kutta method or other equivalent method suited for this purpose.

The ODE solver calculates the positions of the accelerometers independently based on the data points measured at each sample interval (step 408). These position points for sensors A1 and A2, when associated as pairs, indicate the locations of the endpoints of the implement shaft 364 during the swing. Thus, the calculated endpoints of the shaft 364 trace out the path of the club shaft and can be used to calculate the club shaft plane during the swing of the muscle trainer 350. The position points for sensors A4 and A5, when associated as pairs, indicate the locations of the endpoints of the golfer's forearm during the swing.

Because of compounding of errors in the numerical methods applied in computing the actual club shaft plane and errors in the accelerometer data, it is anticipated that computation of the actual club shaft plane of the backswing may be more accurate than that of the actual club shaft plane of the downswing and the actual club shaft plane of the follow-through. With this consideration, one preferred embodiment of the invention calculates the actual club shaft plane for the backswing only, and another preferred embodiment calculates the actual club shaft plane for the backswing, downswing, and follow-through.

In either case, the end of the backswing must be determined so that the computation of the backswing may be separable from the computation of the downswing. In one embodiment, the end of the backswing is determined to have been reached when the horizontal separation between the computed positions of the accelerometer A2 (at the heel of the club head) and the accelerometer A1 (at the end of the grip) is greater than some predetermined amount. Although of different polarity, this value would also reach a maximum at the nine o'clock position. In an alternative embodiment, the end of the backswing is determined to have been reached when the vertical position of the accelerometer A1 (at the end of the grip) in relation to the ground ceases to increase and begins to decrease. In yet another embodiment, the end of the backswing is determined to have been reached when the vertical positions of the accelerometers A1 and A2 with respect to ground level are substantially equal.

Table I below provides a nomenclature for referring to the various segments of a swing.

TABLE I

| Segment No. | Swing Segment Name | Clock Position | Relative Vertical Positions of Accelerometers A1 and A2 |
|---|---|---|---|
| 1 | Address | 6 o'clock | vA2 ≈ zero [1]<br>vA1 − vA2 at positive maximum [2] |
| 2 | Take-away | 6 o'clock-9 o'clock (toe up) | vA1 − vA2 positive and decreasing |
| 3 | Backswing horizontal | 9 o'clock (toe up) | vA1 ≈ vA2 |
| 4 | Initial hinging | 9 o'clock-12 o'clock | vA1 − vA2 negative and increasing |
| 5 | Backswing vertical | 12 o'clock | vA1 − vA2 at negative maximum |
| 6 | Finish hinging | 12 o'clock-3 o'clock (toe down) | vA1 − vA2 negative and decreasing |
| 7 | Backswing completion | 3 o'clock (toe down) | vA1 ≈ vA2<br>Near this point, motions of A1 and A2 experience pauses of variable duration. The duration of pause for A1 and A2 will be different due to bending of the club shaft that occurs when A1 stops moving. Three o'clock toe down is a generalization, as this club shaft position in a full stroke will vary for different golfers and for different clubs swung by the same golfer. |
| 8 | Downswing initiation | 3 o'clock-12 o'clock (toe down) | vA1 − A2 negative and increasing<br>Maintenance of the wrist hinge is crucial until the Downswing Release segment. A stable wrist hinge results in a minimal increase in vA2 in the early part of this segment. An improper early release of the wrist hinge position "casting move" will result in an exaggerated increase in vA2 during the early part of this segment. |
| 9 | Downswing vertical | 12 o'clock | vA1 − vA2 at negative maximum<br>Flattening of ideal downswing club shaft plane means that the difference between vA2 and vA1 will be less than it was for Backswing Vertical segment. |
| 10 | Downswing middle | 12 o'clock-9 o'clock (toe up) | vA1 − vA2 negative and decreasing |
| 11 | Downswing horizontal | 9 o'clock (toe up) | vA1 ≈ vA2 |
| 12 | Downswing release | 9 o'clock-6 o'clock | vA1 − vA2 positive and increasing |
| 13 | Impact | 6 o'clock | vA2 ≈ zero<br>vA1 − vA2 at positive maximum<br>Flattening of ideal downswing club shaft plane means that the difference between vA2 and vA1 will be less than it was at Address segment. |
| 14 | Impact follow-through | 6 o'clock-3 o'clock (toe up) | vA1 − vA2 positive and decreasing |
| 15 | Follow-through horizontal | 3 o'clock | vA1 ≈ vA2 |
| 16 | Re-hinging | 3 o'clock-12 o'clock (toe up) | vA1 − vA2 negative and increasing |
| 17 | Follow-through vertical | 12 o'clock | vA1 − vA2 at negative maximum |
| 18 | Finish re-hinging | 12 o'clock-9 o'clock (toe down) | vA2 − vA1 positive and decreasing |
| 19 | Follow-through completion | 9 o'clock (toe down) | vA1 ≈ vA2 |

[1] vA2 is the vertical position of accelerometer A2 with respect to the ground.
[2] vA1 is the vertical position of accelerometer A1 with respect to the ground.

Figure 30:
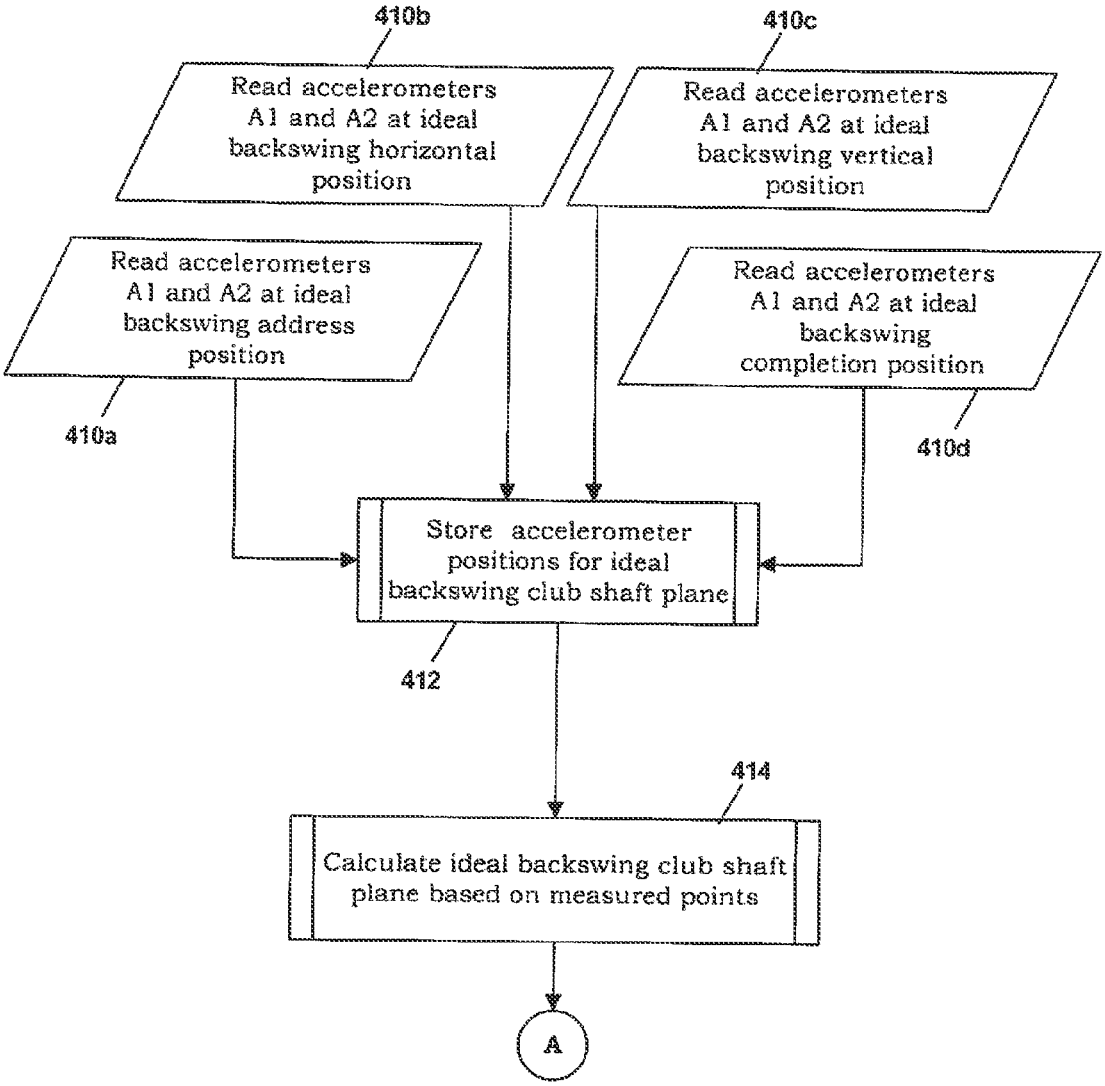
FIG. 30 depicts a flowchart of a method for determining an ideal backswing club shaft plane according to a preferred embodiment of the invention.
Figure 31:
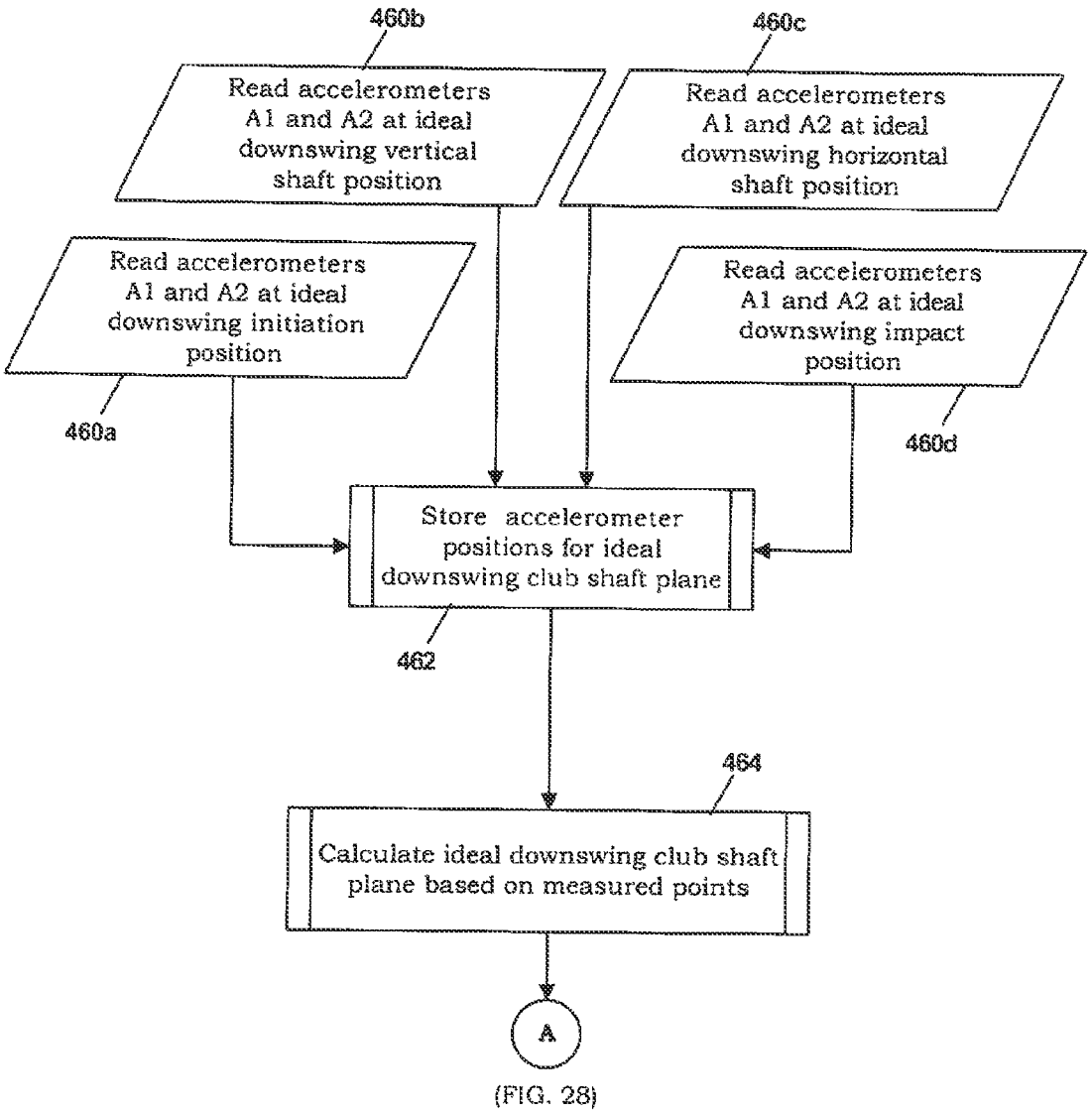
FIG. 31 depicts a flowchart of a method for determining an ideal downswing club shaft plane according to a preferred embodiment of the invention.
Figure 32:
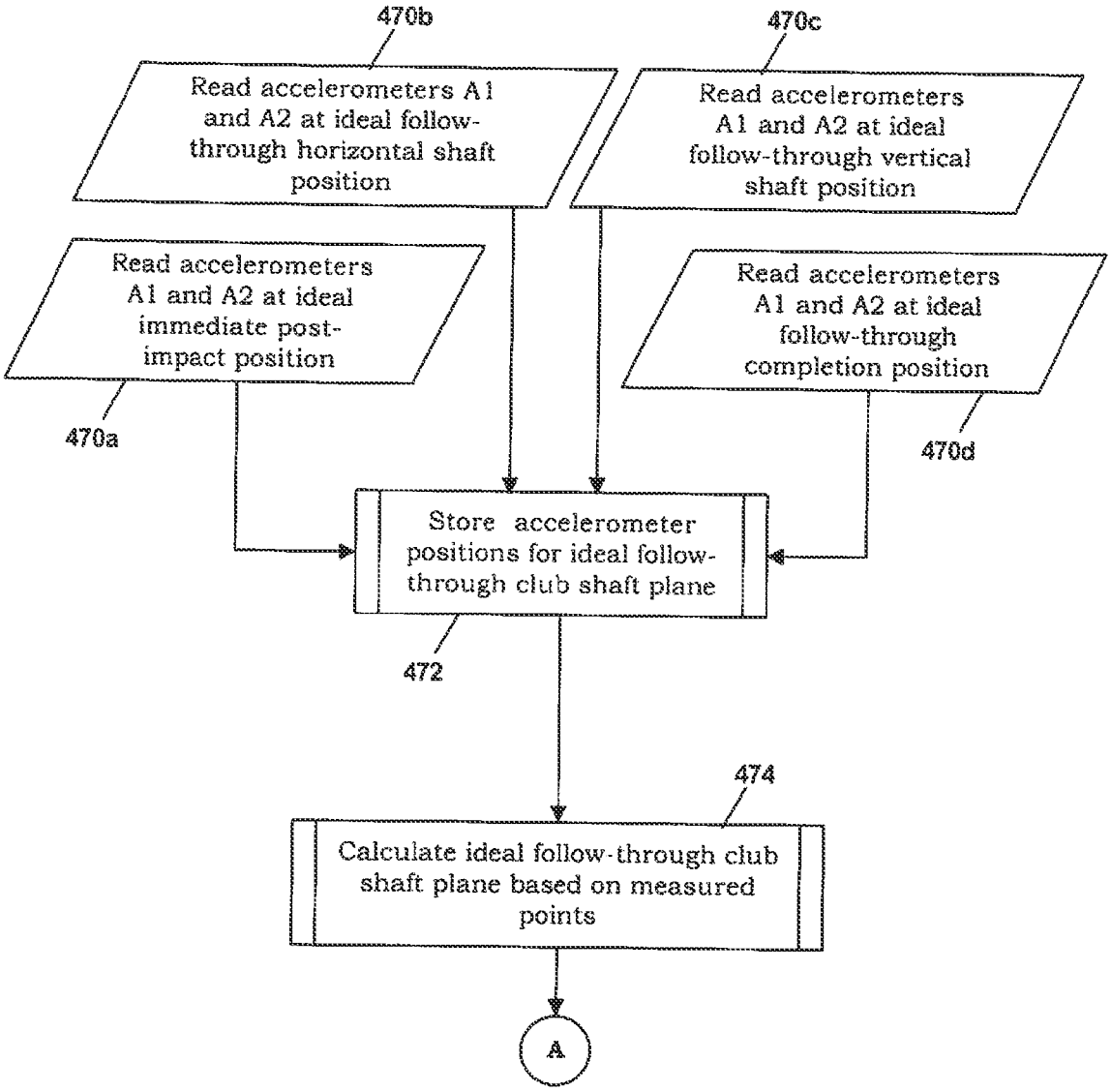
FIG. 32 depicts a flowchart of a method for determining an ideal follow-through club shaft plane according to a preferred embodiment of the invention.

In the preferred embodiment of the invention, the ideal club shaft plane for the three main segments of a swing, referred to herein as the backswing, downswing, and follow-through, is determined according to the method depicted in FIGS. 30, 31 and 32. Each individual golfer has many unique physical characteristics that can affect the orientation of the golfer's ideal club shaft planes, such as height, body proportions, weight, flexibility, etc. Thus, to determine discrete points that lie in the golfer's ideal club shaft planes, it is preferred that a trained professional help the golfer to position the golf club to those positions. Using the accelerometer sensors A1 and A2, the coordinates of the end points of the club are sensed at each of the discrete positions in the ideal club shaft plane for each of the three main segments.

For the backswing (FIG. 30), four "ideal" discrete points are determined at the address position (segment 1), the backswing horizontal position (segment 3), the backswing vertical position (segment 5) and the backswing completion position (segment 7). With the club shaft representing the hand of a clock, the address position of the club is at about the six-o'clock position, corresponding to the position at which the golfer addresses the golf ball. The backswing horizontal position of the club is at the nine o'clock "toe up" position in the backswing of a right-handed golfer (from the perspective of a person facing the golfer). The backswing vertical position of the club is at the twelve o'clock position in the backswing. The backswing completion position corresponds to about the three o'clock toe down position in the backswing of a right-handed golfer (again from the perspective of a person facing the golfer). For a left-handed golfer, the backswing horizontal position is three o'clock toe up and the backswing completion position is nine o'clock toe down.

Thus, according to the preferred embodiment depicted in FIG. 30, the professional assists in placing the golfer and muscle trainer 350 in, at least, these four positions in the golfer's ideal backswing club shaft plane and the signals from the accelerometers A1 and A2 are read while the muscle trainer 350 is held stationary at each position (steps 410*a*, 410*b*, 410*c*, 410*d*). Each of these positions is stored in memory accessible to the processor 353 (step 412) and is used in calculating the ideal backswing club shaft plane (step 414). In the preferred embodiment, the calculation of the ideal club shaft plane is based on interpolating between the four or more measured points of accelerometers A1 and A2 using a three-dimensional curve-fitting routine. Enhanced accuracy of the ideal club shaft plane determination can be obtained by increasing the number of stored ideal positions.

Preferably, the same method is used for the downswing and follow-through as depicted in FIGS. 31 and 32 respectively. Once again, only four positions each are represented for the downswing and follow-through, but more ideal positions can be stored to obtain enhanced accuracy of the ideal club shaft plane calculations.

At step 416 in FIG. 28, the club shaft plane at any given sampling interval during an actual swing (step 408) is then compared to the ideal club shaft plane at that point, where the ideal club shaft planes are calculated at step 414 in FIG. 30, step 464 in FIG. 31, and step 474 in FIG. 32. If the difference between the actual club shaft plane and the ideal club shaft plane at any sampling interval during an actual swing is greater than a predetermined shaft plane tolerance (step 418), then an error condition (behind or in front of the ideal club shaft plane) exists, the direction and magnitude of the error are determined, and corresponding error signals are generated (step 420).

Muscle Training Based on Swing Errors

The error signals are provided to the controller 355 (FIG. 27) which generates control signals for controlling the magnitude and direction of force generators, such as the force generators 370*a*, 370*b* and 370*c* depicted in FIG. 26 (step 422). The error signals may be provided to the controller 355 via a wired interface with the processor 353 or via a wireless link provided by a wireless transmitter unit 309*a*. The control signals generated by the controller 355 are used to drive the force generators to create forces in three dimensions to urge the muscle trainer 350 (FIG. 26) in the appropriate directions for proper conditioning of the muscles. At any given point during the swing, the direction of the training force is substantially identical to the direction of the error movement at that point and the strength of the training force is proportional to the magnitude of the error signal at that point. The three dimensions of control are represented in FIG. 26 by the arrows 372*a*, 372*b* and 372*c*. The arrow 372*a* represents forces generated by the force generator 370*a* in the club shaft plane, the arrow 372*b* represents forces generated by the force generator 370*b* in the club face plane, and the arrow 372*c* represents rotational forces generated by the force generator 370*c* about the club shaft 364. It should also be appreciated that there could be more than three force generators positioned on muscle trainer 350, and that one such additional force generator could be positioned to generate a force in either of two directions which coincide with the axis of shaft 364.

As shown in FIG. 27, the control signals may be provided to the force generators 370*a*, 370*b* and 370*c* via a wired connection with the controller 355 or via a wireless link provided by a wireless transmitter unit 309*b*.

It will be appreciated that the force generators 370*a*, 370*b* and 370*c* depicted in FIG. 26 represent any means for generating force vectors in the directions indicated by the arrows 372*a*, 372*b* and 372*c*, respectively. For example, the force generators 370*a*, 370*b* and 370*c* of FIG. 26 may be thrust generating devices as described herein, such as the motor and blade assembly shown in FIG. 10 or the jet engine assembly shown in FIG. 11. Thus, the invention is not limited to any particular type of device for generating forces in the directions indicated by the arrows 372*a*, 372*b* and 372*c*.

It follows that at any given sampling interval during an actual swing, if the actual club shaft plane is located in front of the ideal club shaft plane and the difference is greater than the shaft plane tolerance (step 418), there is an in-front-of-the-plane error condition and the corresponding error signals are generated (step 420). If the actual club shaft plane is located behind the ideal club shaft plane and the difference is greater than the shaft plane tolerance, there is a behind-the-plane error condition and the corresponding error signals are generated (step 420). In either case, the error signals are provided to the controller 355 (FIG. 27) which generates the control signals to control the magnitude and direction of the force generator 370*a* on the muscle trainer 350 (step 422). At any given point in the swing, the direction of the training force is substantially identical to the direction of the error movement at that point and the magnitude of the training force generated is proportional to the magnitude of the error signal at that point (step 424).

If the difference between the actual club shaft plane and the ideal club shaft plane at any point in the swing (step 416) is less than or equal to the shaft plane tolerance (step 418), then an in-the-ideal-shaft-plane condition is indicated at that point and the force generator 370*a* (FIG. 26) is turned off at that point (step 430).

Preferably, determination of the shaft plane tolerance (step 426 in FIG. 28) is based at least in part on inputting the level of skill of the golfer (step 428), i.e., beginner, intermediate or advanced. This allows players of any caliber to benefit from the use of the muscle trainer 350. In the preferred embodiment, the shaft plane tolerance is not set less than a value equal to twice the standard error as determined by the combined accuracy of the accelerometers and the numerical method applied at step 408. The standard error may be determined by repetitive calculation of the actual club shaft plane as the muscle trainer 350 is repetitively swung through a highly repeatable path using a mechanical swinging device.

Figure 29:
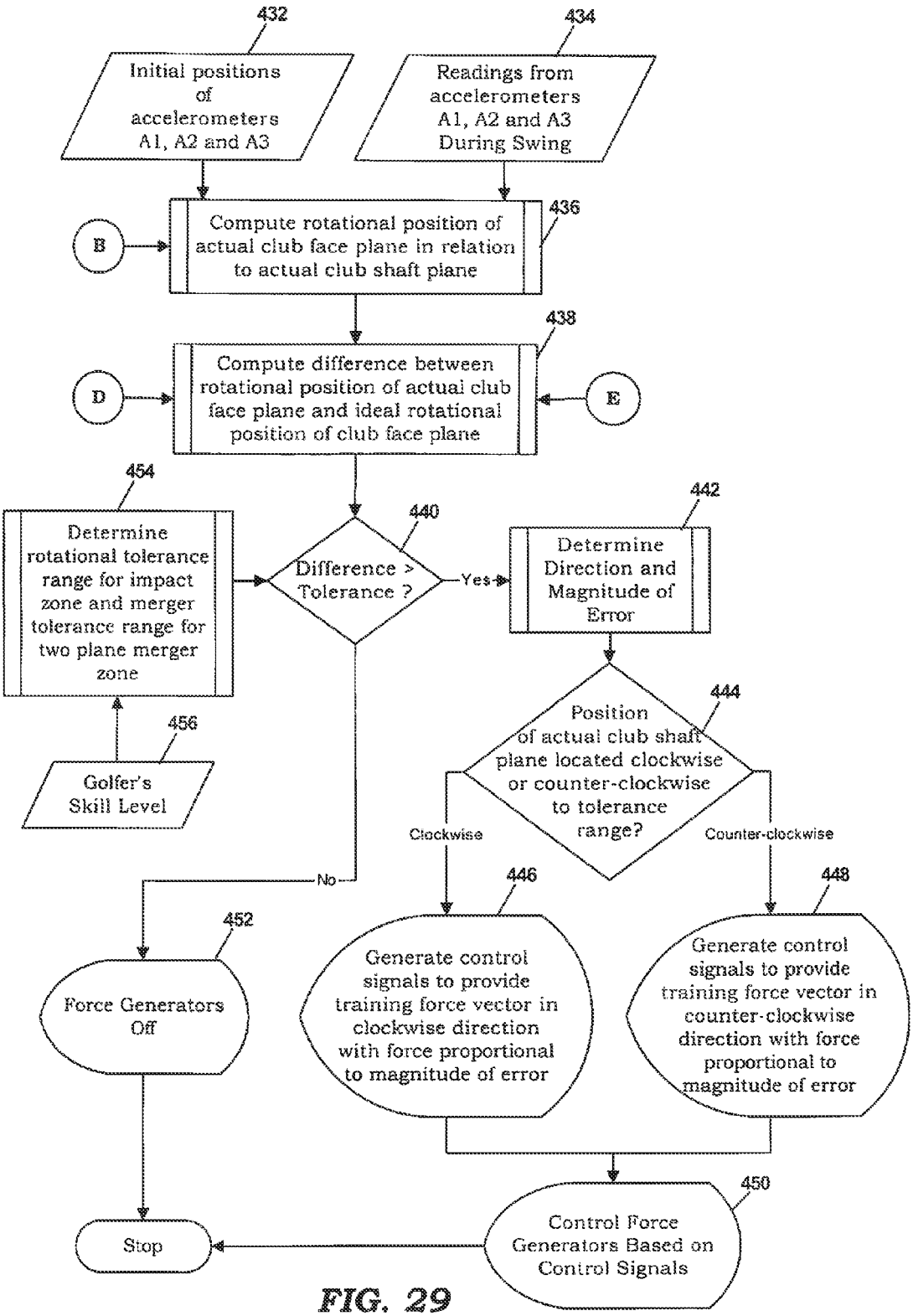
FIG. 29 depicts a flowchart of a method for determining a relationship between a club shaft plane and a club face plane during a swing of a swing training implement according to a preferred embodiment of the invention.
Figure 35:
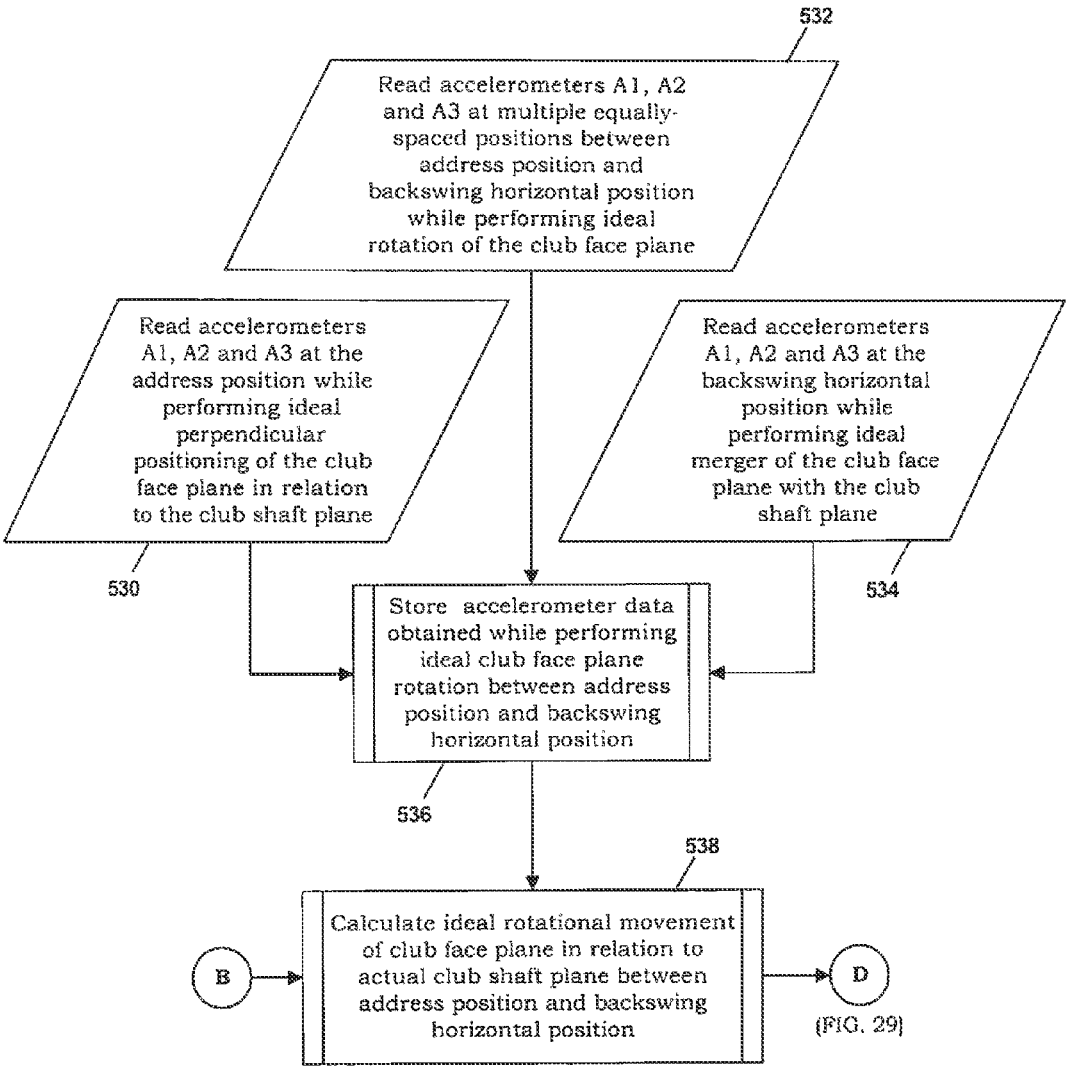
FIG. 35 depicts a flowchart of a method for determining an ideal rotational movement during a swing of a swing training implement between an address position and a backswing horizontal position according to a preferred embodiment of the invention.
Figure 36:
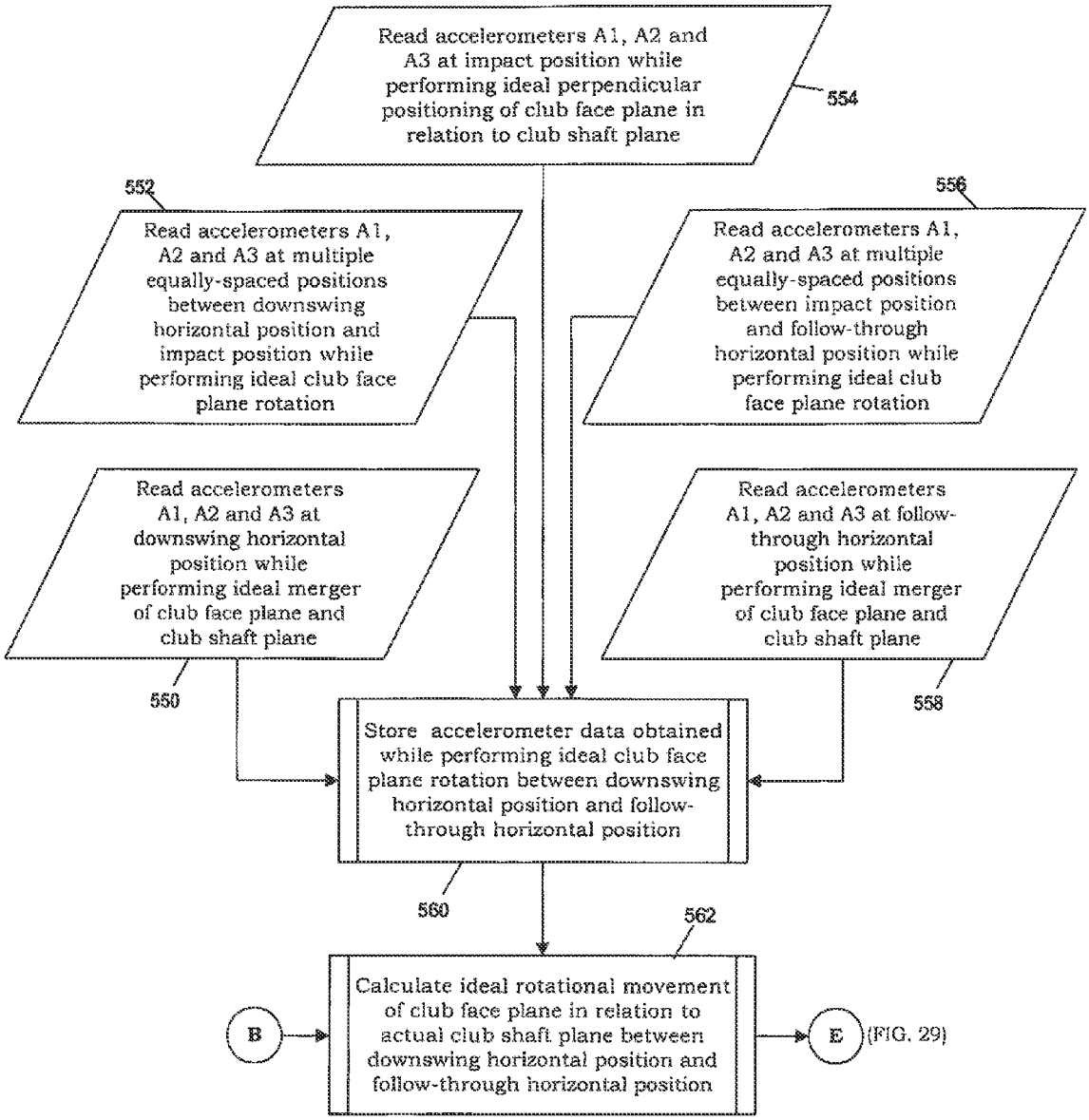
FIG. 36 depicts a flowchart of a method for determining an ideal rotational movement during a swing of a swing training implement between a downswing horizontal position and a follow-through horizontal position according to a preferred embodiment of the invention.

Calculation of the club face plane proceeds as depicted in FIGS. 29, 35 and 36. As discussed previously, the club face plane is a true plane representing the position of the club face as if the club face had zero degrees of loft. The club face plane can be envisioned as an extension of a zero-degree club face that also passes through the shaft of the club. At the address position of the club, the club face plane is ideally a vertical plane that is essentially perpendicular to the club shaft plane.

To provide proper training of the movement of the club face plane in relationship to the club shaft plane, the full swing is divided by a horizontal line running through the nine o'clock toe up and three o'clock toe up positions (for the right-handed golfer). The half of the swing above the dividing horizontal line includes all segments of the backswing, downswing, and follow-through which occur above the horizontal line (Initial Hinging, Backswing Vertical, Finish Hinging, Backswing Completion, Downswing Initiation, Downswing Vertical, Downswing Middle, Re-Hinging, Follow-Through Vertical, Finish Re-Hinging, and Follow-Through Completion) and is referred to as the two-plane-merger zone of the swing. Motion errors within the two-plane-merger zone of the swing are represented by the probability diagram in FIG. 25A. The other zone of the swing which exists below the dividing horizontal line includes all segments of the backswing, downswing, and follow-through which occur below the horizontal line (Address, Take-Away, Downswing Release, Impact, and Impact Follow-Through) and is referred to as the two plane perpendicular zone or impact zone of the swing. Motion errors within the two plane perpendicular zone of the swing are represented by the probability diagram in FIG. 25B.

As shown in FIG. 35, the professional assists in placing the golfer and the muscle trainer 350 in multiple equally spaced positions between the address position and the backswing horizontal position. These positions represent ideal rotational movement of the club face plane in relation to the club shaft plane during this portion of the backswing. The signals from accelerometers A1, A2, and A3 are read at each of these stationary positions (steps 530, 532, and 534). Each of these positions is stored in memory accessible to the processor 353 (step 536) and is used in calculating the ideal club face plane movement during this portion of the swing (step 538). Specifically, the processor computes and stores the perpendicular distance between the club shaft plane and the ideal position of accelerometer A3. This perpendicular distance between the club shaft plane and the ideal position of accelerometer A3 will be at a maximum value at the address position and should approach zero at or near the backswing horizontal position. Another method of determining the ideal position of the club face plane in relationship to the club shaft plane is to compute the rotation angle between the two at each sample interval (angular method). This rotation angle value will be ninety degrees at the address position and should approach zero at or near the backswing horizontal position. Enhanced accuracy of the ideal club face plane rotation determination can be obtained by increasing the number of stored ideal positions.

Once the backswing has entered the two plane merger zone (at or near the backswing horizontal position), ideal rotational movement ceases and the club face plane should remain in a relatively constant relationship merged with the club shaft plane until the swing approaches the downswing horizontal position. As the downswing enters the impact zone (at or near the downswing horizontal position), the position of accelerometer A3 begins a period of rapid change in which it moves away from the merged position in a direction above the club shaft plane to the impact (or two plane perpendicular) position and then back towards the club shaft plane with merger occurring again at or near the follow-through horizontal position.

As shown in FIG. 36, the professional assists in placing the golfer and the muscle trainer 350 in multiple equally spaced positions between the downswing horizontal position, the impact position, and the follow-through horizontal position. These positions represent ideal rotational movement of the club face plane in relation to the club shaft plane during this portion of the swing. The signals from accelerometers A1, A2 and A3 are read at or near each of these stationary positions (steps 550, 552, 554, 556, and 558). The accelerometer data for each of these positions is stored in memory accessible to the processor 353 (step 560) and is used in calculating the ideal clubface plane movement during this portion of the swing (step 562). Specifically, the processor computes and stores the perpendicular distance between the club shaft plane and the ideal position of accelerometer A3. This perpendicular distance between the club shaft and the ideal position of A3 will be zero at or near the downswing horizontal position, reach a maximum value at the impact position and return to zero at or near the follow-through horizontal position. If the angular method is used, the angle between the ideal position of the club face plane and the club shaft plane will be zero at or near the downswing horizontal position, ninety degrees at the impact position, and return to zero at or near the follow-through horizontal position. Once again, enhanced accuracy of the ideal club face plane rotation determination can be obtained by increasing the number of stored ideal positions.

Once the follow-through has reentered the two plane merger zone (at or near the follow-through horizontal position), ideal rotational movement ceases and the club face plane should remain in a relatively constant relationship merged with the club shaft plane until the swing ends (follow-through completion position).

As shown in FIG. 29, during an actual swing with muscle trainer 350, the initial positions of accelerometers A1, A2 and A3 are determined at the beginning of the swing (step 432) with the muscle trainer in the address position. As the muscle trainer 350 is swung, the accelerometer signals from A1, A2 and A3 are sampled at about one millisecond (or smaller) intervals (step 434). The sampled acceleration data is provided to the numerical ordinary differential equation (ODE) solver running on the processor 353, which calculates the club face plane based on the positions of the accelerometers A1, A2 and A3 measured at each sample interval (step 436). These three position points at each sample interval define the club face plane during the swing. The rotational position of the actual club face plane in relation to the actual club shaft plane can then be determined at any sampling interval (step 436).

With reference to FIG. 26, the preferred viewing perspective for an observer to visualize the rotational tolerance range and the merger tolerance range during an actual swing is to imagine a pair of eyes positioned near the end of the club shaft 364 adjacent the accelerometer A2 looking toward accelerometer A1. This preferred viewing perspective for an observer will hereinafter be referred to as the "observer's ideal club face plane viewing perspective." At the address position, the ideal club face plane would be between the two eyes, with the distance from the ideal club face plane to the right eye and the distance from the ideal club face plane to the left eye being equal. As the swing begins, the eyes move with the club shaft 364 and rotate as needed to maintain their fixed angular relationship to the ideal club face plane so that the ideal club face plane is centered between the two eyes throughout the swing. In the backswing completion position, the pair of eyes will be looking approximately 180 degrees away from the target. In viewing a right-handed golfer, deviation of the actual club face plane outside of the tolerance range toward the right eye is said to be occurring in a clockwise or under-rotated direction. Likewise, deviation of the actual club face plane outside of the tolerance range towards the left eye is said to be occurring in a counter-clockwise or over-rotated direction.

The imaginary pair of eyes could also be positioned adjacent the grip end of club shaft 364 where the accelerometer A1 is positioned looking toward accelerometer A2. This viewing perspective will, hereinafter, be referred to as the "golfer's ideal club face plane viewing perspective." In using this golfer's ideal club face plane viewing perspective for a right handed golfer, clockwise deviation toward the right eye would represent over-rotation and counter-clockwise rotation toward the left eye would represent under-rotation. For both the observer's ideal club face plane viewing perspective and the golfer's ideal club face plane viewing perspective, the imaginary eyes could also be attached at any point along club shaft 364, either looking toward accelerometer A1 or toward accelerometer A2.

For all variations of the imaginary pair of eyes discussed above, the eyes could be replaced by a miniature video camera with a viewing perspective axis (line of sight) coinciding with the club face plane. However, a video camera in these positions would rotate with the actual club face plane. Combined with a computer generated representation of the ideal club face plane, this video perspective could be very useful to both the golfer and the teaching professional.

Using the observer's ideal club face plane viewing perspective at any given sampling interval in the portion of an actual swing between the address position and the backswing horizontal position, if the actual club face plane is located outside of the rotational tolerance range and is on the clockwise side of the tolerance range (step 444 in FIG. 29), there is an under-rotation (or clockwise rotational) error condition and the corresponding error signals are generated (step 446). If the position of the actual club face plane is located outside of the rotational tolerance range and is on the counterclockwise side of the tolerance range (step 444), there is an over-rotation (or counterclockwise rotational) error condition and the corresponding error signals are generated (step 448). In either case, the error signals are provided to the controller 355 (FIG. 27) which generates the control signals to control the magnitude and direction of the force generator 370*c* on the muscle trainer 350. (step 450). At any given point in the swing, the direction of the training force is substantially identical to the direction of the error movement at that point and the magnitude of the training force generated is proportional to the magnitude of the error signal at that point.

Using the observer's ideal club face plane viewing perspective at any given sampling interval in the portion of an actual swing between the address position and the backswing horizontal position, if the actual club face plane is located within the rotational tolerance range (step 440), then an ideal rotation condition is indicated at that point and the force generator 370*c* (FIG. 23) is turned off at that point (step 452).

Using the observer's ideal club face plane viewing perspective at any given sampling interval in the portion of an actual swing between the backswing horizontal position, the backswing completion position, and the downswing horizontal position, if the actual clubface plane is located outside the merger tolerance range (step 440) and is on the clockwise side (for a right-handed golfer) (step 444), then there is an under-rotation (or clockwise rotational) error condition and the corresponding error signals are generated (step 446). If the position of the actual club face plane is located outside of the merger tolerance range and is on the counterclockwise side of the tolerance range (step 444), there is an over-rotation (or counterclockwise rotational) error condition and the corresponding error signals are generated (step 448). In either case, the error signals are provided to the controller 355 (FIG. 27) which generates the control signals to control the magnitude and direction of the force generator 370*c* on the muscle trainer 350 (step 450). At any given point in the swing, the direction of the training force is substantially identical to the direction of the error movement at that point and the magnitude of the training force generated is proportional to the magnitude of the error signal at that point.

Using the observer's ideal club face plane viewing perspective at any given sampling interval in the portion of an actual swing between the backswing horizontal position, the backswing completion position, and the downswing horizontal position, if the actual club face plane is located within the merger tolerance range (step 440), then a merged condition is indicated at that point and the force generator 370*c* (FIG. 23) is turned off at that point (step 452).

Using the observer's ideal club face plane viewing perspective at any given sampling interval in the portion of an actual swing between the downswing horizontal position, the impact position, and the follow-through horizontal position, if the actual club face plane is located outside of the rotational tolerance range and is on the clockwise side (for a right-handed golfer) of the tolerance range (step 444), there is a hook (or clockwise rotational) error condition and the corresponding error signals are generated (step 446). If the position of the actual club face plane is located outside of the rotational tolerance range and is on the counterclockwise side of the tolerance range (step 444), there is a slice (or counterclockwise rotational) error condition and the corresponding error signals are generated (step 448). In either case, the error signals are provided to the controller 355 (FIG. 27) which generates the control signals to control the magnitude and direction of the force generator 370*c* on the muscle trainer 350 (step 450). At any given point in the swing, the direction of the training force is substantially identical to the direction of the error movement at that point and the magnitude of the training force generated is proportional to the magnitude of the error signal at that point.

Using the observer's ideal club face plane viewing perspective at any given sampling interval in the portion of an actual swing between the downswing horizontal position, the impact position, and the follow-through horizontal position, if the actual club face plane is located within the rotational tolerance range (step 440), then a square condition is indicated at that point and the force generator 370*c* (FIG. 23) is turned off at that point (step 452).

Using the observer's ideal club face plane viewing perspective at any given sampling interval in the portion of an actual swing between the follow-through horizontal position and the follow-through completion position, if the actual clubface plane is located outside the merger tolerance range (step 440) and is on the clockwise side (for a right-handed golfer), then there is an under-rotation (or clockwise rotational) error condition and the corresponding error signals are generated (step 446). If the position of the actual club face plane is located outside of the merger tolerance range and is on the counterclockwise side of the tolerance range (step 444), there is an over-rotation (or counterclockwise rotational) error condition and the corresponding error signals are generated (step 448). In either case, the error signals are provided to the controller 355 (FIG. 27) which generates the control signals to control the magnitude and direction of the force generator 370*c* on the muscle trainer 350 (step 450). At any given point in the swing, the direction of the training force is substantially identical to the direction of the error movement at that point and the magnitude of the training force generated is proportional to the magnitude of the error signal at that point.

Using the observer's ideal club face plane viewing perspective at any given sampling interval in the portion of an actual swing between the follow-through horizontal position and the follow-through completion position, if the actual club face plane is located within the merger tolerance range (step 440), then no error condition is indicated at that point and the force generator 370*c* (FIG. 23) is turned off at that point (step 452). The actual club face plane is said to be merged with the club shaft plane if these conditions are met.

Figure 34:
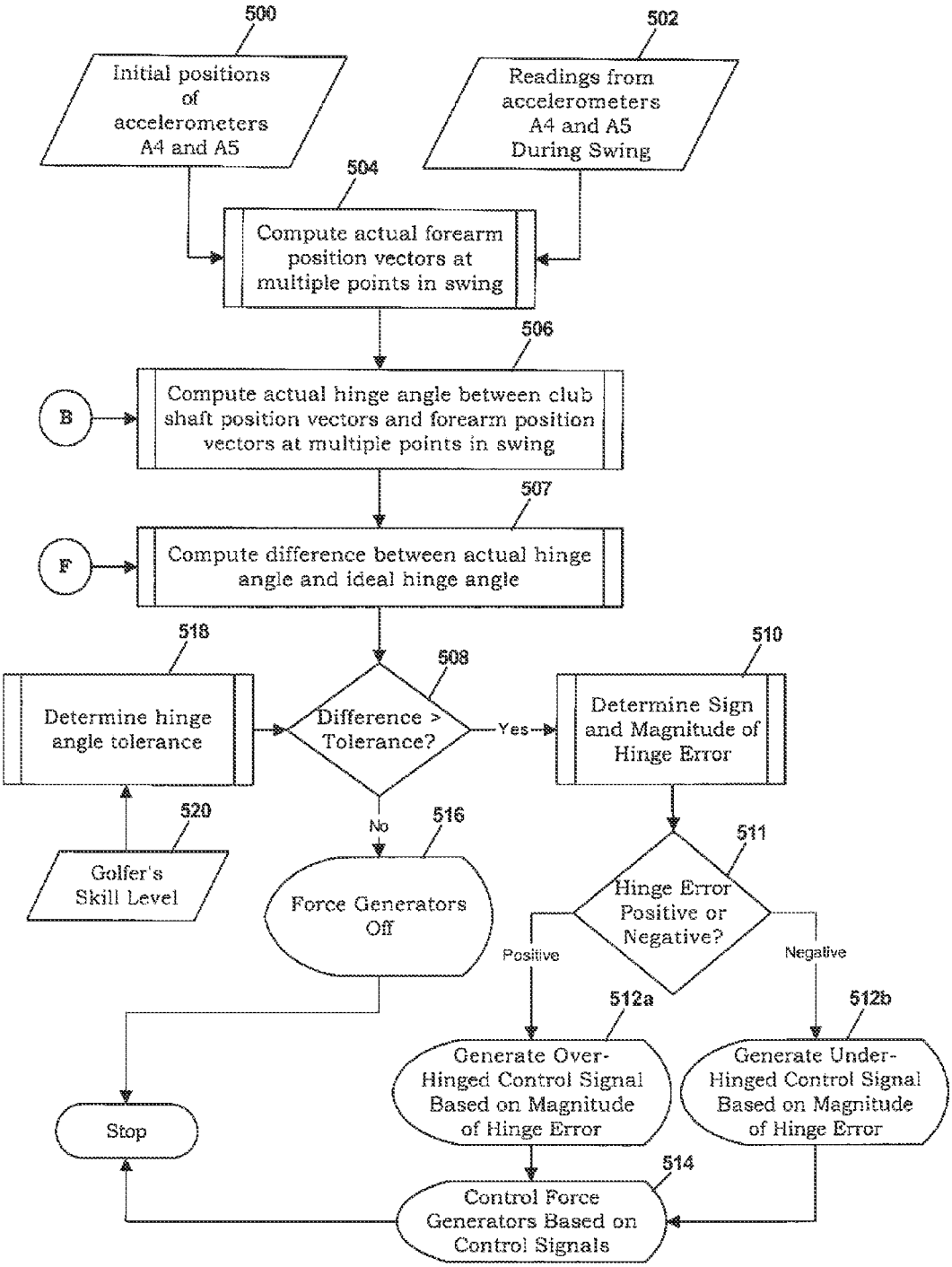
FIG. 34 depicts a flowchart of a method for determining a relationship between an ideal hinge angle and an actual hinge angle during a swing of a swing training implement according to a preferred embodiment of the invention.

As shown in FIG. 34, the initial positions of accelerometers A4 and A5 on the golfer's forearm are determined at the beginning of the swing (step 500) with the club head and shaft positioned at predetermined reference positions. As the muscle trainer 350 is swung, the accelerometer signals from A4 and A5 are sampled at about one millisecond intervals (step 502). The sampled acceleration data is provided to the numerical ODE solver running on the processor 353, which calculates vectors representing the forearm position and orientation based on the signals from the accelerometers A4 and A5 measured at each sample interval (step 504). As shown in FIG. 22B, the hinge angle is then determined to be the angle ($\phi$) between the club shaft position vectors and the forearm position vectors (step 506).

Figure 37:
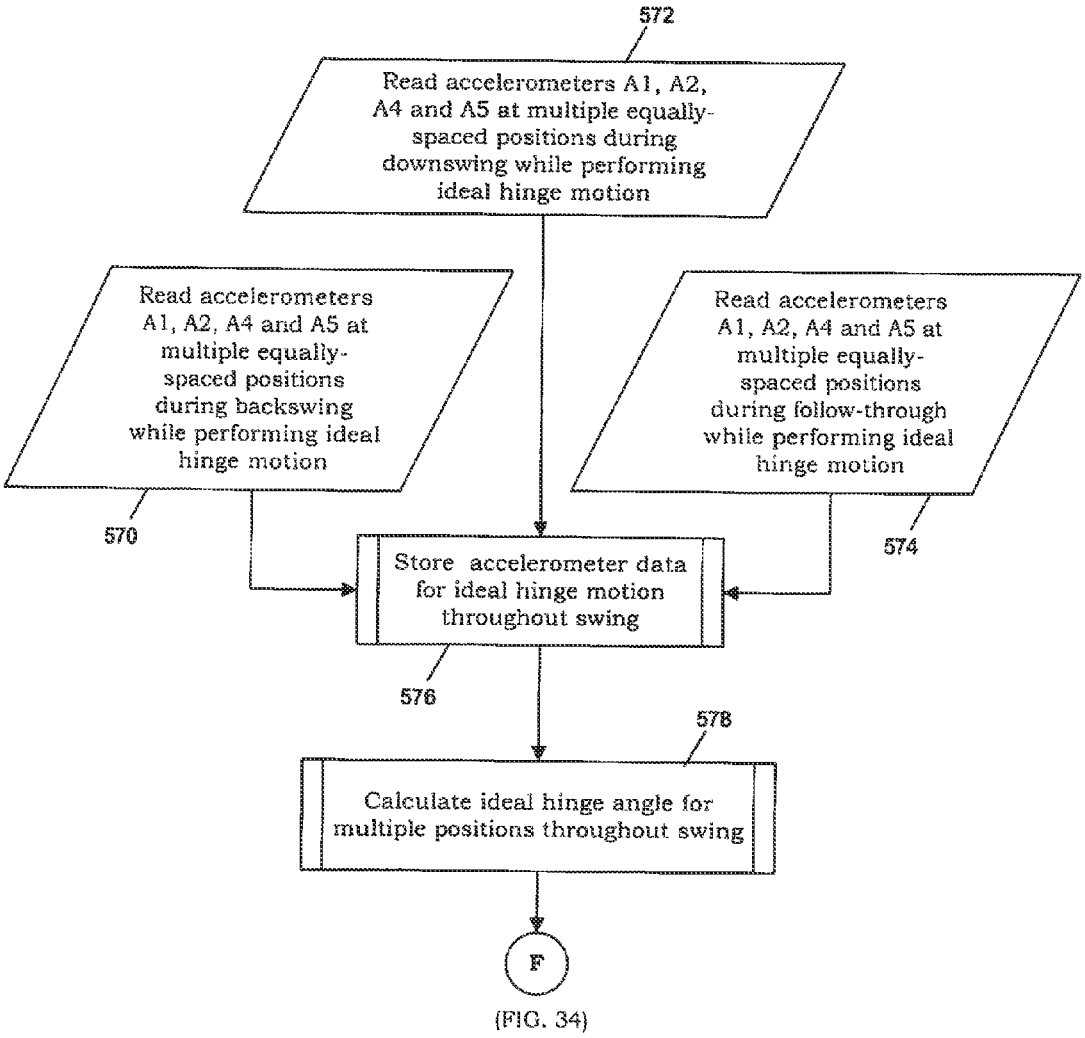
FIG. 37 depicts a flowchart of a method for determining an ideal hinge angle during a swing of a swing training implement according to a preferred embodiment of the invention.

As shown in FIG. 37, the golf training professional assists in placing the golfer and the muscle trainer 350 in multiple equally-spaced ideal positions throughout the swing, including positions in the backswing, the down-swing and the follow-through. These positions represent ideal hinge movement. The signals from accelerometers A1, A2, A4, and A5 are read at each of these stationary positions (steps 570, 572 and 574). Data representing each of these positions are stored in memory accessible to the processor 353 (step 576) and are used in calculating the ideal hinge angle throughout the swing (step 578). In a preferred embodiment, the processor 353 computes and stores the hinge angle ($\phi$) between the club shaft position vectors and the forearm position vectors. Enhanced accuracy of the ideal hinge angle determination can be obtained by increasing the number of stored ideal positions.

With reference again to FIG. 34, the actual hinge angle at any given sampling point during an actual swing is then compared to the ideal hinge angle at the corresponding point (step 507). If the difference between the actual and ideal hinge angles is greater than a predetermined hinge angle tolerance range (step 508), then an error condition exists. In this case, the direction (negative or positive) and magnitude of the error are determined (step 510). If the hinge angle error is positive ($+\phi_E$) (step 511), then an over-hinged control signal is generated based on the magnitude of the over-hinged error (step 512*a*). If the hinge angle error is negative ($-\phi_E$) (step 511), then an under-hinged control signal is generated based on the magnitude of the under-hinged error (step 512*b*). In either case, the error signals are provided to the controller 355 (FIG. 27) which generates the control signals to control the magnitude and direction of the force generator 370*b* on the muscle trainer 350 (step 514).

At any given point in the swing, the direction of the training force is preferably substantially identical to the direction of the error movement at that point and the magnitude of the training force generated is proportional to the magnitude of the error signal at that point. The hinge tolerance range is determined based on data representing the level of skill of the golfer who is using the training device (steps 518 and 520). This tolerance range may be measured in degrees and is preferably set at a smaller angle for professionals than for amateurs.

At any given sampling point during an actual swing, if the actual hinge angle is within the hinge angle tolerance range (step 508), then an ideally-hinged condition is indicated at that point and the force generator 370*b* (FIG. 23) is turned off at that point (step 516).

Figure 38:
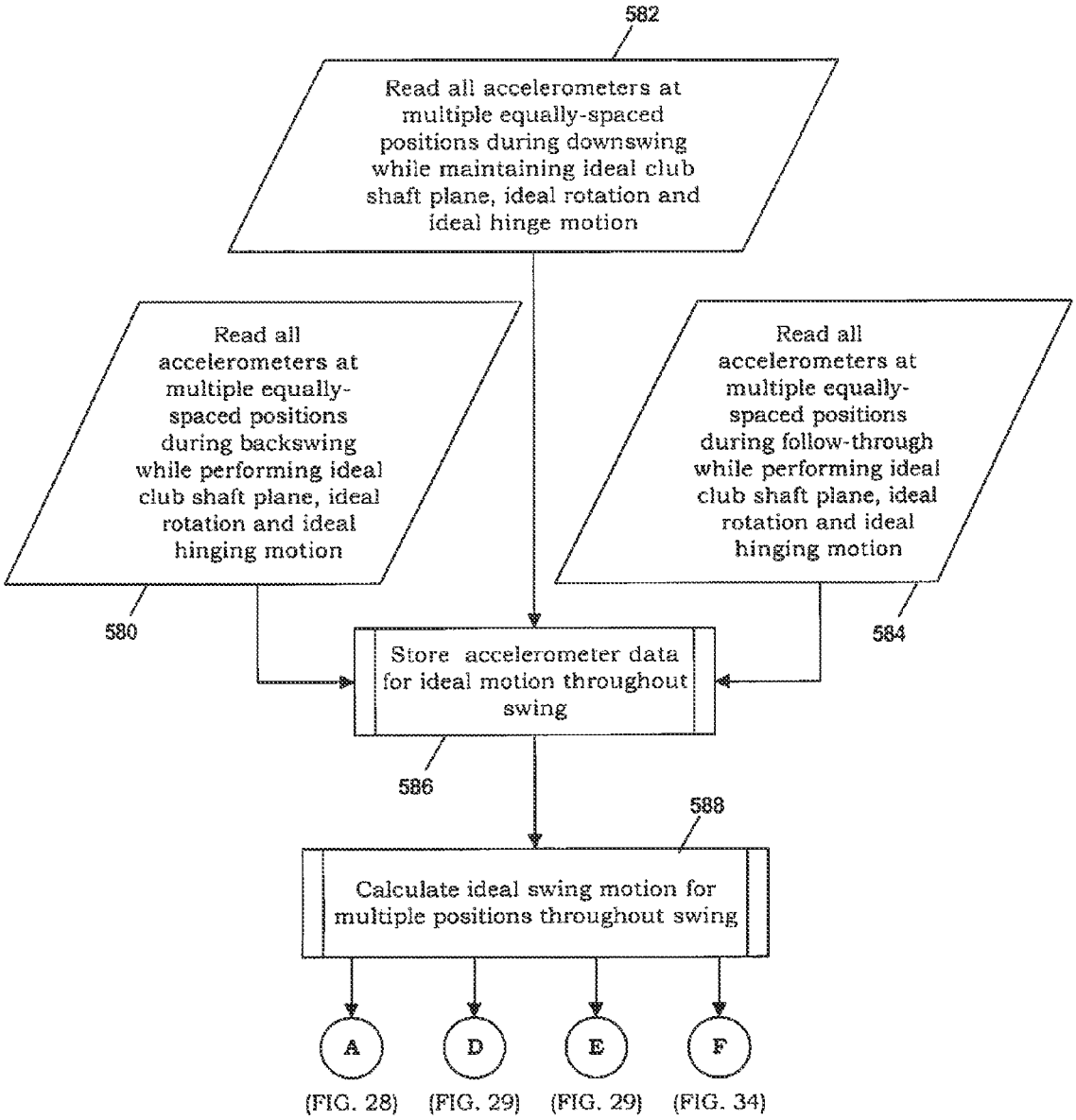
FIG. 38 depicts a flowchart of a method for determining an ideal swing motion during a swing of a swing training implement according to a preferred embodiment of the invention.

As shown in FIG. 38, it will be appreciated that sensor data for determining the ideal club shaft plane positions, ideal rotation positions and ideal hinge motion positions may be collected simultaneously as the professional assists in placing the golfer in multiple positions in the backswing (step 580), downswing (step 582) and follow-through (step 584) portions of the "ideal" swing. In a preferred embodiment, this position data is stored in memory or on a storage device (step 586) and the ideal swing motion, including ideal club shaft plane, ideal rotation motion and ideal hinge motion, may be calculated (step 588) by sub-modules of a comprehensive software program. Thus, the invention is not limited to any particular sequence or timing of the collection of the ideal swing motion data.

Calculation of Angle Between Club Shaft Plane and Club Face Plane

Figure 39:
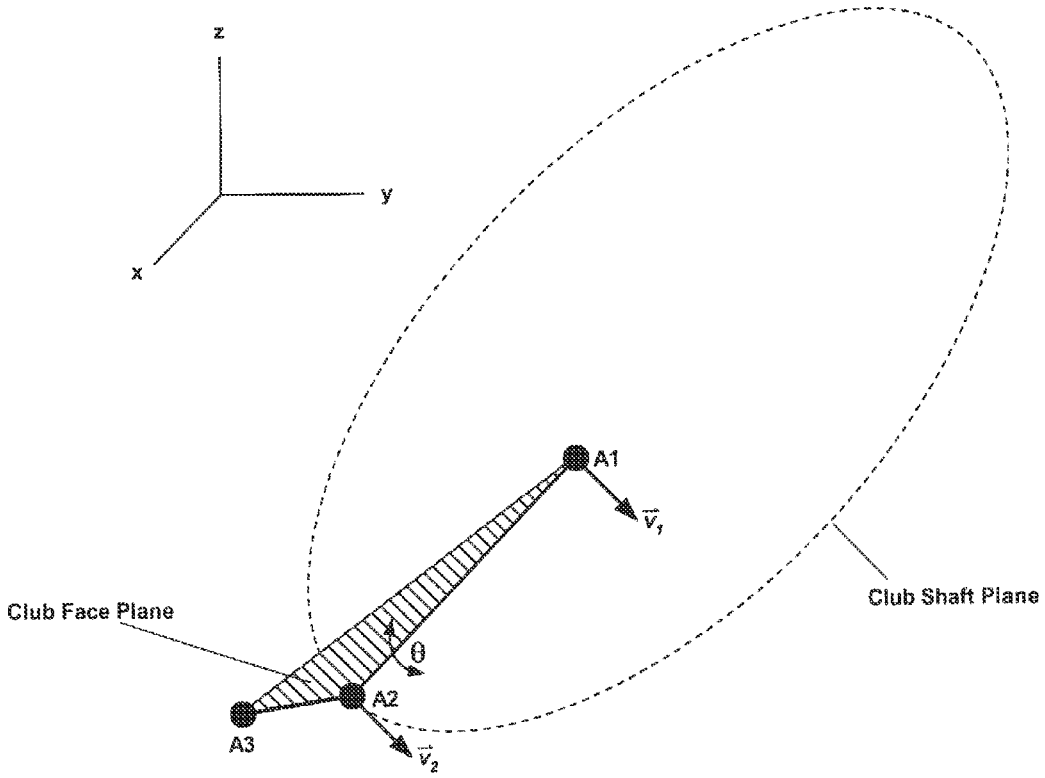
FIG. 39 depicts an angular relationship between an implement shaft plane and an implement face plane.

As discussed at length above, due to motion of a golfer's wrist and arms during a swing, and the twisting motion of the club face, the angle $\theta$ between the club shaft plane and the club face plane varies throughout the swing. As shown in FIG. 39, the club shaft plane is approximated as the surface through which the club shaft travels during a swing. The club face plane is ideally perpendicular to the club shaft plane at the impact position ($\theta$=90 degrees, as depicted in FIG. 39), but the angular relationship between the two planes changes during the swing as the club face plane twists with the rotation of the golfer's wrists. For purposes of the following discussion, the club face plane is the plane defined by the positions of accelerometers A1, A2 and A3, which all lie in the club face plane. Note that accelerometers A1 and A2 also lie in the club shaft plane.

Shaft velocity vectors for A1 and A2 point (approximately) parallel to the club shaft plane throughout the swing. These three-dimensional shaft velocity vectors, referred to herein as first and second shaft velocity vectors and denoted herein as $\vec{v}_1$ and $\vec{v}_2$ respectively, have x, y, and z components and are represented as:

$$\vec{v}_1=\langle v_{1x}, v_{1y}, v_{1z}\rangle \quad \vec{v}_2=\langle v_{2x}, v_{2y}, v_{2z}\rangle \tag{1}$$

In one embodiment, these two shaft velocity vectors are equally weighted, so that an average velocity of the shaft is determined by adding $\vec{v}_1$ and $\vec{v}_2$ together and dividing by two:

$$\vec{v}_{avg,CS}=\frac{\vec{v}_1+\vec{v}_2}{2}=\left\langle\frac{v_{1x}+v_{2x}}{2}, \frac{v_{1y}+v_{2y}}{2}, \frac{v_{1z}+v_{2z}}{2}\right\rangle. \tag{2}$$

This average velocity vector and the shaft lie on the club shaft plane. Thus, the club shaft plane may be thought of as the plane containing accelerometers A1, A2 and the average velocity vector $\vec{v}_{avg,CS}$.

Figure 40A:
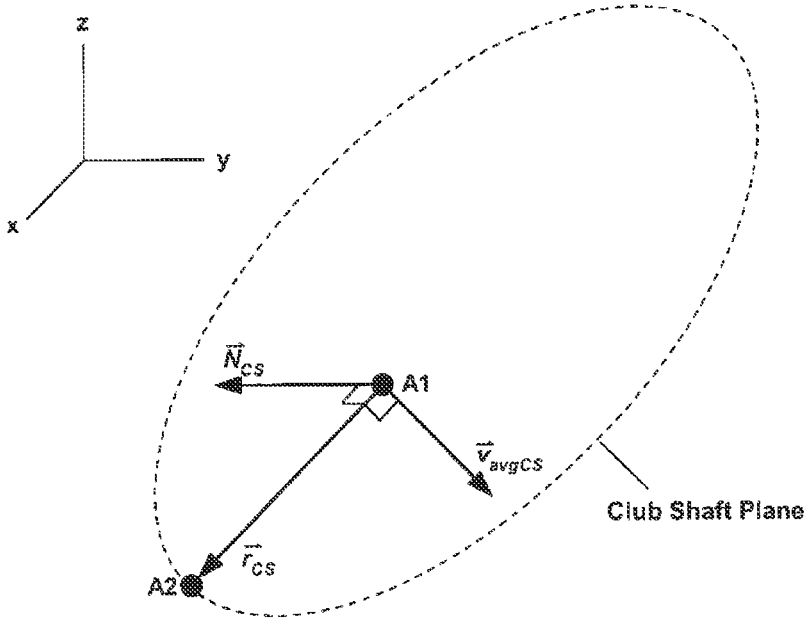
FIGS. 40A-40D depict various vectors used in calculating angular relationships between an implement shaft plane and an implement face plane, and between an implement shaft and a forearm of a person swinging the implement shaft.

As shown in FIG. 40A, the cross-product of the average velocity vector $\vec{v}_{avg,CS}$ and a shaft vector $\vec{r}_{CS}$, which is the displacement vector that joins A1 and A2, yields a first normal vector $\vec{N}_{CS}$, which is a vector perpendicular to the club shaft plane:

$$\vec{N}_{CS}=\vec{r}_{CS}\times\vec{v}_{avg,CS} \tag{3}$$

where $$\vec{r}_{CS}=\langle x_{A2}-x_{A1}, y_{A2}-y_{A1}, z_{A2}-z_{A1}\rangle. \tag{4}$$

Figure 40B:
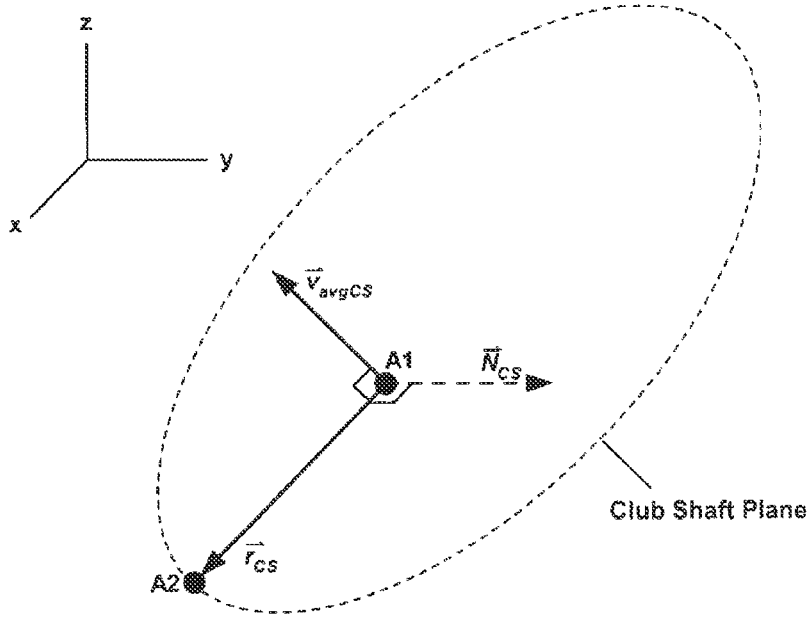

During the backswing, the first normal vector $\vec{N}_{CS}$ points downward and in toward the golfer, as shown in FIG. 40B. During the downswing, the first normal vector $\vec{N}_{CS}$ generally points upward and away from the golfer, as shown in FIG.

40A. This change of direction occurs because the velocity vector $\vec{v}_{avg,CS}$ has roughly opposite directions between the backswing and downswing.

Figure 40C:
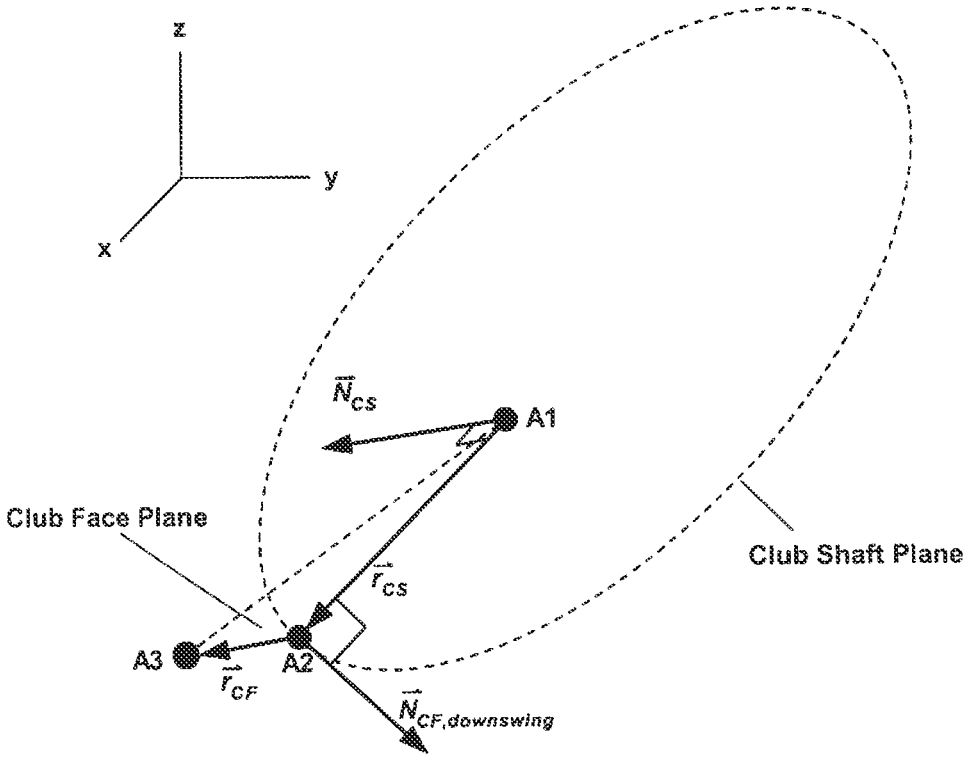

Similar calculations are carried out for the club face plane, which is the plane containing accelerometers A1, A2 and A3. As shown in FIG. 39, the portion of the club face plane disposed between A1, A2 and A3 resembles a triangular sail. As shown in FIG. 40C, this plane may be defined by two vectors that lie along two of the edges of this triangular portion: the shaft vector $\vec{r}_{CS}$, which is the vector from A1 to A2 along the club shaft (defined by equation (4)); and a face vector $\vec{r}_{CF}$, which is the displacement vector along the lower edge of the club face from A2 to A3. The vector $\vec{r}_{CF}$ is expressed as:

$$\vec{r}_{CF}=\left\langle x_{A3}-x_{A2}, y_{A3}-y_{A2}, z_{A3}-z_{A2}\right\rangle. \tag{4}$$

The cross-product of $\vec{r}_{CS}$ and $\vec{r}_{CF}$ yields a second normal vector $\vec{N}_{CF}$ which is perpendicular to the club face plane. In order to determine the angle between the club face plane and club shaft plane, which indicates whether or not they are merged, the normal to the club face plane should point in one direction during the backswing and in the opposite direction during the downswing. To account for this, two second normal vectors are defined as:

$$\vec{N}_{CF,backswing}=\vec{r}_{CS}\times\vec{r}_{CF} \tag{6a}$$

and $$\vec{N}_{CF,downswing}=\vec{r}_{CF}\times\vec{r}_{CS} \tag{6b}$$

FIG. 40C depicts the ideal positioning of the club face plane with respect to the club shaft plane at the point in the swing where the ball is struck by the club face. At that point, $N_{CF,downswing}$ should, ideally, be in the club shaft plane, which means $N_{CF,downswing}$ is substantially perpendicular to $\vec{N}_{CS}$. This condition can be confirmed by calculating the angle between $\vec{N}_{CF,downswing}$ and $\vec{N}_{CS}$. For the downswing, this angle is computed based on the inverse cosine of a dot product between these two vectors, divided by the product of their magnitudes:

$$\theta=\cos^{-1}\left(\frac{\vec{N}_{CF,downswing}\cdot\vec{N}_{CS}}{|\vec{N}_{CF,downswing}||\vec{N}_{CS}|}\right) \tag{7a}$$

Thus, θ is the angle between the club shaft plane and club face plane, as well as the angle between and $\vec{N}_{CF,downswing}$ and $\vec{N}_{CS}$. For the backswing, the angle θ between the club shaft plane and club face plane is calculated as:

$$\theta=\cos^{-1}\left(\frac{\vec{N}_{CF,backswing}\cdot\vec{N}_{CS}}{|\vec{N}_{CF,backswing}||\vec{N}_{CS}|}\right). \tag{7b}$$

In preferred embodiments of the invention, this method for determining the angle θ between the actual club shaft plane and the actual club face plane is applied in the computation step 436 of FIG. 29.

Calculation of Angle Between Golfer's Forearm and Other Planes or Vectors

Data from the accelerometers placed on the golfer's left forearm (A4 and A5) may be used in the same way to determine a "left forearm plane". The angle between the left forearm plane and any of the other planes can be determined by an equation similar to (7a) and (7b). For example, a forearm vector along the left forearm $\vec{r}_{LF}$, an average velocity of the left forearm $\vec{v}_{avg,LF}$, and a vector normal to the left forearm plane $\vec{N}_{LF}$ are expressed as follows:

$$\vec{r}_{LF}=\langle x_{A5}-x_{A4}, y_{A5}-y_{A4}, z_{A5}-z_{A4}\rangle \tag{8}$$

$$\vec{v}_{avg,LF}=\frac{\vec{v}_5+\vec{v}_4}{2}=\left\langle\frac{v_{5x}+v_{4x}}{2}, \frac{v_{5y}+v_{4y}}{2}, \frac{v_{5z}+v_{4z}}{2}\right\rangle \tag{9}$$

$$\vec{N}_{LF}=\vec{r}_{LF}\times\vec{v}_{avg,LF} \tag{10}$$

An angle $\theta_{LFandCS}$ between the left forearm plane and the club shaft plane, for example, is determined according to:

$$\theta_{LFandCS}=\cos^{-1}\left(\frac{\vec{N}_{LF}\cdot\vec{N}_{CS}}{|\vec{N}_{LF}||\vec{N}_{CS}|}\right). \tag{11}$$

Figure 40D:
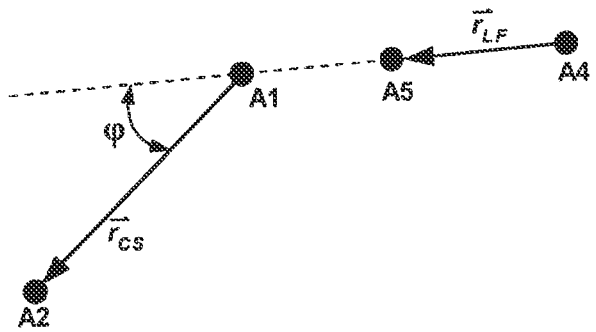

As shown in FIG. 40D, the angle γ is the angle between the left forearm, represented by the forearm vector $\vec{r}_{LF}$, and the club shaft, represented by shaft vector $\vec{r}_{CS}$. This angle γ, which is also referred to herein as the hinge angle, may be calculated as:

$$\varphi=\cos^{-1}\left(\frac{\vec{r}_{LF}\bullet\vec{r}_{CS}}{|\vec{r}_{LF}||\vec{r}_{CS}|}\right). \tag{12}$$

In preferred embodiments of the invention, this method for determining the actual hinge angle ϕ between the club shaft position vector and the golfer's forearm position vector is applied in the computation step 506 of FIG. 34.

In some embodiments, the accuracy of the calculation of the average velocity vector of the club shaft, $\vec{v}_{avg,CS}$, may be enhanced by applying non-equal weighting factors to the individual shaft velocity vectors, $\vec{v}_1$ and $\vec{v}_2$ (FIG. 39). For example, $\vec{v}_{avg,CS}$ could be defined using two weighting parameters, $\alpha_1$ and $\alpha_2$, as follows:

$$\vec{v}_{avg,CS}=\alpha_1\vec{v}_1+\alpha_2\vec{v}_2=\left\langle\alpha_1 v_{1x}+\alpha_2 v_{2x}, \alpha_1 v_{1y}+\alpha_2 v_{2x}, \alpha_1 v_{1z}+\alpha_2 v_{2z}\right\rangle \tag{13}$$

where, $$\alpha_1+\alpha_2=1 \tag{14}$$

is the constraint the weighting parameters must satisfy. Experimentation may reveal the best selection of weighting parameters for defining the club shaft plane and the club face plane.

In some circumstances, at the instant when the club head impacts the ball during a swing, it is desirable for the normal vector $\vec{N}_{CF,downswing}$ to be parallel to the ground. In some embodiments, the velocity vectors representing the velocity measured by the accelerometers A2 and A3 are monitored to insure that they are perpendicular to local gravity. This is based on an assumption that the force of gravity defines a generally vertical direction, and that the direction of the gravity force vector defines the local vertical or z axis. Accordingly, defining the z-axis to be parallel with the earth's local gravity, when the club face impacts the ball, the following conditions are met:

$$\vec{v}_2 \cdot \hat{z} = 0 \quad \vec{v}_3 \cdot \hat{z} = 0 \tag{15}$$

where $\hat{z}$ denotes a unit vector perpendicular to the ground. In one embodiment, a computer system, such as the processor 353 (FIG. 27), monitors the $\vec{v}_2$ and $\vec{v}_3$ vectors at impact and provides an alert to the coach and/or golfer when the conditions of equation (15) are not met.

Various embodiments of the invention described herein provide methods and apparatuses for sensing, calculating and comparing actual and ideal characteristics of a swing of an implement, such as club shaft plane characteristics, club face plane characteristics, rotational characteristics and hinging characteristics. It will be appreciated that the methods and apparatuses described herein have application to other swing-related characteristics, such as arc, velocity and acceleration characteristics of a swing.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. A computer-implemented method of exercising at least a non-dominating implement shaft plane muscle of two opposing implement shaft plane muscles typically used by a person when attempting to move an implement in an ideal implement shaft plane during performance of a useful or recreational function, where the non-dominating implement shaft plane muscle applies a non-dominating implement shaft plane force to the implement in a non-dominating implement shaft plane force direction, and a dominating implement shaft plane muscle of the two opposing implement shaft plane muscles applies a dominating implement shaft plane force to the implement in a dominating implement shaft plane force direction, where the dominating implement shaft plane force direction is substantially opposite the non-dominating implement shaft plane force direction, and the dominating implement shaft plane force exceeds the non-dominating implement shaft plane force, wherein if the two opposing implement shaft plane muscles were of appropriate strength, the two opposing implement shaft plane muscles would desirably apply opposing forces to the implement at appropriate levels to maintain the implement in the ideal implement shaft plane as the implement is moved by the person, the method for training the opposing implement shaft plane muscles to consistently maintain the implement in or near the ideal implement shaft plane during the movement, the method comprising:

(a) sensing movement of a muscle trainer in an implement shaft plane using one or more sensors in electrical communication with a computer processor, wherein the movement is caused by application of implement shaft plane forces exerted by the two opposing implement shaft plane muscles;

(b) determining a difference between the implement shaft plane and the ideal implement shaft plane using the computer processor based on signals generated by the one or more sensors, where the difference indicates the dominating implement shaft plane force direction;

(c) using one or more force generators in electrical communication with the computer processor, applying an external force to the muscle trainer during a movement of the muscle trainer to urge the muscle trainer in the dominating implement shaft plane force direction; and (d) using the non-dominating implement shaft plane muscle during the movement to urge the muscle trainer against the external force to thereby exercise the non-dominating implement shaft plane muscle.

2. The computer-implemented method as set forth in claim 1 further for exercising at least a non-dominating rotational muscle of two opposing rotational muscles typically used by the person when attempting to rotate the implement through an ideal rotation while moving the implement in the implement shaft plane during performance of a useful or recreational function, where the non-dominating rotational muscle applies a non-dominating rotational force to the implement in a non-dominating rotational force direction, and a dominating rotational muscle of the two opposing rotational muscles applies a dominating rotational force to the implement in a dominating rotational force direction, where the dominating rotational force direction is substantially opposite the non-dominating rotational force direction, and the dominating rotational force exceeds the non-dominating rotational force, wherein if the two opposing rotational muscles were of appropriate strength, the two opposing rotational muscles would desirably apply appropriate rotational forces to the implement in substantially opposite directions to execute the ideal rotation of the implement as the implement is moved by the person, the method for training the opposing rotational muscles to consistently execute the ideal rotation of the implement during the movement of the implement in the implement shaft plane, the method further comprising:

(e) while performing step (a), sensing rotation of the muscle trainer through a rotation angle using the one or more sensors, wherein the rotation is caused by application of rotational forces exerted by the two opposing rotational muscles;

(f) determining a difference between the rotation angle and an ideal rotation angle using the computer processor based on the signals generated by the one or more sensors, where the difference indicates the dominating rotational force direction;

(g) using the one or more force generators, applying an external force to the muscle trainer during a movement of the muscle trainer to urge the muscle trainer in the dominating rotational force direction; and (h) using the non-dominating rotational muscle during the movement to urge the muscle trainer against the external force to thereby exercise the non-dominating rotational muscle.

3. The computer-implemented method set forth as in claim 1 further for exercising at least a non-dominating hinge muscle of two opposing hinge muscles typically used by the person when attempting to perform an ideal hinging movement of the implement in a hinge plane while moving the implement in the implement shaft plane during performance of a useful or recreational function, where the non-dominating hinge muscle applies a non-dominating hinge force to the implement in a non-dominating hinge force direction, and a dominating hinge muscle of the two opposing hinge muscles applies a dominating hinge force to the implement in a dominating hinge force direction, where the dominating hinge force direction is substantially opposite the non-dominating hinge force direction, and the dominating hinge force exceeds the non-dominating hinge force, wherein if the two opposing hinge muscles were of appropriate strength, the two opposing hinge muscles would desirably apply appropriate forces to the implement in substantially opposite directions to execute an ideal hinging movement of the implement as the implement is moved by the person, the method for training the opposing hinge muscles to consistently perform the ideal hinging movement of the implement during the movement of the implement in the implement shaft plane, the method further comprising:

(e) while performing step (a), sensing a hinging movement of the muscle trainer through a hinge angle in the hinge plane using the one or more sensors, wherein the hinging movement is caused by application of hinge forces exerted by the two opposing hinge muscles;

(f) determining a difference between the hinge angle and an ideal hinge angle using the computer processor based on the signals generated by the one or more sensors, where the difference indicates the dominating hinge force direction;

(g) using the one or more force generators, applying an external force to the muscle trainer during a movement of the muscle trainer to urge the muscle trainer in the dominating hinge force direction; and (h) using the non-dominating hinge muscle during the movement to urge the muscle trainer against the external force to thereby exercise the non-dominating hinge muscle.

4. A computer-implemented method of exercising at least a non-dominating rotational muscle of two opposing rotational muscles typically used by a person when attempting to rotate an implement through an ideal rotation while moving the implement during performance of a useful or recreational function, where the non-dominating rotational muscle applies a non-dominating rotational force to the implement in a non-dominating force direction, and a dominating rotational muscle of the two opposing rotational muscles applies a dominating rotational force to the implement in a dominating rotational force direction, where the dominating rotational force direction is substantially opposite the non-dominating rotational force direction, and the dominating rotational force exceeds the non-dominating rotational force, wherein if the two opposing rotational muscles were of appropriate strength, the two opposing rotational muscles would desirably apply appropriate rotational forces to the implement in substantially opposite directions to execute ideal rotation of the implement as the implement is moved by the person, the method for training the opposing rotational muscles to consistently execute ideal rotation of the implement during the movement, the method comprising:

(a) sensing rotation of a muscle trainer while rotating the muscle trainer through a rotation angle using one or more sensors in electrical communication with a computer processor, wherein the rotation is caused by application of rotational forces exerted by the two opposing rotational muscles;

(b) determining a difference between the rotation angle and an ideal rotation angle using the computer processor based on signals generated by the one or more sensors, where the difference indicates the dominating rotational force direction;

(c) using one or more force generators in electrical communication with the computer processor, applying an external force to the muscle trainer during a movement to further urge the muscle trainer in the dominating rotational force direction; and (d) using the non-dominating rotational muscle during the movement to urge the muscle trainer against the external force to thereby exercise the non-dominating rotational muscle.

5. The method of claim 4 wherein the external force applied in step (c) has a magnitude which is proportional to the difference determined in step (b).

6. The method of claim 4 wherein steps (b) and (c) are performed substantially simultaneously.

7. The method of claim 4 wherein the implement is a golf club, the person is a golfer, and the muscle trainer has a shape and a weight distribution configured to simulate the shape and weight distribution of a golf club.

8. The method of claim 4 wherein the muscle trainer has a shape and a weight distribution configured to simulate the shape and weight distribution of an implement selected from the group consisting of golf clubs, baseball bats, softball bats, tennis rackets, racket ball rackets, mauls, axes and hammers.

9. The method of claim 4 wherein step (b) includes the computer processor determining a plurality of positions of the muscle trainer during the rotation of the muscle trainer based on the signals generated by the one or more sensors.

10. The computer-implemented method set forth as in claim 4 further for exercising at least a non-dominating hinge muscle of two opposing hinge muscles typically used by the person when attempting to perform an ideal hinging movement of the implement in a hinge plane while rotating the implement through a rotation angle during performance of a useful or recreational function, where the non-dominating hinge muscle applies a non-dominating hinge force to the implement in a non-dominating hinge force direction, and a dominating hinge muscle of the two opposing hinge muscles applies a dominating hinge force to the implement in a dominating hinge force direction, where the dominating hinge force direction is substantially opposite the non-dominating hinge force direction, and the dominating hinge force exceeds the non-dominating hinge force, wherein if the two opposing hinge muscles were of appropriate strength, the two opposing hinge muscles would desirably apply appropriate forces to the implement in substantially opposite directions to execute an ideal hinging movement of the implement as the implement is rotated by the person, the method for training the opposing hinge muscles to consistently execute the ideal hinging movement of the implement during the rotational movement, the method further comprising:

(e) while performing step (a), sensing a hinging movement of the muscle trainer through a hinge angle in the hinge plane using the one or more sensors, wherein the hinging movement is caused by application of hinge forces exerted by the two opposing hinge muscles;

(f) determining a difference between the hinge angle and an ideal hinge angle using the computer processor based on the signals generated by the one or more sensors, where the difference indicates the dominating hinge force direction;

(g) using the one or more force generators, applying an external force to the muscle trainer during a hinging movement to urge the muscle trainer in the dominating hinge force direction; and (h) using the non-dominating hinge muscle during the hinging movement to urge the muscle trainer against the external force to thereby exercise the non-dominating hinge muscle.

11. The method of claim 10 wherein the external force applied in step (g) has a magnitude which is proportional to the difference determined in step (f).

12. The method of claim 10 wherein steps (b), (c), (f) and (g) are performed substantially simultaneously.

13. The method of claim 10 wherein steps (b) and (f) include the computer processor determining a plurality of positions of the muscle trainer during the movement of the muscle trainer based on the signals generated by the one or more sensors.

14. A computer-implemented method for exercising at least a non-dominating hinge muscle of two opposing hinge muscles typically used by a person when attempting to perform an ideal hinging movement of an implement in a hinge plane while moving the implement during performance of a useful or recreational function, where the non-dominating hinge muscle applies a non-dominating hinge force to the implement in a non-dominating hinge force direction, and a dominating hinge muscle of the two opposing hinge muscles applies a dominating hinge force to the implement, where the dominating hinge force direction is substantially opposite the non-dominating hinge force direction, and the dominating hinge force exceeds the non-dominating hinge force, wherein if the two opposing hinge muscles were of appropriate strength, the two opposing hinge muscles would desirably apply appropriate forces to the implement in substantially opposite directions to execute the ideal hinging movement of the implement as the implement is moved by the person, the method for training the opposing hinge muscles to consistently execute the ideal hinging movement of the implement during the movement, the method comprising:

(a) sensing movement of a muscle trainer while performing a hinging movement of the muscle trainer through a hinge angle in the hinge plane using one or more sensors in electrical communication with a computer processor, wherein the hinging movement is caused by application of the hinge forces exerted by the two opposing hinge muscles;

(b) determining a difference between the hinge angle and an ideal hinge angle using the computer processor based on signals generated by the one or more sensors, the difference indicating the dominating hinge force direction;

(c) using one or more force generators in electrical communication with the computer processor, applying an external force to the muscle trainer during a movement to urge the muscle trainer in the dominating hinge force direction; and (d) using the non-dominating hinge muscle during the movement to urge the muscle trainer against the external force to thereby exercise the non-dominating hinge muscle.

15. The method of claim 14 wherein the external force applied in step (c) has a magnitude which is proportional to the difference determined in step (b).

16. The method of claim 14 wherein steps (b) and (c) are performed substantially simultaneously.

17. The method of claim 14 wherein the implement is a golf club, the person is a golfer, and the muscle trainer has a shape and a weight distribution configured to simulate the shape and weight distribution of a golf club.

18. The method of claim 14 wherein the muscle trainer has a shape and a weight distribution configured to simulate the shape and weight distribution of an implement selected from the group consisting of golf clubs, baseball bats, softball bats, tennis rackets, racket ball rackets, mauls, axes and hammers.

19. The method of claim 14 wherein step (b) includes the computer processor determining a plurality of positions of the muscle trainer during the movement of the muscle trainer based on the signals generated by the one or more sensors.

20. A computer-implemented method of exercising at least a non-dominating muscle of two opposing muscles typically used by a person when attempting to perform an ideal movement of an implement during performance of a useful or recreational function, where the non-dominating muscle applies a non-dominating force to the implement in a non-dominating force direction, and a dominating muscle of the two opposing muscles applies a dominating force to the implement in a dominating force direction, where the dominating force direction is substantially opposite the non-dominating force direction, and the dominating force exceeds the non-dominating force, wherein if the two opposing muscles were of appropriate strength, the two opposing muscles would desirably apply opposing forces to the implement at appropriate levels to perform the ideal movement, the method thereby training the opposing muscles to consistently perform the ideal movement, the method comprising:

(a) determining the ideal movement of the implement for the person;

(b) sensing a movement of the implement using one or more sensors in electrical communication with a computer processor, wherein the movement is caused by application of forces exerted by the two opposing muscles of the person;

(c) at a plurality of points during the movement of step (b), determining a difference between the movement of step (b) and the ideal movement determined in step (a) using the computer processor based on signals generated by the one or more sensors, where the difference at each point indicates the dominating force direction at that point;

(d) performing a movement of the implement by application of forces exerted by the two opposing muscles of the person while one or more force generators in electrical communication with the computer processor apply one or more external forces to the implement to urge the implement in the dominating force direction; and (e) using the non-dominating muscle during the movement of step (d) to urge the implement against the one or more external forces to thereby exercise the non-dominating muscle.

21. The method of claim 20 wherein the movement of step (b) and the movement of step (d) are the same movement.

22. The method of claim 20 wherein the one or more external forces applied in step (d) have a magnitude which is proportional to the difference determined in step (c).

23. The method of claim 20 wherein steps (c) and (d) are performed substantially simultaneously.

24. A computer-implemented method for determining an angular relationship between an implement shaft plane and an implement face plane of an implement swung by a person during performance of a useful or recreational function, the implement including a shaft having a proximal end and a distal end, and an implement surface configured to impact an object during the performance of the useful or recreational function, the method comprising:

(a) sensing motion of the proximal end of the shaft using a sensor attached adjacent the proximal end of the shaft, wherein the motion of the proximal end of the shaft is represented by a first shaft velocity vector;

(b) sensing motion of the distal end of the shaft using a sensor attached adjacent the distal end of the shaft, wherein the motion of the distal end of the shaft is represented by a second shaft velocity vector;

(c) using a computer processor in electrical communication with the sensors attached to the shaft, determining an average shaft velocity vector based at least in part on the first shaft velocity vector and the second shaft velocity vector;

(d) using the computer processor, determining a shaft vector aligned with the proximal end of the shaft and the distal end of the shaft;

(e) using the computer processor, determining a first normal vector based on a cross product of the shaft vector and the average shaft velocity vector according to $$\vec{N}_{CS}=\vec{r}_{CS}\times\vec{v}_{avg,CS}$$

where $\vec{N}_{CS}$ is the normal vector, $\vec{r}_{CS}$ is the shaft vector and $\vec{v}_{avg,CS}$ is the average shaft velocity vector;

(f) using the computer processor, determining an implement face vector aligned with the distal end of the shaft and the implement surface;

(g) using the computer processor, determining a second normal vector based on a cross product of the shaft vector and the implement face vector according to $$\vec{N}_{CF}=\vec{r}_{CS}\times\vec{r}_{CF}$$

where $\vec{N}_{CF}$ is the second normal vector, $\vec{r}_{CS}$ is the shaft vector and $\vec{r}_{CF}$ is the implement face vector;

(h) using the computer processor, determining an angle θ between the first normal vector and the second normal vector according to $$\theta=\cos^{-1}\left(\frac{\vec{N}_{CF}\bullet\vec{N}_{CS}}{|\vec{N}_{CF}||\vec{N}_{CS}|}\right);$$

and (i) using a display device in electrical communication with the computer processor, displaying a representation of the angle θ.

25. The method of claim 24 further comprising displaying a representation of relationship of an implement shaft plane and an implement face plane using a display device in electrical communication with the computer processor, wherein the relationship is based at least in part on the angle θ.

26. A computer-implemented method for determining an angular relationship between a shaft of an implement and a forearm of a person moving the implement during performance of a useful or recreational function, where the implement shaft has a proximal end and a distal end, and the forearm has an elbow end and a wrist end, the method comprising:

(a) sensing motion of the shaft using one or more sensors attached to the shaft, (b) using a computer processor in electrical communication with the sensors attached to the shaft, determining a shaft vector aligned with the proximal end of the shaft and the distal end of the shaft based on motion sensed by the one or more sensors attached to the shaft;

(c) sensing motion of the forearm using one or more sensors attached to the forearm, (d) using a computer processor in electrical communication with the sensors attached to the forearm, determining a forearm vector aligned with the elbow end of the forearm and the wrist end of the forearm based on motion sensed by the one or more sensors attached to the forearm;

(e) using a computer processor, determining an angle ϕ between the shaft vector and the forearm vector according to $$\varphi=\cos^{-1}\left(\frac{\vec{r}_{LF}\bullet\vec{r}_{CS}}{|\vec{r}_{LF}||\vec{r}_{CS}|}\right)$$

where $\vec{r}_{CS}$ is the shaft vector and $\vec{r}_{LF}$ is the forearm vector; and (f) using a display device in electrical communication with the computer processor, displaying a representation of the angle ϕ.

27. A computer-implemented method of exercising at least a non-dominating muscle of two opposing muscles typically used by a person when attempting to perform an ideal movement of an implement during performance of a useful or recreational function, where the non-dominating muscle applies a non-dominating force to the implement in a non-dominating force direction, and a dominating muscle of the two opposing muscles applies a dominating force to the implement in a dominating force direction, where the dominating force direction is substantially opposite the non-dominating force direction, and the dominating force exceeds the non-dominating force, wherein if the two opposing muscles were of appropriate strength, the two opposing muscles would desirably apply opposing forces to the implement at appropriate levels to maintain the implement in an ideal path as the implement is moved by the person, the method comprising:

(a) sensing movement of a muscle trainer in a movement path using one or more sensors in electrical communication with a computer processor, wherein the movement is caused by application of forces exerted by the two opposing muscles;

(b) determining a difference between the movement path and the ideal path using the computer processor based on signals generated by the one or more sensors, where the difference indicates the dominating force direction;

(c) using one or more force generators in electrical communication with the computer processor, applying an external force to the muscle trainer during a movement of the muscle trainer to urge the muscle trainer in the dominating force direction; and (d) using the non-dominating muscle during the movement to urge the muscle trainer against the external force to thereby exercise the non-dominating muscle.

28. The method of claim 27 wherein the external force applied in step (c) has a magnitude that is proportional to the difference determined in step (b).

29. The method of claim 27 wherein steps (b) and (c) are performed substantially simultaneously.

30. The method of claim 27 wherein the implement is a golf club, the person is a golfer, and the muscle trainer has a shape and a weight distribution configured to simulate the shape and weight distribution of a golf club.

31. The method of claim 27 wherein the muscle trainer has a shape and a weight distribution configured to simulate the shape and weight distribution of an implement selected from the group consisting of golf clubs, baseball bats, softball bats, tennis rackets, racket ball rackets, mauls, axes and hammers.

32. The method of claim 27 wherein step (b) includes the computer processor determining a plurality of positions of the muscle trainer during the movement of the muscle trainer based on the signals generated by the one or more sensors.

33. The computer-implemented method of claim 27 wherein the two opposing muscles are two opposing implement shaft plane muscles, the non-dominating muscle is a non-dominating implement shaft plane muscle, and the dominating muscle is a dominating implement shaft plane muscle, wherein:

step (a) comprises sensing movement of the muscle trainer in an actual implement shaft plane using the one or more sensors, wherein the movement is caused by application of implement shaft plane forces exerted by the two opposing implement shaft plane muscles;

step (b) comprises determining a difference between the actual implement shaft plane and an ideal implement shaft plane using the computer processor based on the signals generated by the one or more sensors, where the difference indicates a dominating implement shaft plane force direction;

step (c) comprises applying an external force to the muscle trainer using the one or more force generators during a movement of the muscle trainer to urge the muscle trainer in the dominating implement shaft plane force direction; and step (d) comprises using the non-dominating implement shaft plane muscle during the movement to urge the muscle trainer against the external force to thereby exercise the non-dominating implement shaft plane muscle.

34. The computer-implemented method of claim 27 wherein the two opposing muscles are two opposing rotational muscles, the non-dominating muscle is a non-dominating rotational muscle, and the dominating muscle is a dominating rotational muscle, wherein:

step (a) comprises sensing movement of the muscle trainer through an actual rotation angle using the one or more sensors, wherein the movement is caused by application of rotational forces exerted by the two opposing rotational muscles;

step (b) comprises determining a difference between the actual rotation angle and an ideal rotation angle using the computer processor based on the signals generated by the one or more sensors, where the difference indicates a dominating rotational force direction;

step (c) comprises applying an external force to the muscle trainer using the one or more force generators during a movement of the muscle trainer to urge the muscle trainer in the dominating rotational force direction; and step (d) comprises using the non-dominating rotational muscle during the movement to urge the muscle trainer against the external force to thereby exercise the non-dominating rotational muscle.

35. The computer-implemented method of claim 27 wherein the two opposing muscles are two opposing hinge muscles, the non-dominating muscle is a non-dominating hinge muscle, and the dominating muscle is a dominating hinge muscle, wherein:

step (a) comprises sensing movement of the muscle trainer through an actual hinge angle in a hinge plane using the one or more sensors, wherein the movement is caused by application of hinge forces exerted by the two opposing hinge muscles;

step (b) comprises determining a difference between the actual hinge angle and an ideal hinge angle movement using the computer processor based on the signals generated by the one or more sensors, where the difference indicates a dominating hinge force direction;

step (c) comprises applying an external force to the muscle trainer using the one or more force generators during a movement of the muscle trainer to urge the muscle trainer in the dominating hinge force direction; and step (d) comprises using the non-dominating hinge muscle during the movement to urge the muscle trainer against the external force to thereby exercise the non-dominating hinge muscle.

* * * * *